US008330066B2

(12) United States Patent
Xu

(10) Patent No.: US 8,330,066 B2
(45) Date of Patent: Dec. 11, 2012

(54) SWITCH ASSEMBLY

(75) Inventor: Xinsheng Xu, Shanghai (CN)

(73) Assignee: Shanghai Bai Cheng Electric Equipment, Shanghai (CN)

( * ) Notice: Subject to any disclaimer, the term of this patent is extended or adjusted under 35 U.S.C. 154(b) by 173 days.

(21) Appl. No.: 12/717,868

(22) Filed: Mar. 4, 2010

(65) Prior Publication Data

US 2011/0315530 A1 Dec. 29, 2011

Related U.S. Application Data

(62) Division of application No. 11/403,609, filed on Apr. 12, 2006, now Pat. No. 7,705,260.

(30) Foreign Application Priority Data

Apr. 18, 2005 (CN) ..... 2005 1 0065797
Jan. 27, 2006 (CN) ..... 2006 1 0002402

(51) Int. Cl.
*H01H 9/20* (2006.01)

(52) U.S. Cl. ..... 200/522; 200/43.17

(58) Field of Classification Search ..... 200/522, 200/430, 433, 437–439, 330, 332, 334, 335, 200/318.1, 321, 332.2, 43.11–43.17, 61.85
See application file for complete search history.

(56) References Cited

U.S. PATENT DOCUMENTS 4,241,298 A 12/1980 Trammell, Jr. et al.
4,286,125 A 8/1981 Schaffeler et al.
4,307,325 A 12/1981 Saar
4,412,158 A 10/1983 Jefferson et al.
4,459,522 A 7/1984 Huber
4,523,176 A 6/1985 Leibinger et al.
4,756,216 A 7/1988 Lo
4,878,000 A 10/1989 Chen
5,014,793 A 5/1991 Germanton et al.
5,051,547 A 9/1991 Nagata et al.
5,075,604 A 12/1991 Crook et al.
5,084,598 A 1/1992 Nagata et al.
5,198,793 A 3/1993 Leveque
5,289,047 A 2/1994 Broghammer
5,798,584 A 8/1998 Schaeffeler et al.
5,981,885 A 11/1999 Katoh et al.
5,990,429 A 11/1999 Kramer
6,104,105 A 8/2000 Schaeffeler et al.
6,143,998 A 11/2000 Mattes
6,469,268 B1 10/2002 Schaeffeler et al.
6,489,578 B1 12/2002 Jung et al.
6,555,773 B1 4/2003 Broghammer et al.
6,664,490 B2 12/2003 Kato (Continued)

FOREIGN PATENT DOCUMENTS

EP 0199983 11/1986

*Primary Examiner* — Amy Cohen Johnson
*Assistant Examiner* — Marina Fishman
(74) *Attorney, Agent, or Firm* — Lee & Hayes, PLLC

(57) ABSTRACT

A switch assembly provides a pressing plate on a pivot contact lever to minimize heat generation at the point between the pivot contact lever and the contact point by providing an additional parallel connection contact plate which is in parallel connection to the pivot contact lever. The switch assembly provides convex contact portions on the internal output ports of the forward/reverse switch mechanism. A supplementary elastic metal plate to the pivot contact lever is provided to solve the problem of loose contact at the pivot connection site where the pivot contact lever and the support unit meet, and provides a supplementary contact unit to the movable contact device at the forward/reverse switch mechanism.

14 Claims, 67 Drawing Sheets

U.S. PATENT DOCUMENTS 6,717,080 B1 4/2004 Chan et al.
6,727,450 B2 4/2004 Schaeffeler et al.
6,736,220 B1 5/2004 Chan et al.
6,741,051 B2 5/2004 Chu
6,749,028 B1 6/2004 Chan et al.
6,794,594 B2 9/2004 Ching
7,297,891 B2 11/2007 Omori et al.
2004/0041531 A1 3/2004 Chu
2004/0134766 A1 7/2004 Ching

SWITCH ASSEMBLY

RELATED APPLICATION

This application is a divisional of and claims priority to U.S. patent application Ser. No. 11/403,609, filed on Apr. 12, 2006, the disclosure of which is incorporated by reference herein.

BACKGROUND

The present invention relates to an electrical switch, particularly to a high power DC switch, more particularly to a trigger switch used for trigger control of a power tool.

It is publicly known in the art that there is a Marquardt (trademark) 2711.5507 high rating DC switch powered with electricity of 18V DC 25 A. U.S. Pat. No. 6,717,080 discloses a trigger switch assembly used for an electric power tool having an electric motor. U.S. Pat. No. 6,741,051 discloses a trigger controller used for an electric power tool including an electric motor. Also, U.S. Pat. No. 6,104,105 discloses an electrical switch for switching on and off a tool having an electric motor.

A pivot contact lever mechanism is used in all of the above-mentioned switches to switch on and switch off the electric connection. Typically, one end of the pivot contact lever is pivotably attached to a support which is connected to an input terminal for electric current. An output terminal of the electric circuit is attached with a fixed contact. The other end of the pivot contact lever can be pivoted to contact the fixed contact so as to be electrically connected. In these switches, when the pivot contact lever connects the electric circuit, electric current flows through the pivot point between the pivot contact lever and the support, and the pivot contact lever and the fixed contact. However, contact between the pivot contact lever and the support on the pivot point may be not very desirable because it generates a high contact resistance and causes the heating generation and "INT" problem. The INT problem refers to the sparkle that is generated at the contact point due to unstable contact at the contact point under the normal working condition and/or environment. The sparkle, in return, may burn or melt the pivot contact plate, which becomes a more serious problem on a high rating switch.

In addition, the above-mentioned conventional switches have the following deficiency. As a by-pass switch, namely, a second pivot contact lever is provided, when the trigger (a button) is pressed to the innermost position, the second pivot contact lever connects the input and the output. For a high rating switch, the normal operating current is around 25 A. However, the current can be up to 100 A at the very moment when the motor starts or stalls. Thus, even though contact loss is very small for the second pivot contact lever, heat is generated in such a high current situation.

A conventional switch has further deficiency in that a conventional switch is normally provided with a forward/reverse switch mechanism that is able to alternate the pole of the output voltage. Two switch contact plates are provided for the switch mechanism to connect simultaneously two internal outputs to two external outputs, thereby to control the pole of the output. There is only one single convex portion on each internal output that provides a line contact between the switch contact plate and the internal output so as to decrease contact loss. However, such a structure does not effectively minimize heat generation.

SUMMARY OF THE INVENTION

A switch assembly includes a casing; an input terminal secured with respect to said casing and used for electric connection to a supply of an electric voltage; and an output terminal secured with respect to said casing and used for electric connection to an electricity consuming device to be controlled by said switch assembly. A fixed contact portion is secured with respect to said casing and electrically connected to said output port. A support is secured with respect to said casing and electrically connected to said input port. A trigger lever is secured on a trigger and is held on and extends into said casing and is slidable with respect to said casing. A cam is secured to said trigger lever. A trigger spring is attached to said trigger for functioning so that said trigger lever and said trigger are normally in an outermost position, with the trigger being able to be activated by a user from outside said switch assembly.

A pivot contact lever having a second end is provided with a compressed portion, is supported on said support and is pivotably and electrically connected to a pivot connecting point on top of said support. The connecting point between said pivot contact lever and said support is located between said compressed portion and a first end of said pivot contact lever. A pivot contact lever spring is attached to said pivot contact lever, with a connecting point between said pivot contact lever spring and said pivot contact lever being located at a position between the first end of said pivot contact lever and the pivot connecting point. The other end of said pivot contact lever spring is secured with respect to said casing with the pivot contact lever spring functioning so that said first end of said pivot contact lever has a tendency of electric connection to said fixed contact portion.

The cam presses against said compressed portion so that said pivot contact lever pivots to a state in which the second end thereof is cut off from electric connection to said fixed contact portion by overcoming action force from said pivot contact lever spring when said trigger lever and said trigger are normally in the outermost position.

The cam leaves said compressed portion so that said pivot contact lever pivots around said connecting point between itself and said support so that the first end of said pivot contact lever contacts said fixed contact portion so that said input terminal is in electric communication with said output terminal when said trigger is pressed to overcome action force from said pivot contact lever spring so that said trigger lever and said trigger simultaneously slide inwardly. The trigger lever slides outwardly when subjected to the action force from said trigger spring so that said trigger and said trigger lever protrude outwardly when said trigger is released.

An alternative switch assembly includes a housing, current input unit, at least one pivot contact part, and an elastic metal plate. Said pivot contact part is equipped with a current input side and a current output side. Said pivot contact part is used to receive electric current from said current input unit and to deliver the received electric current to the current output unit.

The current output unit is used to receive electric current from said pivot contact part and to deliver the received electric current to the other parts on said switch assembly or to the power-driven equipment under the control of the switch assembly. There are fixed contact units on said current input unit and said current output unit, and each of said fixed contact units is equipped with fixed contact surfaces. Said current input side stays in contact with said current input unit, and said pivot contact part is able to pivot on the contact unit, between the first position and the second position. Said current input unit is in contact with the pivot contact part, and on said first position, the current output side of said pivot contact part stays disconnected from said current input unit, while on the second position of said pivot contact part, the current output side of said pivot contact part is in contact with said current output unit;

The elastic metal plate is used as an additional contact with said current input unit for electric conduction, and is fixed to said pivot contact part. One portion of said elastic metal plate is fixed to said pivot contact part so as to make the other portion of the metal plate press firmly on said current input unit through the elasticity of said elastic metal plate to implement supplementary conduction between said pivot contact part and said current input unit.

The improved features and advantageous effects of the present invention, which will now be described by way of example only with reference to the accompanying drawings, will be more clearly and completely understood by a skilled person in the art.

DETAILED DESCRIPTION OF PREFERRED EMBODIMENTS

Figure 1:
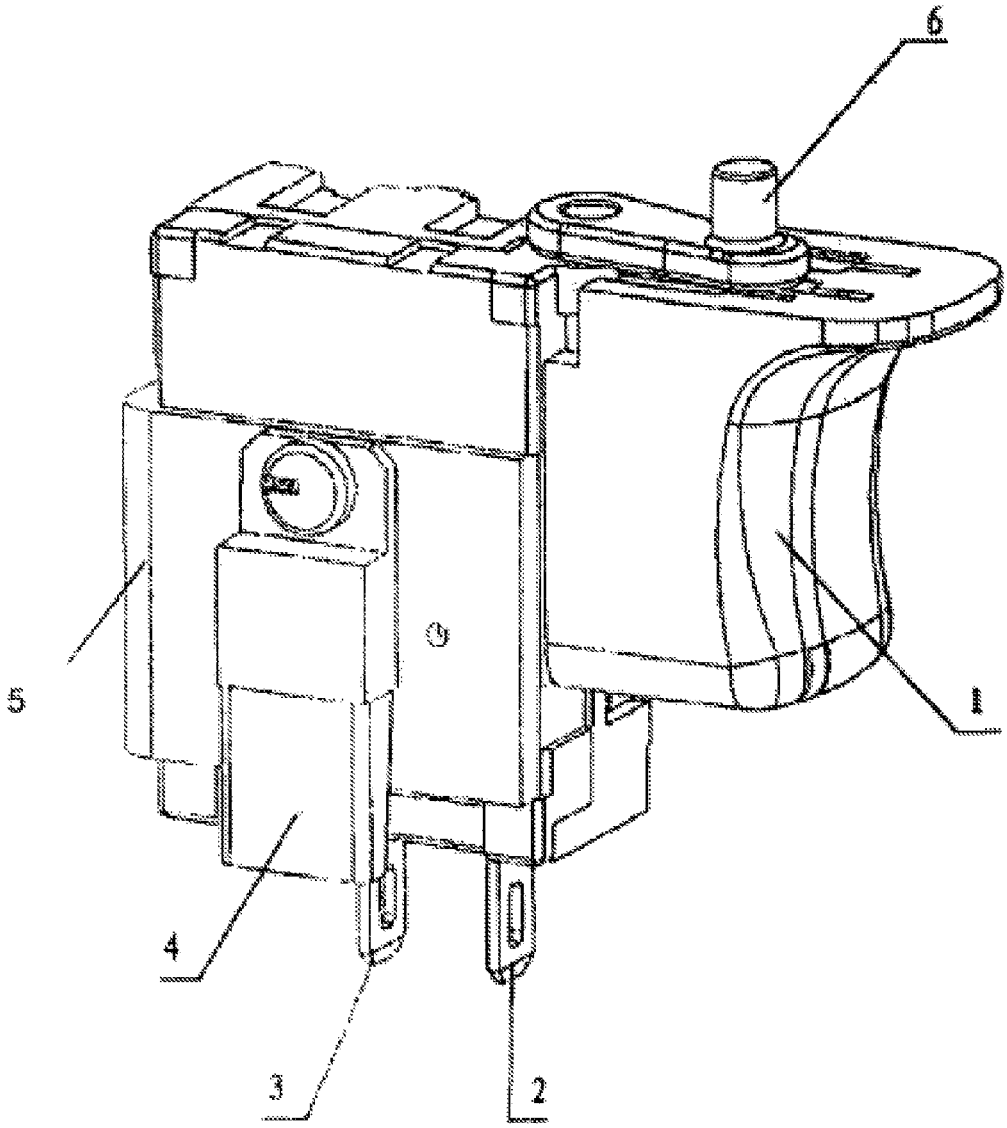
FIG. 1 is an exposed perspective view from one side of the switch assembly according to an embodiment of the present invention.

Referring to the drawings, there is shown in detail a switch assembly, which is a high rating DC switch assembly, according to a preferred embodiment of the present invention. The present invention can be applied to a normal switch but is more useful when used for a high rating DC switch assembly.

Figure 2:
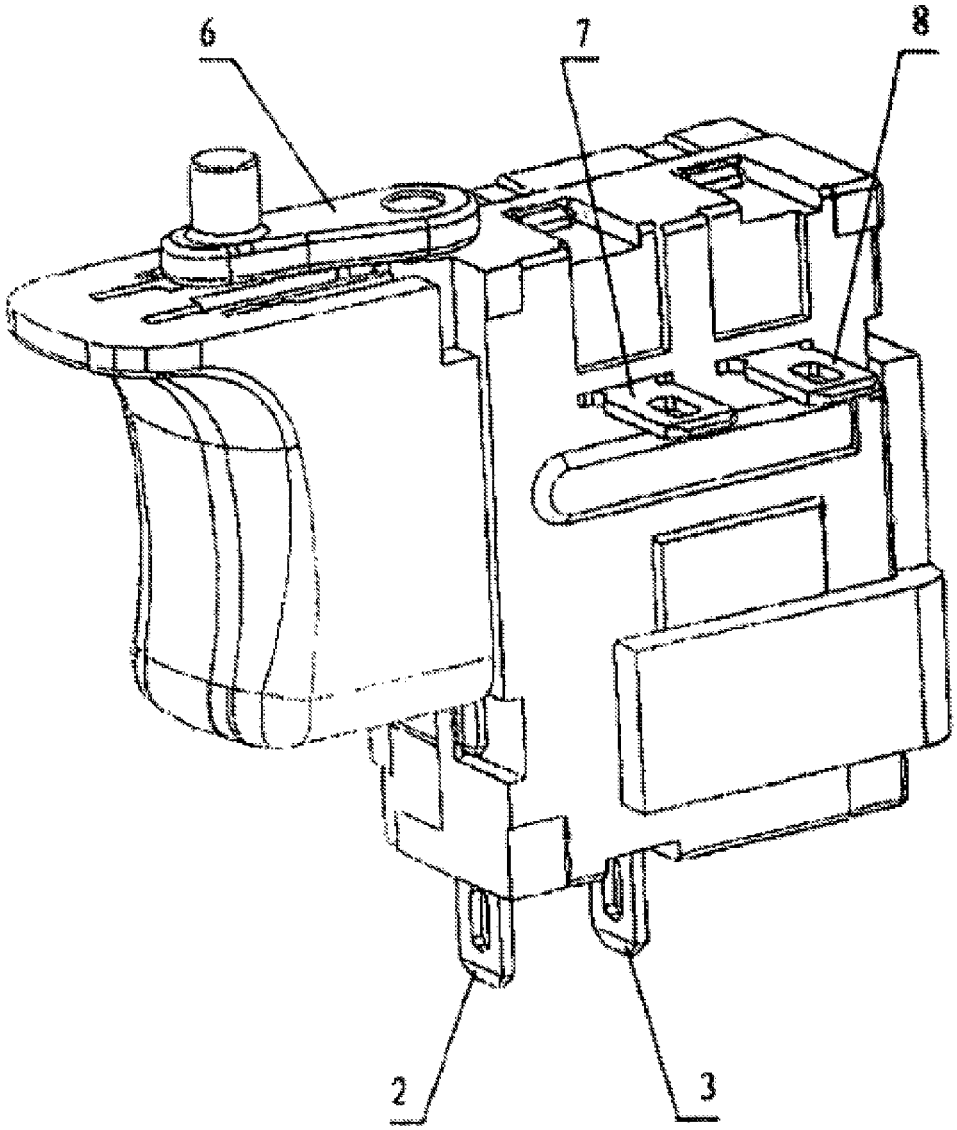
FIG. 2 is an exposed side perspective view from another side of the switch assembly according to an embodiment of the present invention.

As shown in FIGS. 1 and 2, the switch assembly is seen externally to comprise a casing, a trigger 1, first and second input ports 2, 3 used for connection to the positive or negative pole of a supply of an electric voltage, for example, a battery, first and second external output ports 7, 8 used for connection to ports of an electricity consuming device to be controlled by said switch assembly, for example, an electric tool having an electric motor output ports, an MOSFET 4 used as a solid state switch, a heat sink 5, and a forward/reverse lever 6. The trigger is under the control of a user. The switch assembly is open when the trigger 1 is in the outermost position. The switch assembly is closed and supplies the same voltage as that received by the input terminal to an electricity consuming device, for example, an electric tool having an electric motor when the trigger 1 is pressed to the innermost position. The output voltage of the switch assembly increases from zero to the maximum when the trigger 1 is pressed from the outermost position to the innermost position. The MOSFET 4 is able to alternate the output voltage of the switch assembly. The heat sink 5 functions to dissipate the heat generated by the MOSFET. The user can alternate the pole of the output voltage by manipulating the forward/reverse lever 6 when the trigger is at the middle position.

Figure 3:
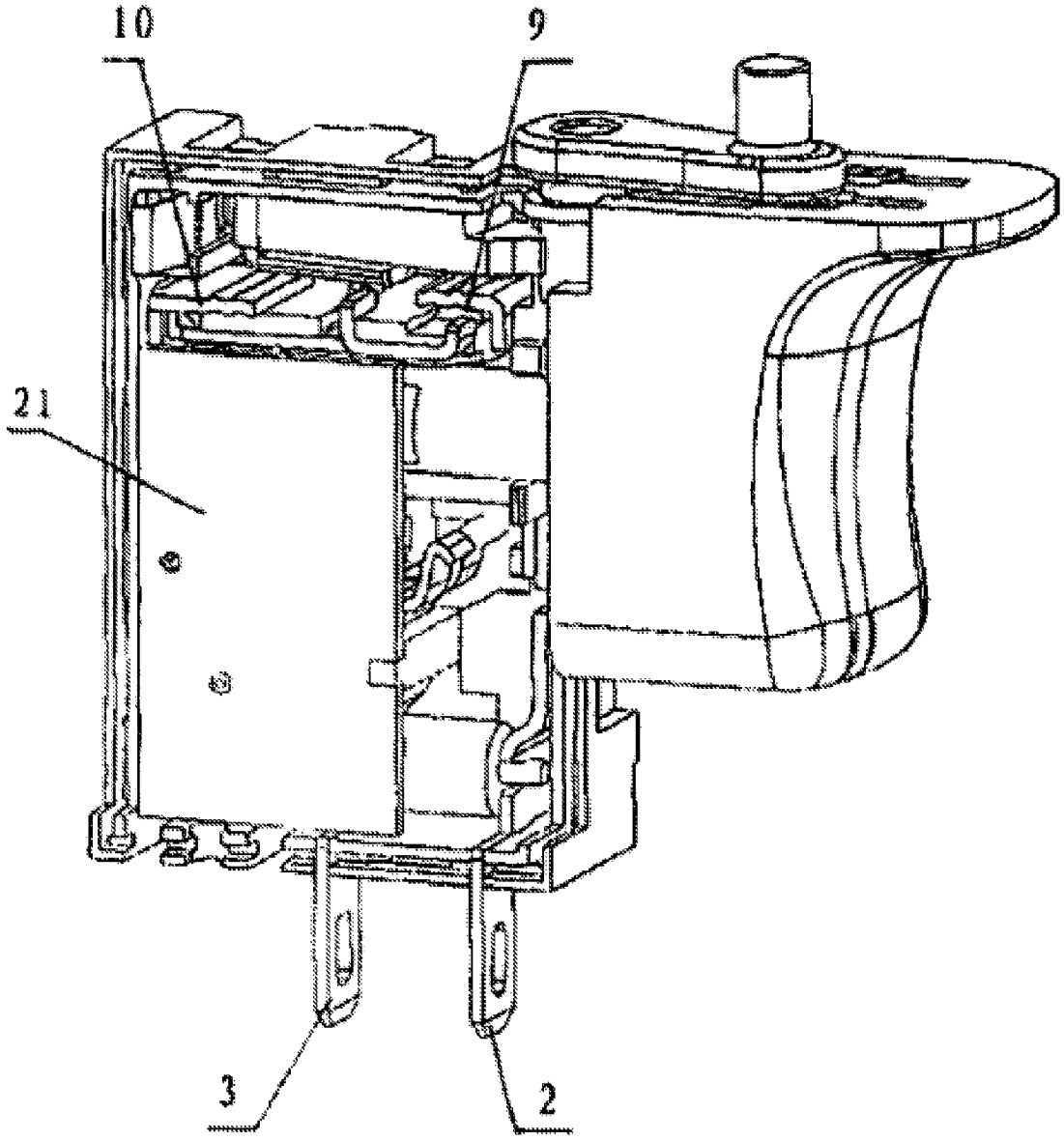
FIG. 3 is a partial cross-sectional perspective view from one side of the switch assembly according to an embodiment of the present invention, with said switch assembly including the electronic circuit.

There can be seen an electronic circuit board 21 in FIG. 3 showing a partial cross-sectional perspective view. The electronic circuit board 21 is used to generate signals to switch on and off the MOSFET 4. A resistance track is used to detect the trigger position.

There can be seen a first internal output terminal 9 and a second internal output terminal 10 of the switch assembly in the upper portion of FIG. 3.

Figure 4:
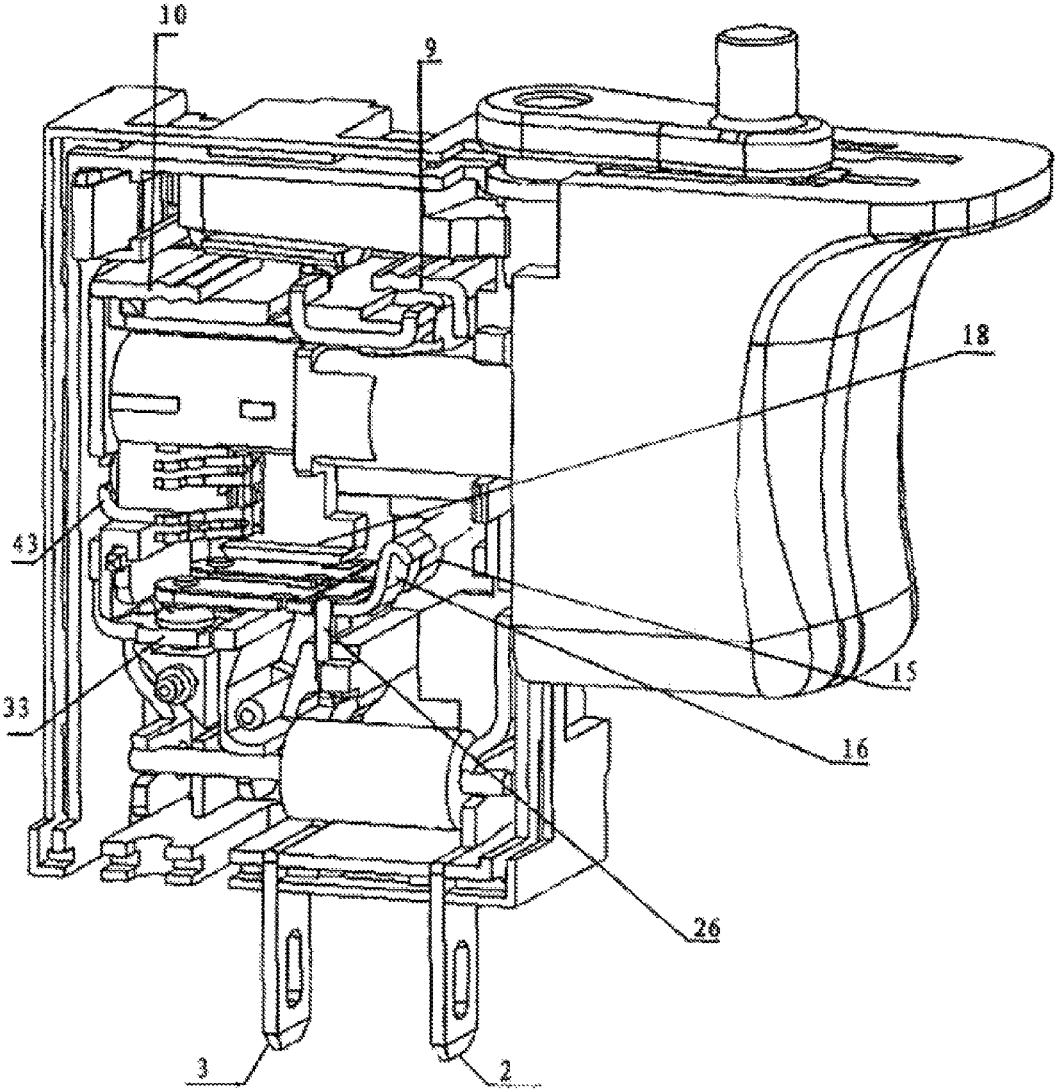
FIG. 4 is a partial cross-sectional perspective view from one side of the switch assembly according to an embodiment of the present invention, with the electronic circuit removed for a clearer view.

FIG. 4 does not include the electronic circuit board 21 for the purpose of showing more clearly the components inside the switch assembly. One can see in FIG. 4 a first pivot contact lever 15, a second pivot contact lever 16, a support 26, a first additional contact portion 43, a second fixed contact portion 33 and a second cam 18. The two pivot contact levers have the same shape. The support 26 is fixed with respect to the casing and is connected to the second input terminal 3.

Figure 5:
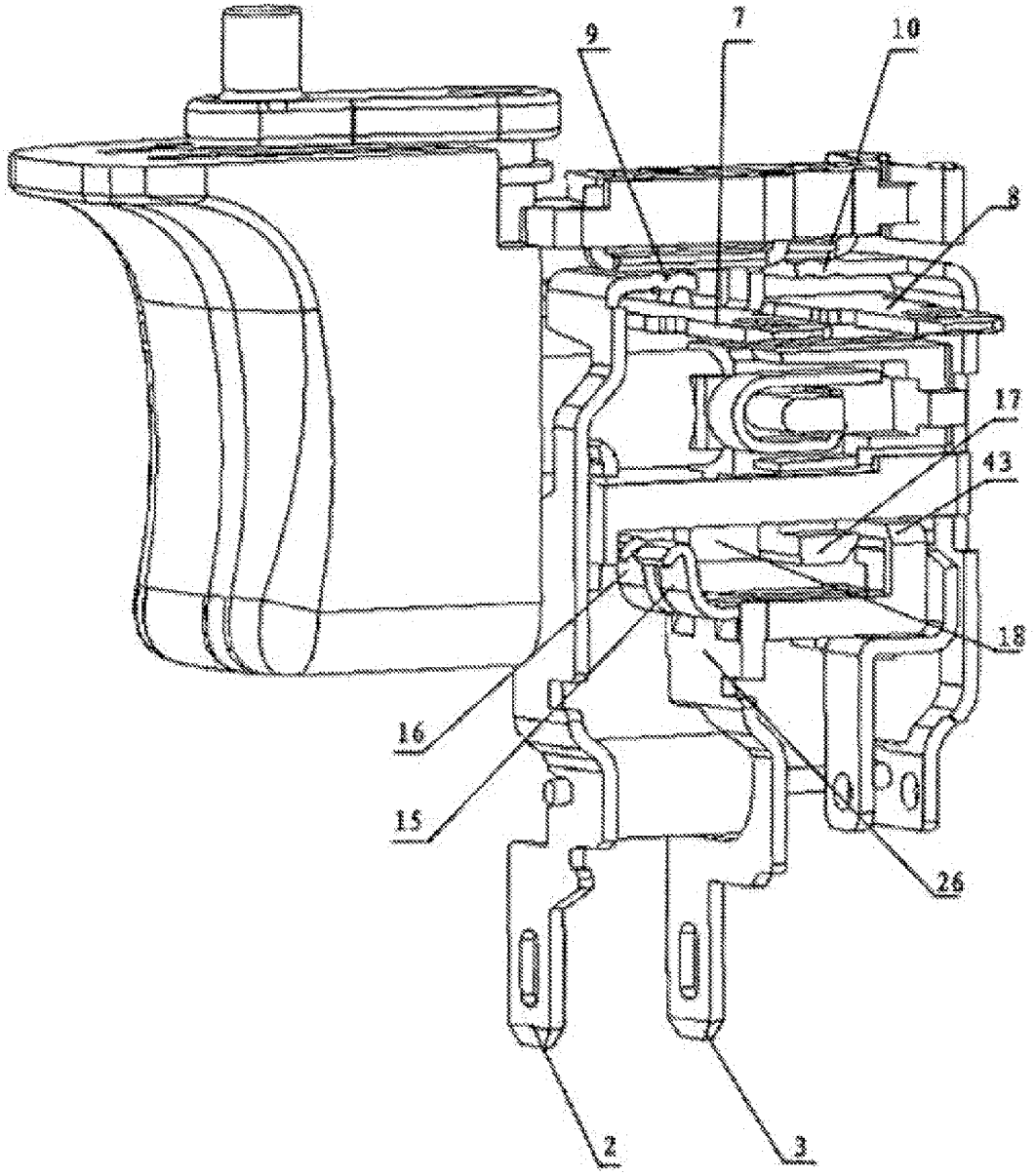
FIG. 5 is a cross-sectional perspective view from another side of the switch assembly according to an embodiment of the present invention.

One can see in FIG. 5 a first cam 17, is second cam 18, the support 26 and the first additional contact portion 43. The first additional contact portion 43 is fixed to or configured integrally with the support 26. The first cam 17 has a shape different from that of the second cam 18, and the two cams are staggered to provide pivotal closing of the first and second pivot contact levers 15, 16 at different positions of the trigger.

Figure 6:
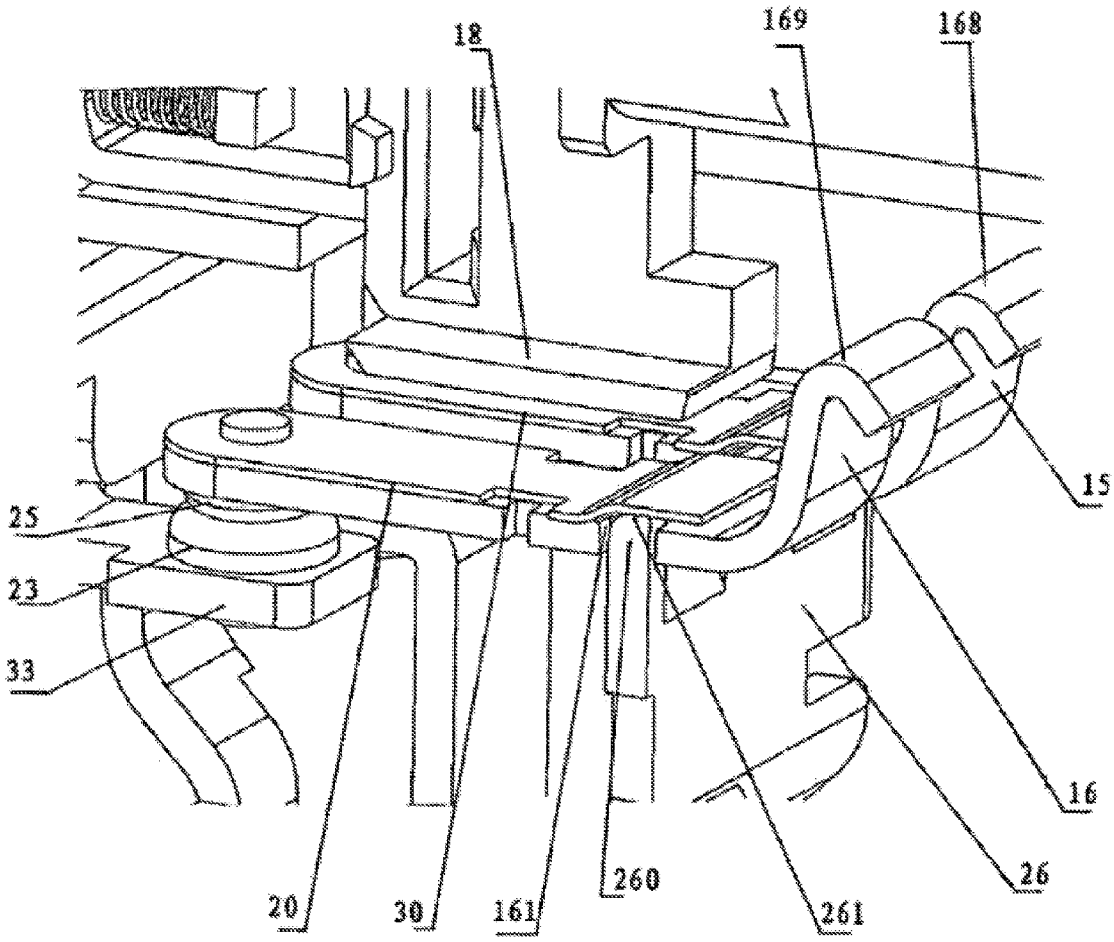
FIG. 6 is a perspective view adjacent to two pivot contact levers of the switch assembly according to an embodiment of the present invention.
Figure 7:
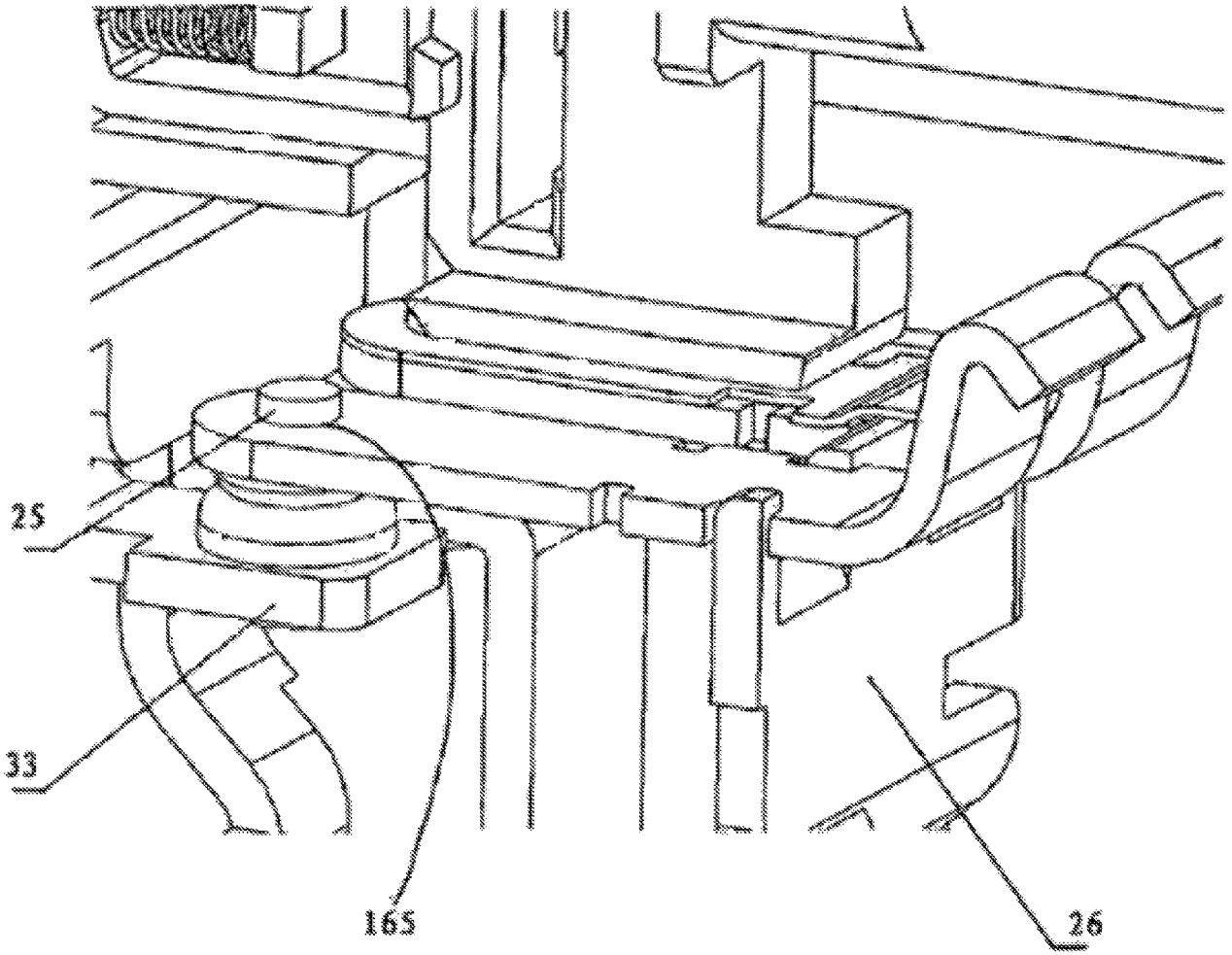
FIG. 7 is a perspective view adjacent to two pivot contact levers of the switch assembly according to an embodiment of the present invention.
Figure 8:
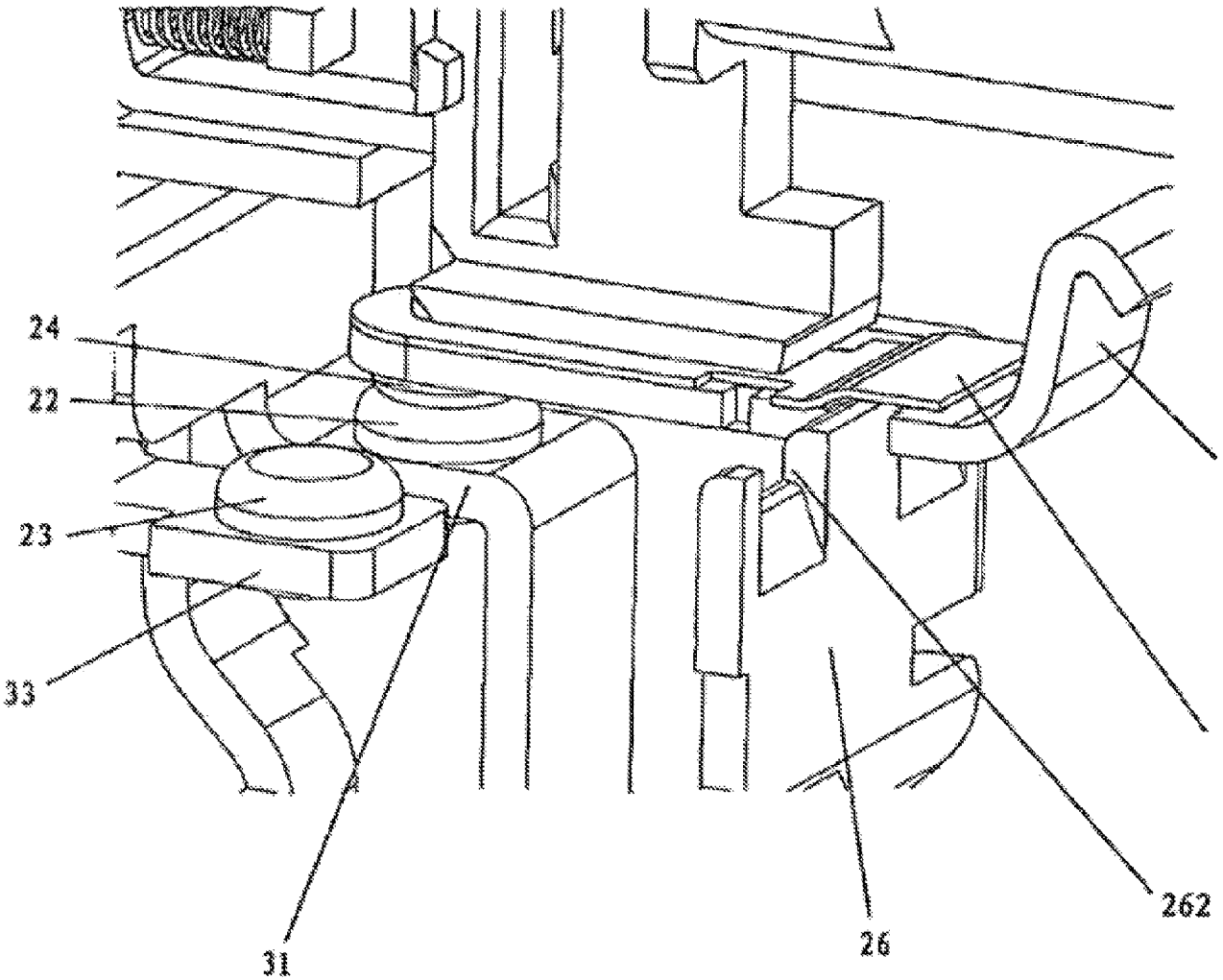
FIG. 8 is a perspective view adjacent to two pivot contact levers, trigger levers and additional parallel connection plates of the switch assembly according to an embodiment of the present invention.

Now referring to FIGS. 6-8, a first fixed contact portion 31 and a second fixed contact portion 33 are arranged substantially in parallel and are fixed with respect to the casing. First and second contact heads 22, 23 are provided respectively on the two contact portions.

The support 26 has a notch 262 provided on the top thereof. The pivot contact lever 16, which is shaped like a thin and long strip, has a corresponding notch 161 to cooperate with the notch 262. With cooperation of these two notches, the pivot contact lever 16 is held on the support 26 so that it is able to pivot around the notches.

Figure 9:
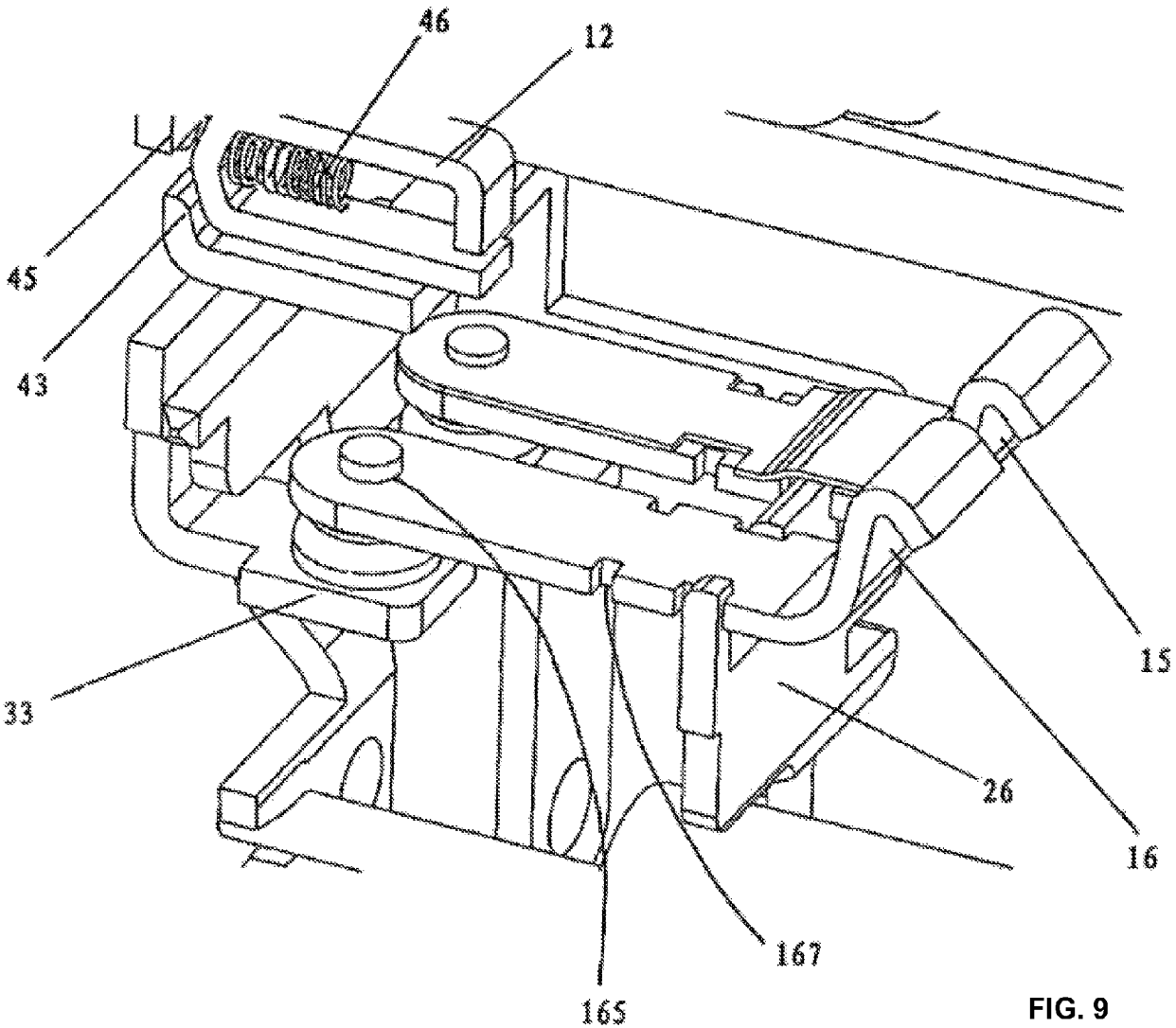
FIG. 9 is a perspective view adjacent to two pivot contact levers, trigger levers and additional parallel connection plates of the switch assembly according to an embodiment of the present invention.
Figure 10:
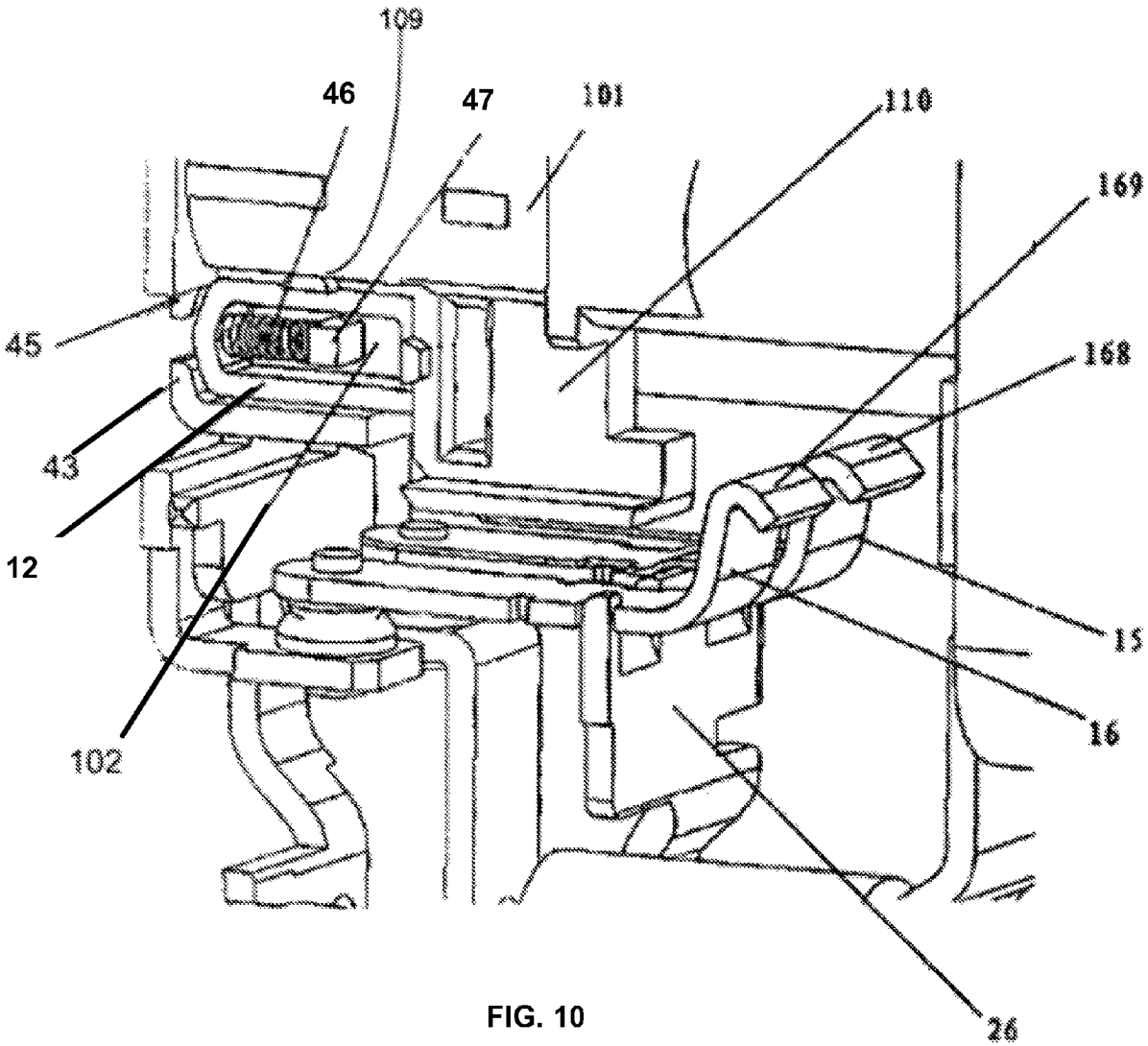
FIG. 10 is a perspective view adjacent to additional parallel connection plates, trigger levers, and the forward/reverse switch mechanism of the switch assembly according to an embodiment of the present invention.
Figure 11:
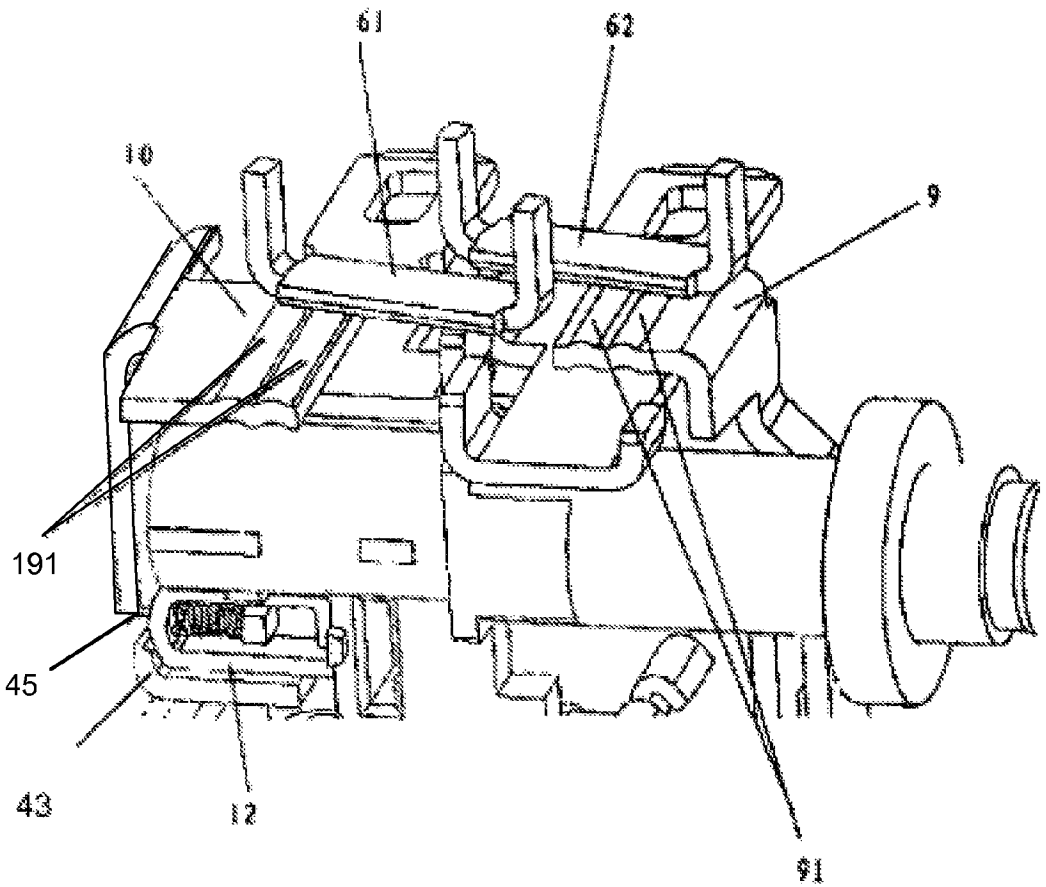
FIG. 11 is a perspective view of the connection between the additional parallel connection plate and the trigger lever of the switch assembly according to an embodiment of the present invention.
Figure 12:
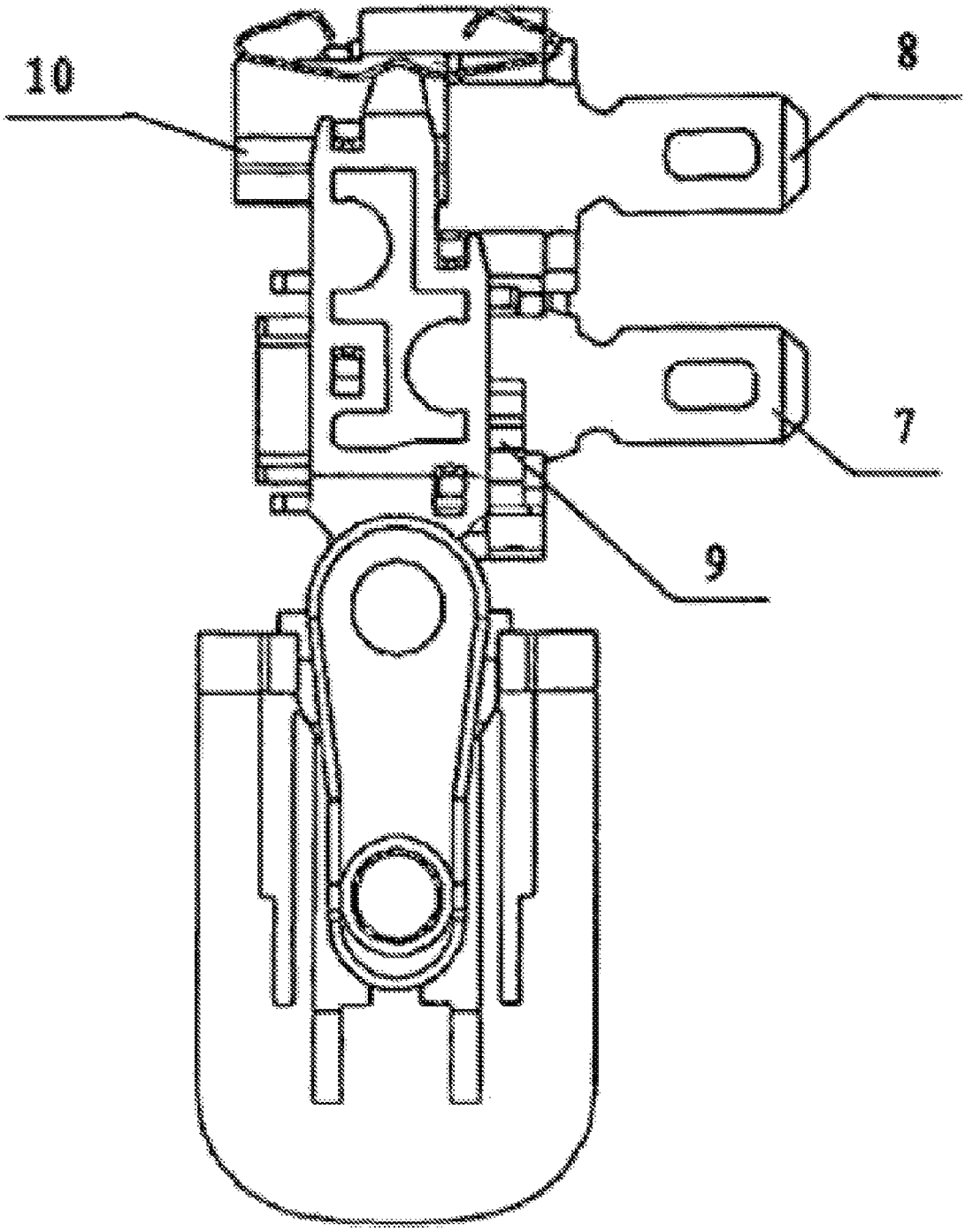
FIG. 12 is an illustrative view of the forward/reverse switch mechanism of the switch assembly in a forward position according to an embodiment of the present invention.
Figure 21:
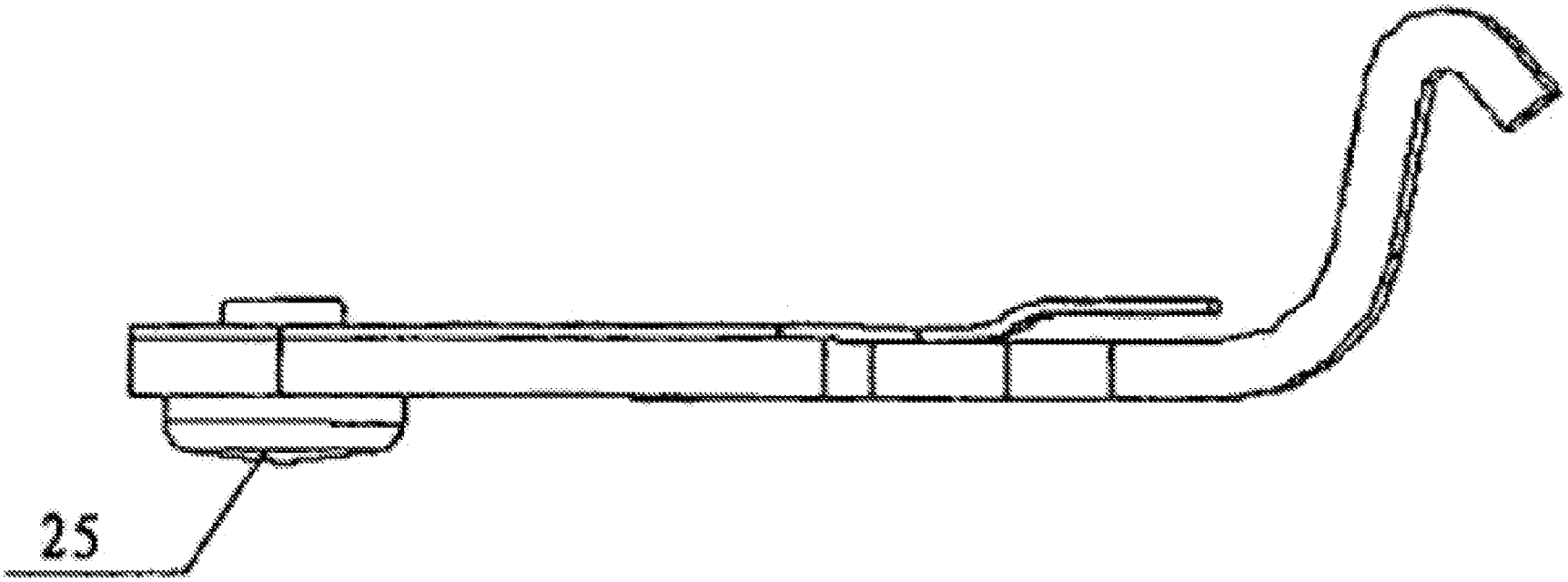
FIG. 21 is an illustrative view showing the structure of the switch assembly according to an embodiment of the present invention, including a pivot contact lever with an additional pressing plate.
Figure 22:
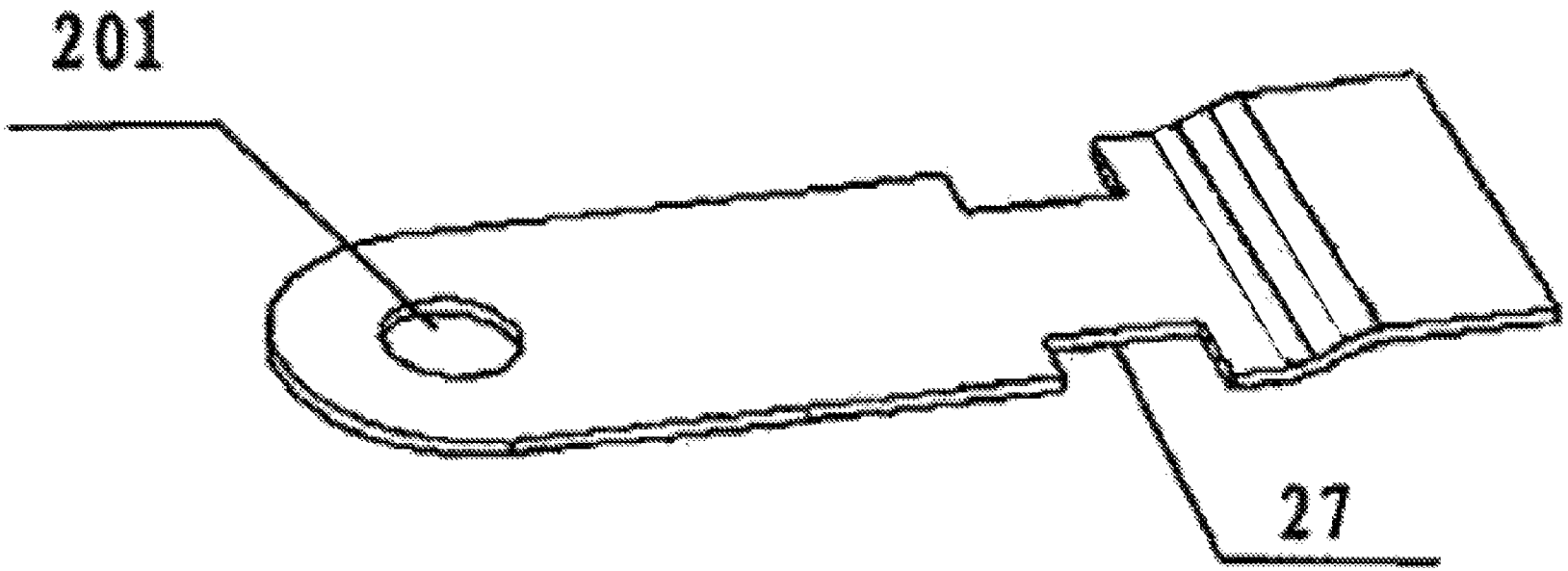
FIG. 22 is an illustrative view showing the structure of an additional pressing plate of the switch assembly according to an embodiment of the present invention.
Figure 30:
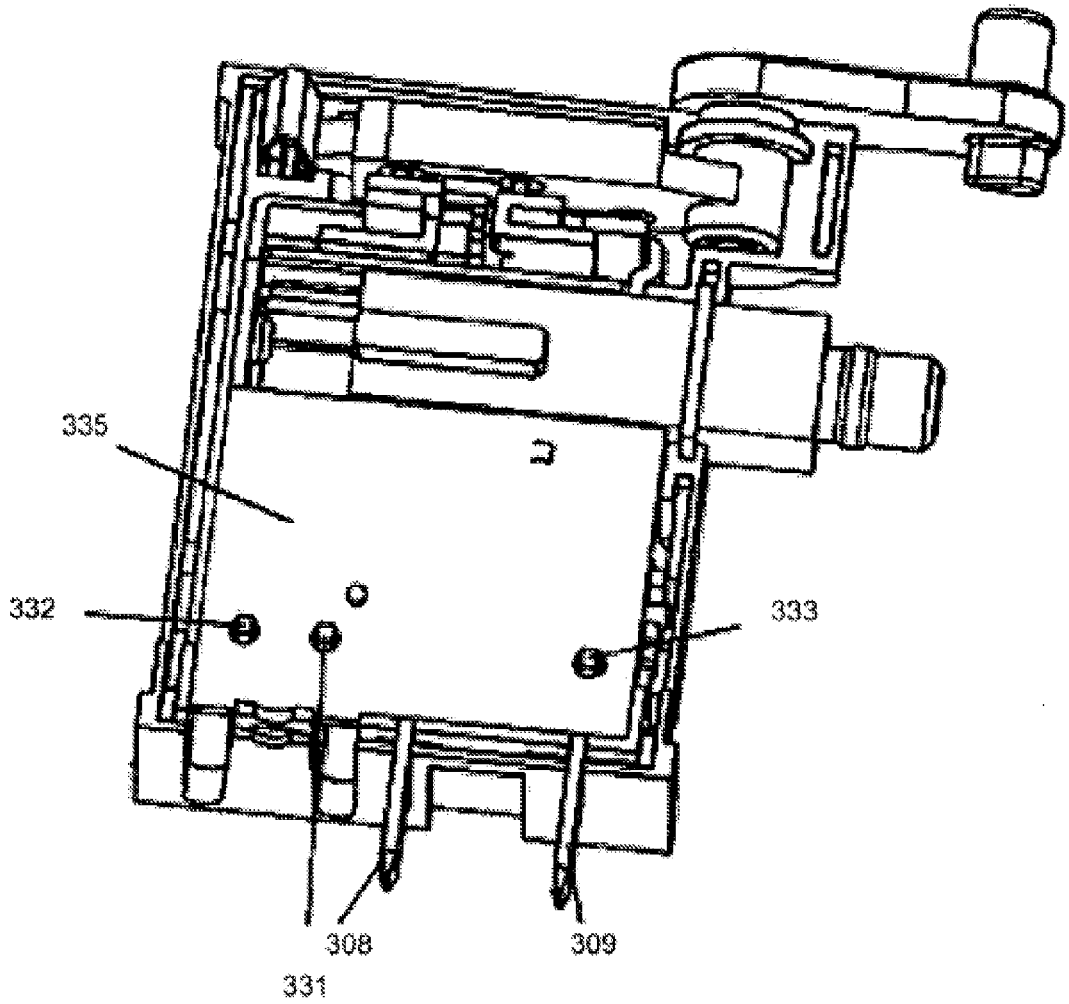
FIG. 30 is a diagram showing the electric speed governing system grounding according to an embodiment of the present invention.

The pivot contact levers 16, 15 have additional pressing plates 20, 30 made from copper attached thereto. The additional pressing plates 20, 30 are connected and fixed by fixed contact heads 24, 25. Each of the fixed contact heads has a portion with a large diameter and a portion with a small diameter as shown in FIG. 21. The additional pressing plates 20, 30 can have the same shape, which is a thin and long sheet as shown in FIG. 30 with a first end provided with a pressing plate through hole 201. The additional pressing plates have a thickness smaller than that of the pivot contact levers. The pivot contact lever 16 has a first end thereof provided with a pivot contact lever through hole 165 as shown in FIGS. 7 and 9.

Figure 28:
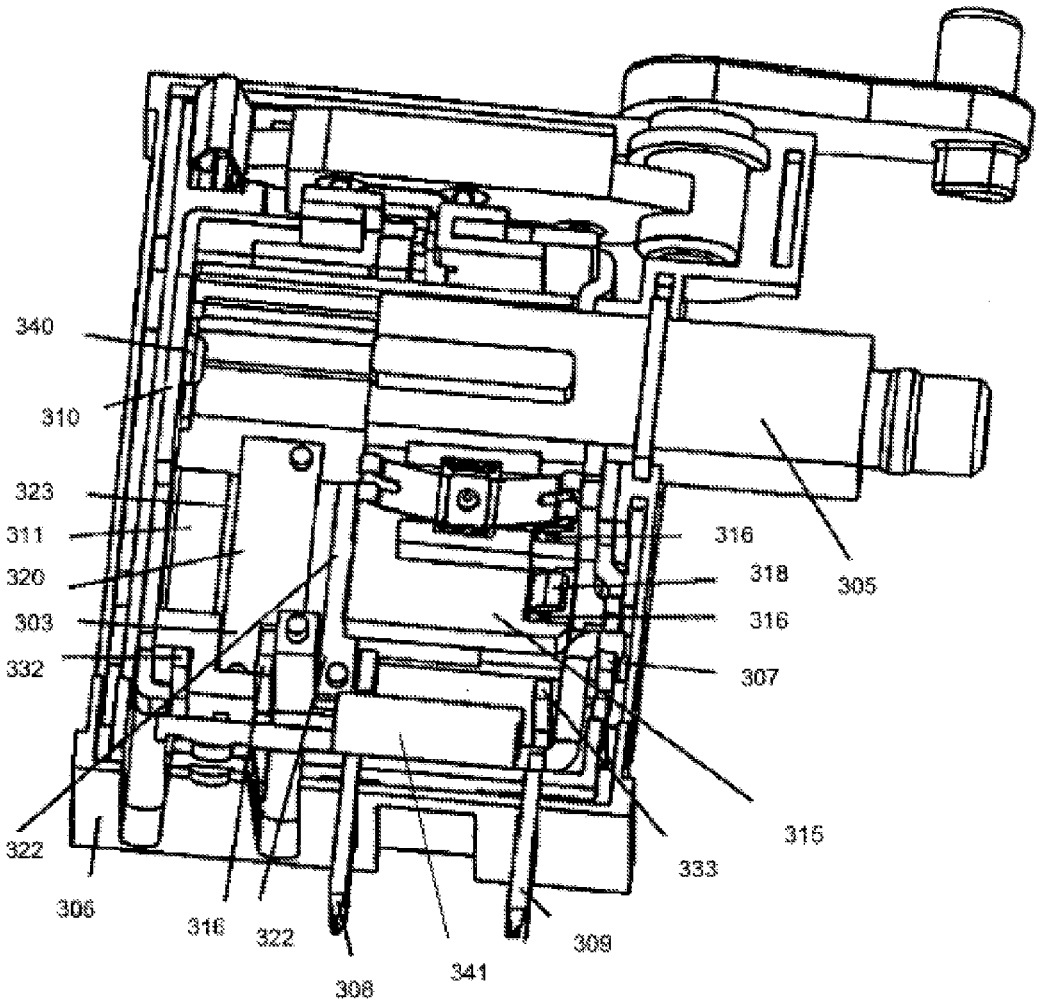
FIG. 28 is another sectional view of the switch assembly, with a push rod illustrated, according to an embodiment of the present invention.

As shown in FIG. 28, the pressing plate through hole on the first end of the additional pressing plate is aligned with the pivot contact lever through hole provided on the first end of the pivot contact lever. The portion with a small diameter of said fixed contact head passes through said two through holes so that the portion with a large diameter is positioned on the side contacting the fixed contact heads 22, 23 on the fixed contact portions. A tip of the portion with a small diameter is pressed to deform so that the diameter thereof is increased to secure the fixed contact head and the additional pressing plate to the pivot contact lever. The additional pressing plate is elastic and is elastically pre-bent after being fixed together with the pivot contact lever to the support. Such an elastic pre-bending keeps a second end of the additional pressing plate firmly pressed on a top 261 of said support and applies pre-compression onto the same so as to apply additional contact force on the pivot point In addition, the additional pressing plate always keeps close contact to the top of the support, thereby ensuring reliable electric connection. These two functions of the pressing plate help to reduce contact loss on the pivot point and decrease the possibility of occurrences of "INT" problem.

Each of the pivot contact lever and the additional pressing plate is provided with a slot 167, 27 for connecting the pivot contact lever spring (not shown). The slots 167, 27 for connecting the pivot contact lever spring are positioned between the first end of the pivot contact lever and the pivot connecting point, i.e., the notch 262. The other end of the pivot contact lever spring is secured with respect to the casing of the switch assembly. The pivot contact lever spring functions to pull the pivot contact lever so that the fixed contact head of the first end of the pivot contact lever is pressed on the fixed contact head of the fixed contact portion.

Referring back to FIGS. 4 and 9, the trigger 1 has a trigger lever 101 secured thereto. The trigger lever 101 is held on to and extends into said casing, and is slidable with respect to said casing. The first and second cams 17, 18 are secured to the trigger lever 101.

Figure 24:
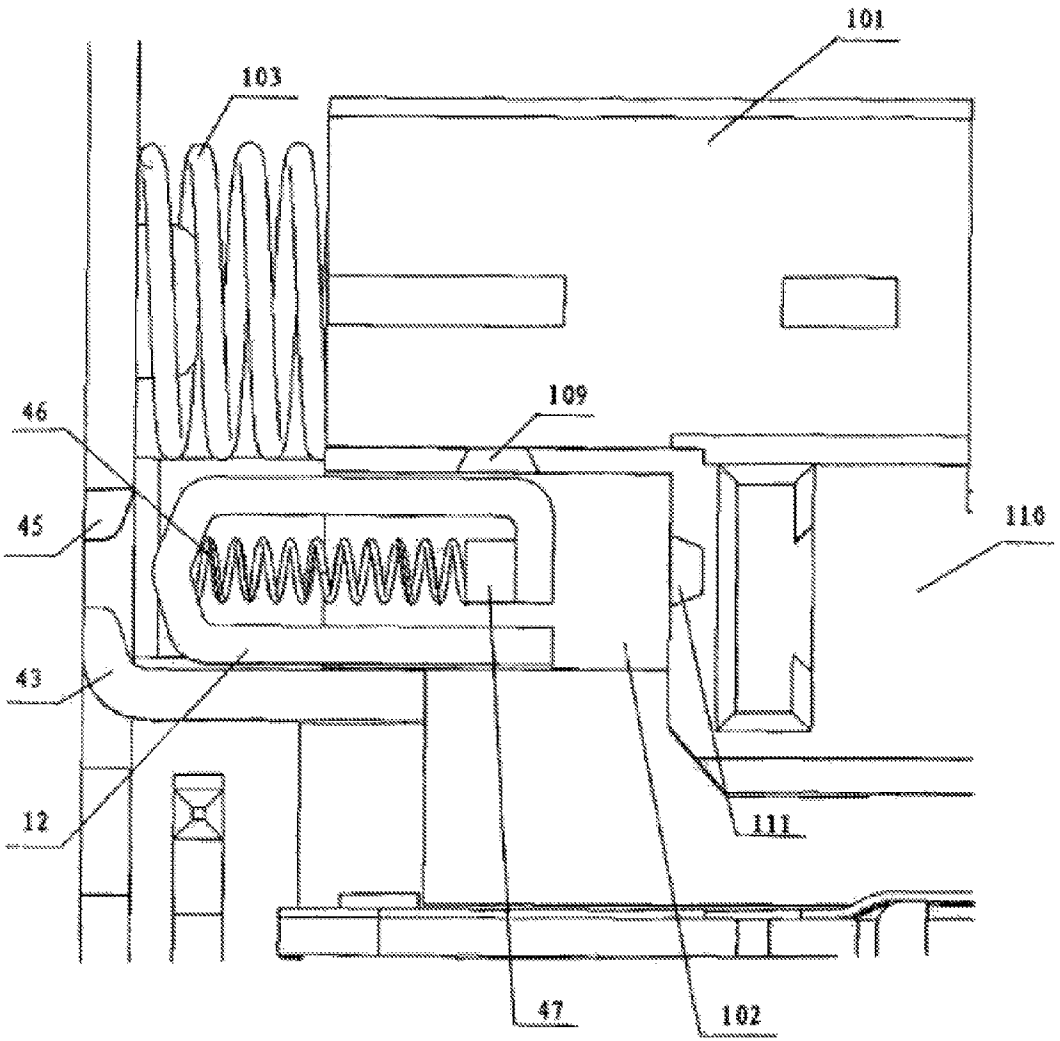
FIG. 24 is an illustrative view showing the structure of the connection between an additional pressing plate and a trigger lever of the switch assembly according to an embodiment of the present invention.
Figure 25:
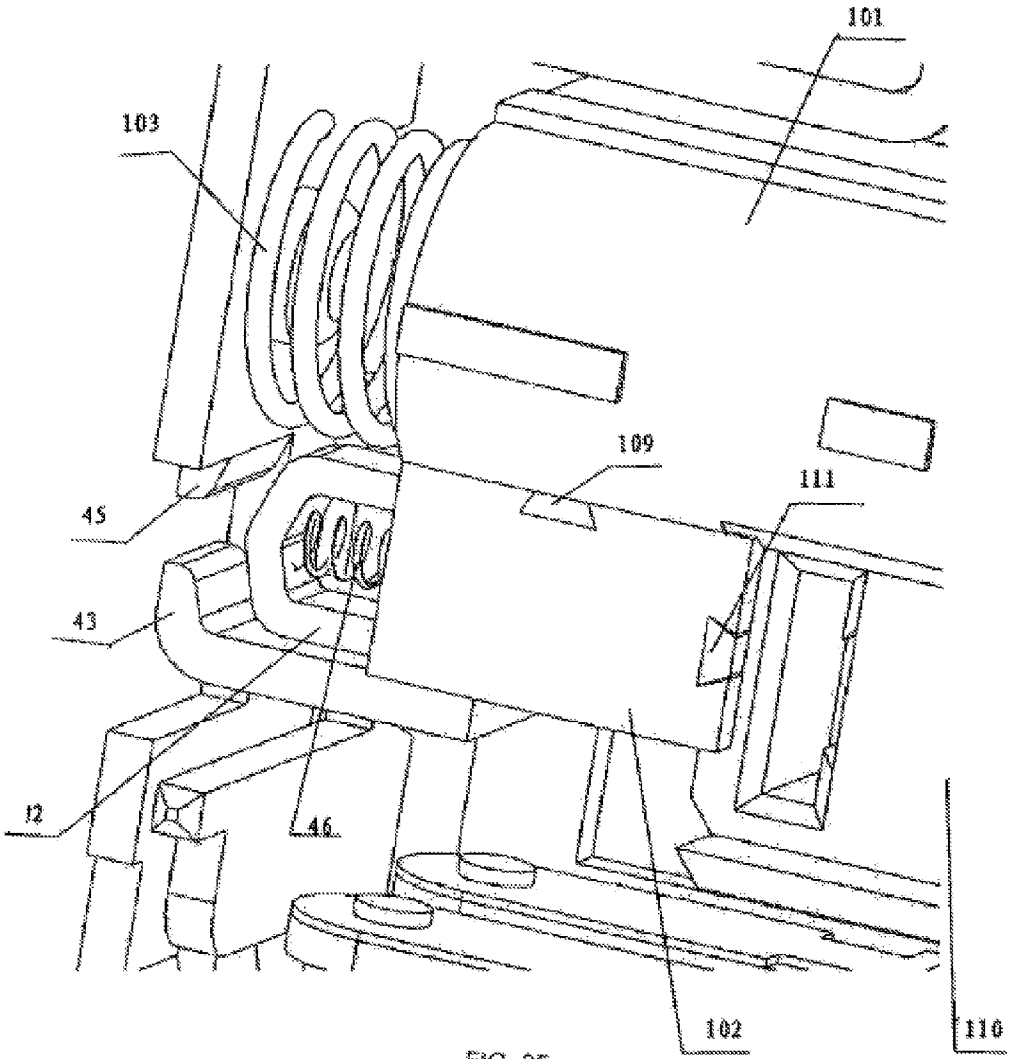
FIG. 25 is an illustrative view showing the structure of the connection between an additional pressing plate and a trigger lever of the switch assembly according to an embodiment of the present invention.

Referring to FIGS. 24 and 25, a trigger spring 103 is attached to the trigger lever with one end thereof carried on a protrusion 3 (see FIG. 3). The trigger spring functions to bias the trigger lever and the trigger to the outermost position. The trigger can be activated by a user from outside the switch assembly.

The pivot contact lever 15, 16 has a second end provided with a compressed portion 168, 169. The two cams 17, 18 press against the two compressed portions so that the pivot contact lever pivots to a state in which the contact head of the second end thereof is cut off from electric connection to the contact head on the fixed contact portion by overcoming the action force from the pivot contact lever spring when the trigger lever and the trigger are normally in the outermost position.

An additional parallel connection contact plate 12 can be seen in FIG. 9. The additional parallel connection contact plate 12 closes to connect the second input terminal and the second output terminal so as to bypass the current flowing through the contact point of the second pivot contact lever when the trigger is in the innermost position. With the additional parallel connection contact plate 12, heat generation can be further reduced and circuit efficiency can be improved, which is an advantage of the present invention over the prior art, as it is deficient to only rely on the second pivot contact lever to bypass the current so as to reduce heat generation by lowering the high current in an existing high rating switch assembly.

As shown in FIGS. 9, 11, and 24-25, the additional parallel connection contact plate 12 is provided on a lower side of a front portion of the trigger lever. A first additional contact portion 43 is fixed to the support (see FIG. 5) and a second additional contact portion 45 is fixed to the second internal output terminal 10. The first additional contact portion 43 is spaced from said second additional contact portion 45. Connection of the second input terminal and the second output terminal by the additional parallel connection contact plate 12 is realized via the additional parallel connection contact plate 12 contacting simultaneously said first additional contact portion 43 and said second additional contact portion 45 when the trigger 1 is pressed to the innermost position.

Referring to FIGS. 24 and 25, the trigger lever 101 has two connecting plates 102 fixed to the lower side of the front portion thereof. These two connecting plates 102 are spaced to contain therebetween the additional parallel connection contact plate 12. A rib 47 is fixed to the two connecting plates 102 and is substantially perpendicular to said connecting plates 102.

The trigger lever 101 has a protruding plate 110 fixed to a lower side of a rear point of the front portion thereof. The first cam 17 and the second cam 18 are fixed to a lower end of the protruding plate 110. The protruding plate 110 has a laterally protruding tenon 111 that provides unilaterally fixed respectively to each side of a front end thereof and two downwardly protruding tenons 109 fixed to a lower side of a front end thereof. The two connecting plates 102 are fixed to the laterally protruding tenons 111 and the downwardly protruding tenons 109 respectively by corresponding grooves thereon.

Figure 23:
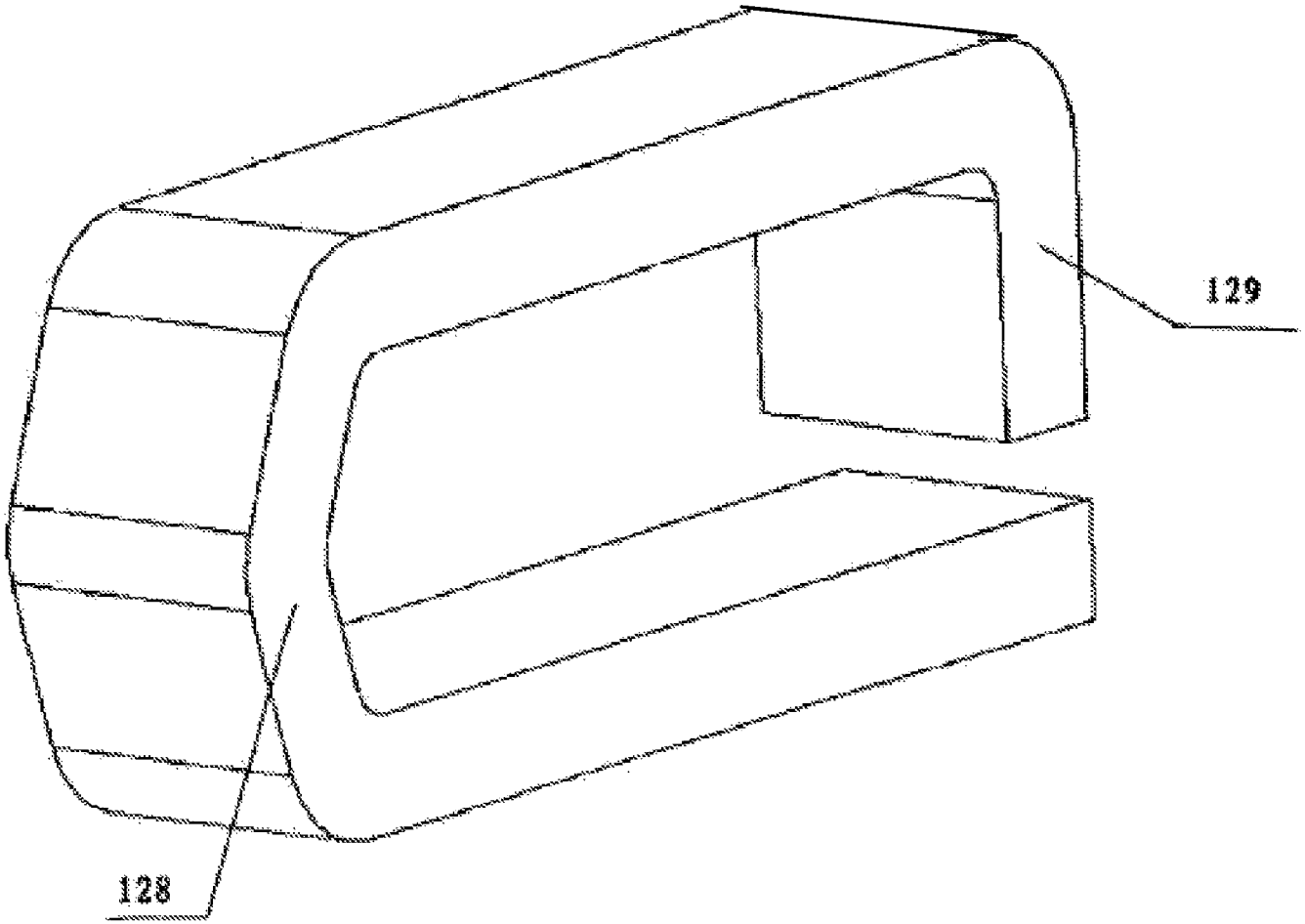
FIG. 23 is an illustrative view showing the structure of an additional parallel connection contact plate of the switch assembly according to an embodiment of the present invention.

As seen in FIG. 23, the parallel connection contact plate 12 is shaped substantially like an elongated "D". A curved end 128 of said "D" shape is used to contact the first and second additional contact portions 43, 45 and a straight end 129 of said "D" shape is used as a braking portion. The rib 47 is fitted inside the parallel connection contact plate. A compression spring 46 is provided between the rib 47 and the curved end 128 with one end thereof arranged against the rib 47 and the other end thereof arranged against an inner side of the curved end 128 so as to bias an inner side of the straight end 129 to be closely against the rib 47. The parallel connection contact plate is long enough to be biased by the compression spring 46 to have the curved end thereof extending forwardly beyond a front end of the trigger lever 101.

As seen in FIGS. 10 and 13-17, a forward/reverse switch mechanism comprises switch contact plates 61, 62. The first internal output terminal 9 and the second internal output terminal 10 is provided respectively with two wave-shaped convex contact portions for contacting lower contacting surfaces of the switch contact plates 62, 61. Heat generation is reduced more efficiently in a manner of low cost by providing double convex contact portions on the internal output ports.

Figure 13:
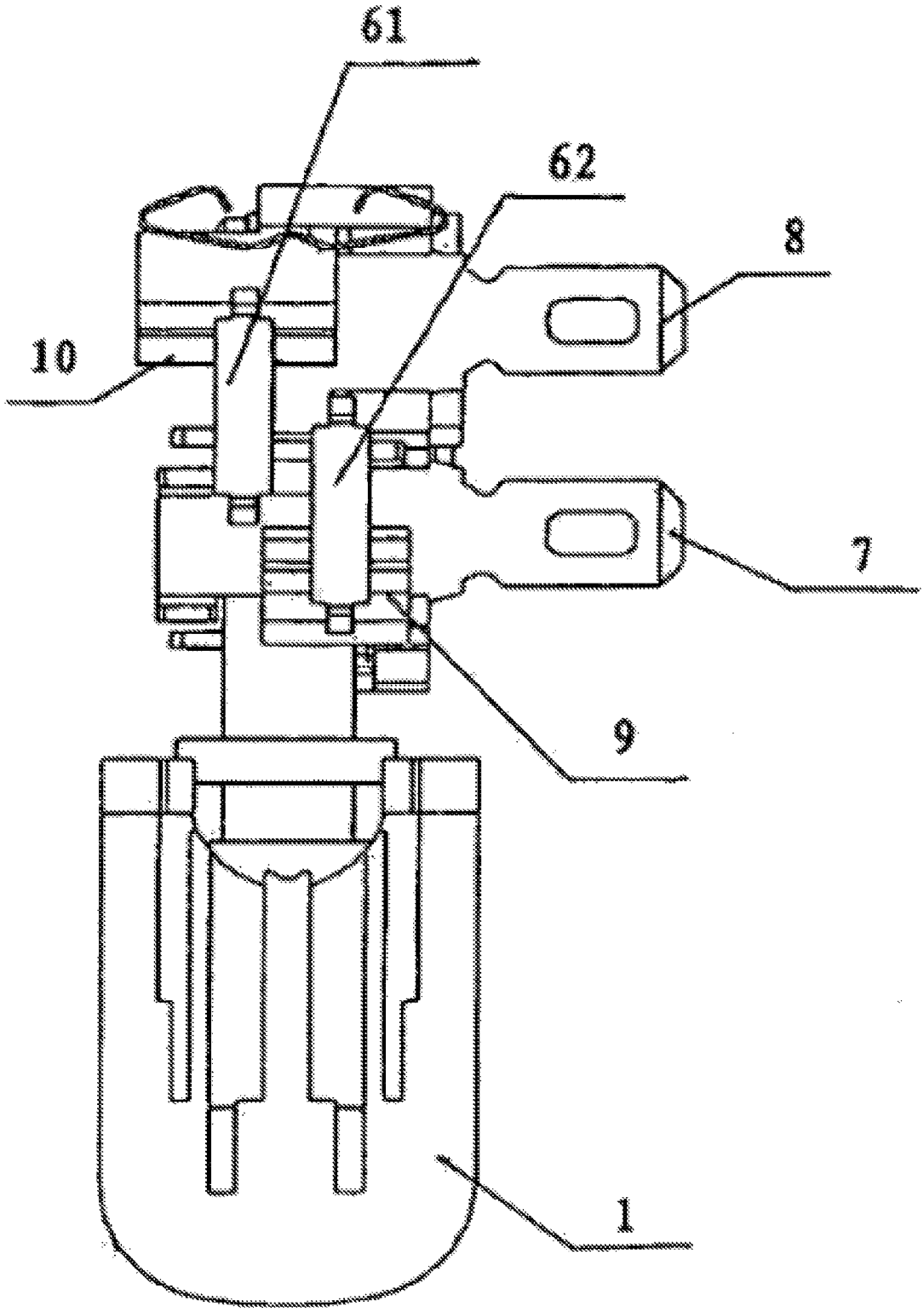
FIG. 13 is an illustrative view of the forward/reverse switch mechanism of the switch assembly in a forward position according to an embodiment of the present invention.
Figure 14:
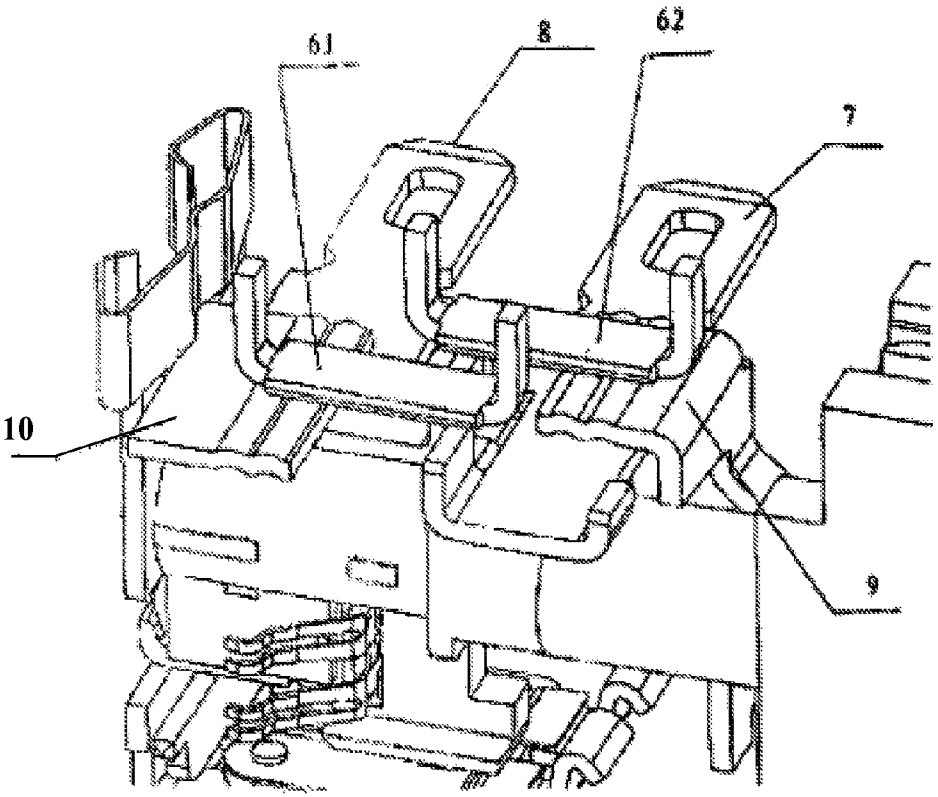
FIG. 14 is an illustrative view of the forward/reverse switch mechanism of the switch assembly in a forward position according to an embodiment of the present invention.

The forward/reverse switch mechanism of the switch assembly shown in FIG. 13-14 is positioned in the middle position, wherein the switch contact plate 61 only contacts the second internal output terminal 10 and the switch contact plate 62 only contacts the first internal output terminal 9.

Figure 15:
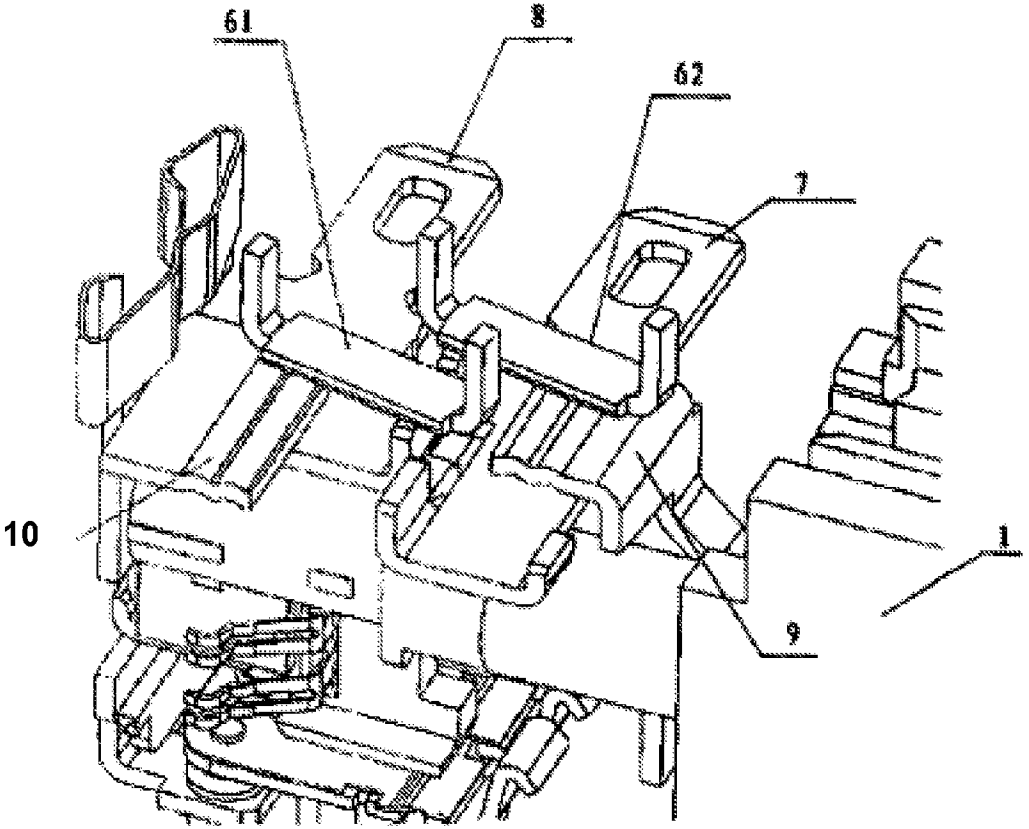
FIG. 15 is an illustrative view of the forward/reverse switch mechanism of the switch assembly in reverse position according to an embodiment of the present invention.

The forward/reverse switch mechanism of the switch assembly shown in FIG. 15 is positioned in the forward position, wherein the switch contact plate 61 contacts the second internal output terminal 10 and the second external output terminal 8 and the switch contact plate 62 contacts the first internal output terminal 9 and the second external output terminal 8.

Figure 16:
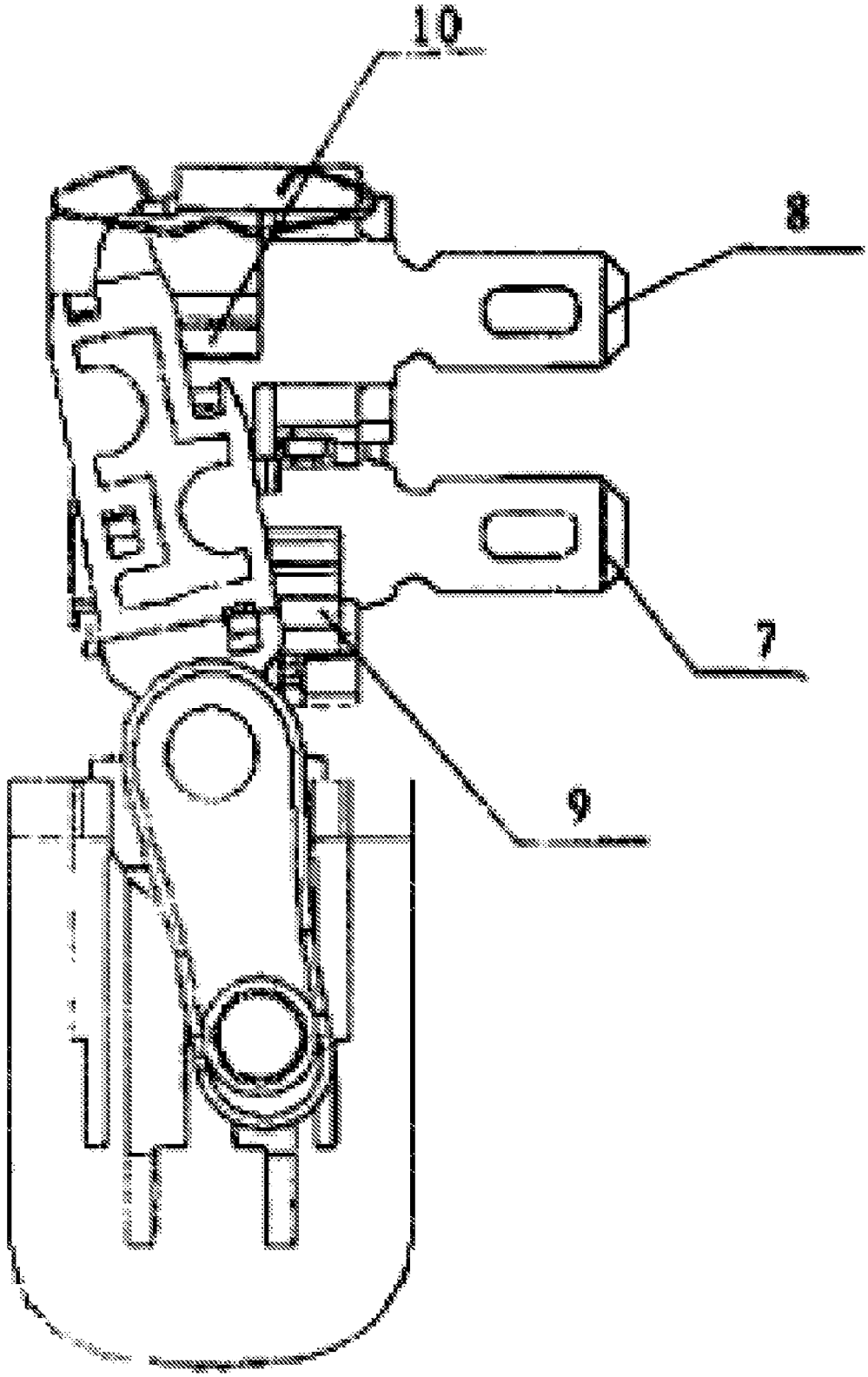
FIG. 16 is an illustrative view of the additional parallel connection plate and double convex contact portions of the switch assembly according to an embodiment of the present invention.
Figure 17:
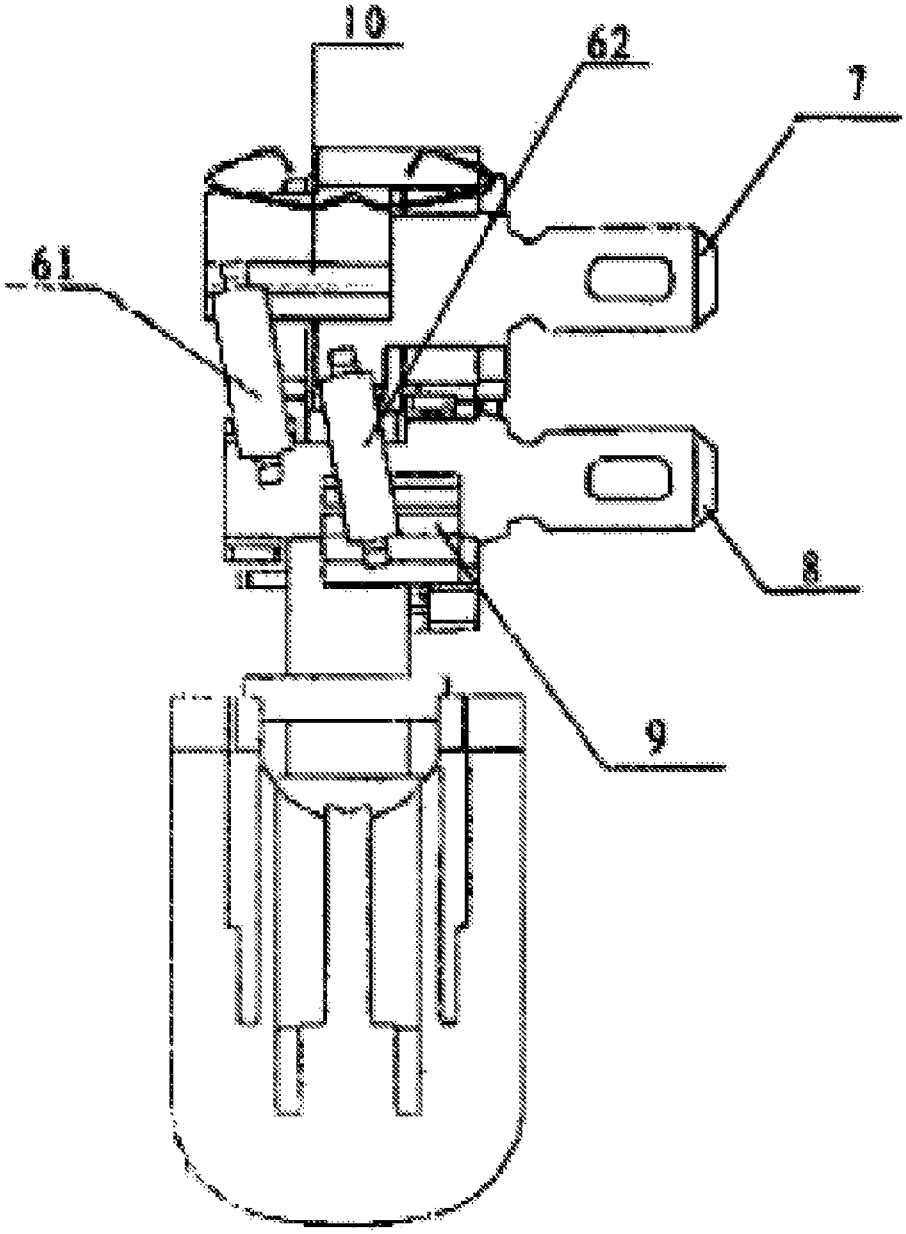
FIG. 17 is an illustrative view of the additional parallel connection plate and double convex contact portions of the switch assembly according to an embodiment of the present invention.
Figure 18:
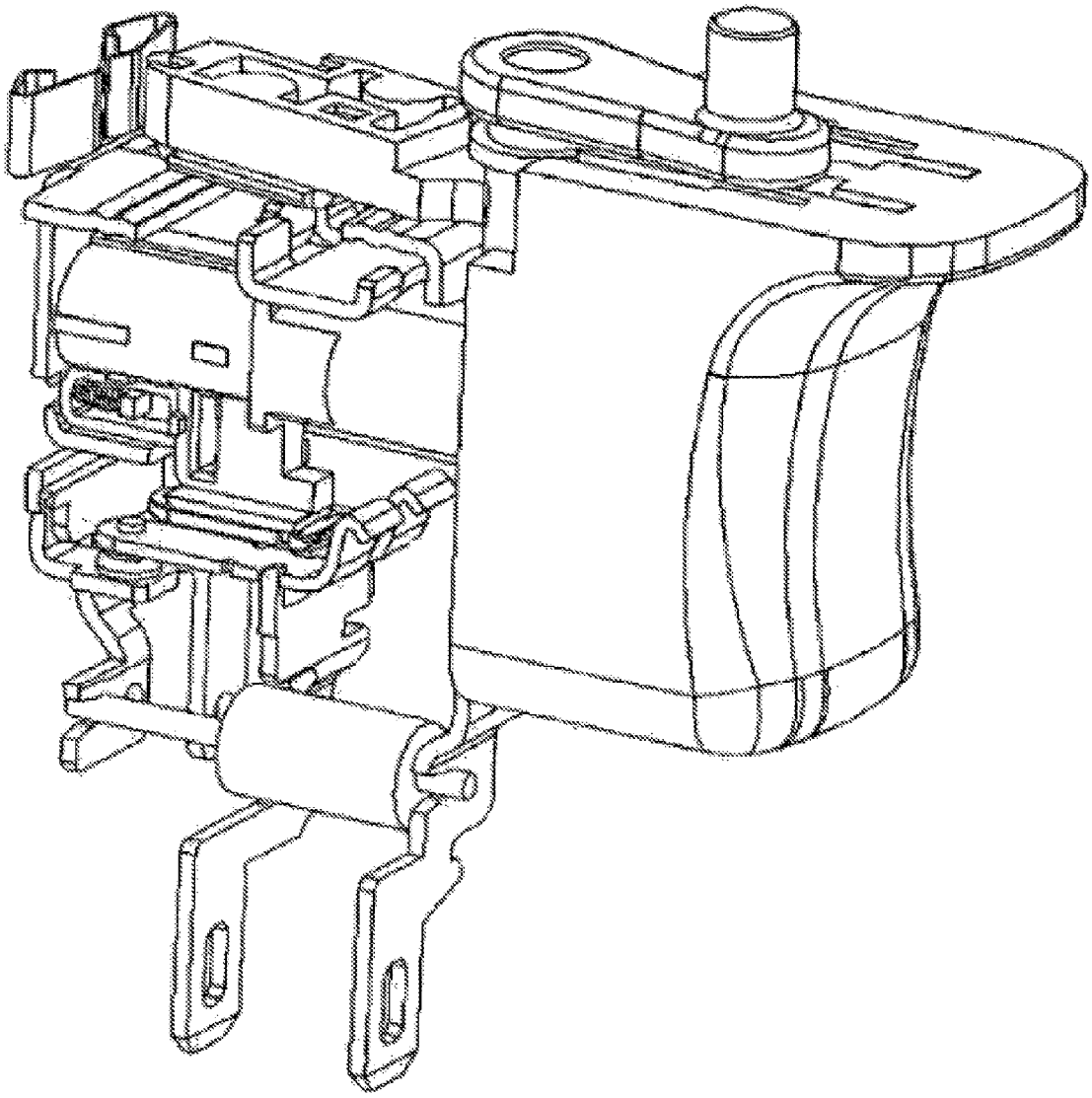
FIG. 18 is an illustrative view showing the structure of the switch assembly according to an embodiment of the present invention, including a first internal output.
Figure 19:
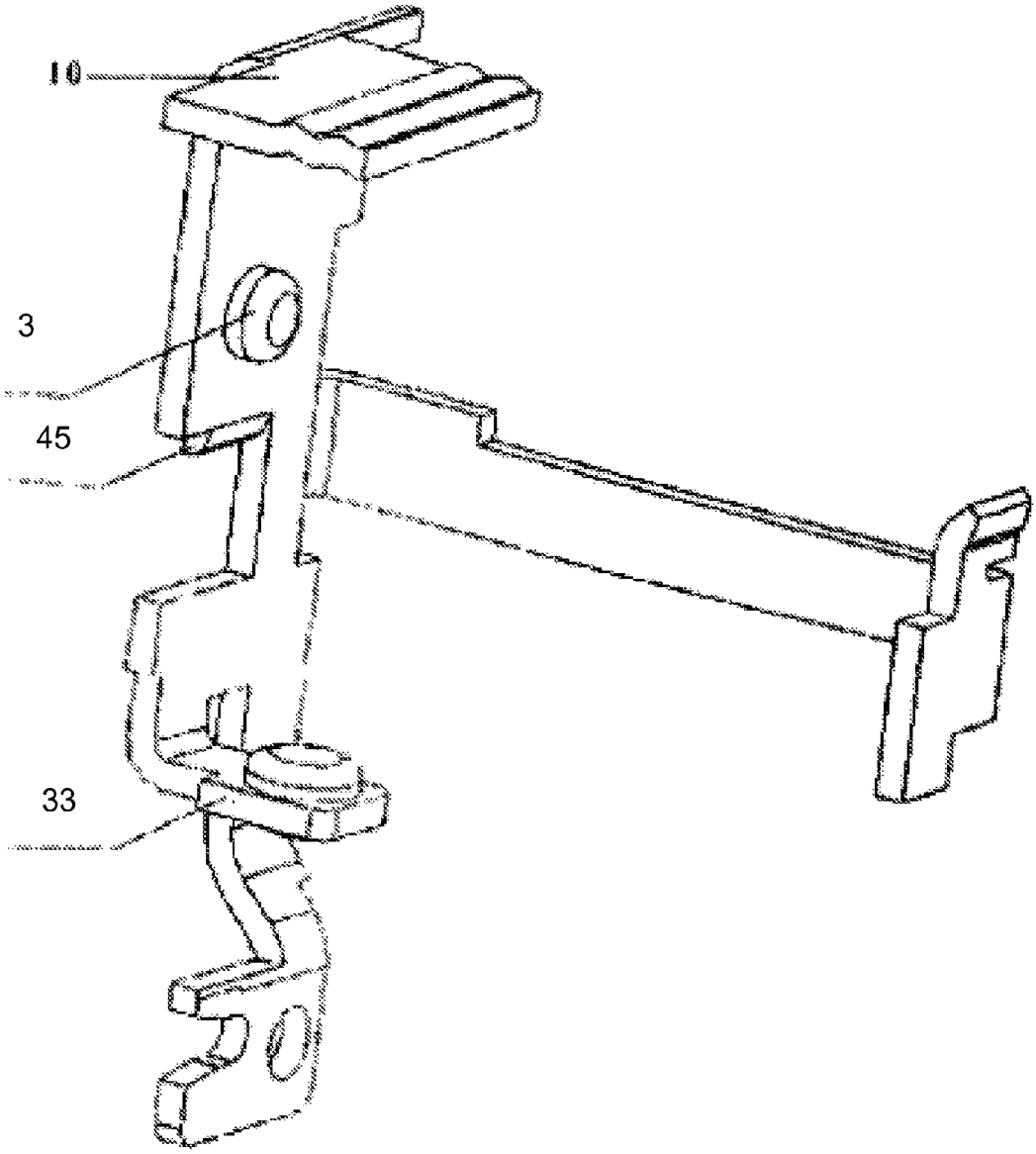
FIG. 19 is an illustrative view showing the structure of the switch assembly according to an embodiment of the present invention, including a first internal output.
Figure 20:
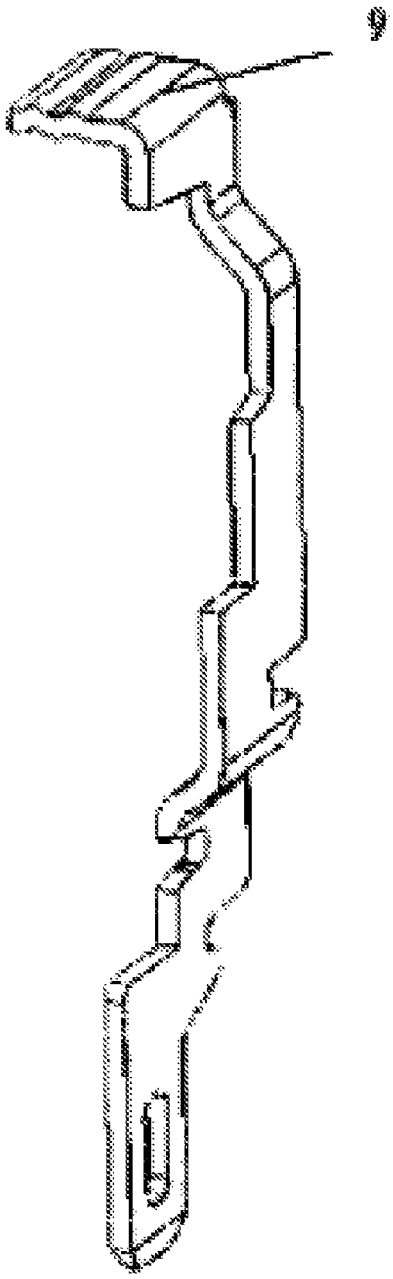
FIG. 20 is an illustrative view showing the structure of the switch assembly according to an embodiment of the present invention, including a first internal output.

The forward/reverse switch mechanism of the switch assembly shown in FIG. 16-17 is positioned in the reverse position, wherein the switch contact plate 61 contacts the second internal output terminal 10 and the first external output terminal 7 and the switch contact plate 62 contacts the first internal output terminal 9 and the second external output terminal 8.

A skilled person in the art can understand the particular structure of the forward/reverse switch mechanism as well as the manner in which the same alternates the pole of the voltage, and thus it is not necessary to describe it in further detail.

Figure 26:
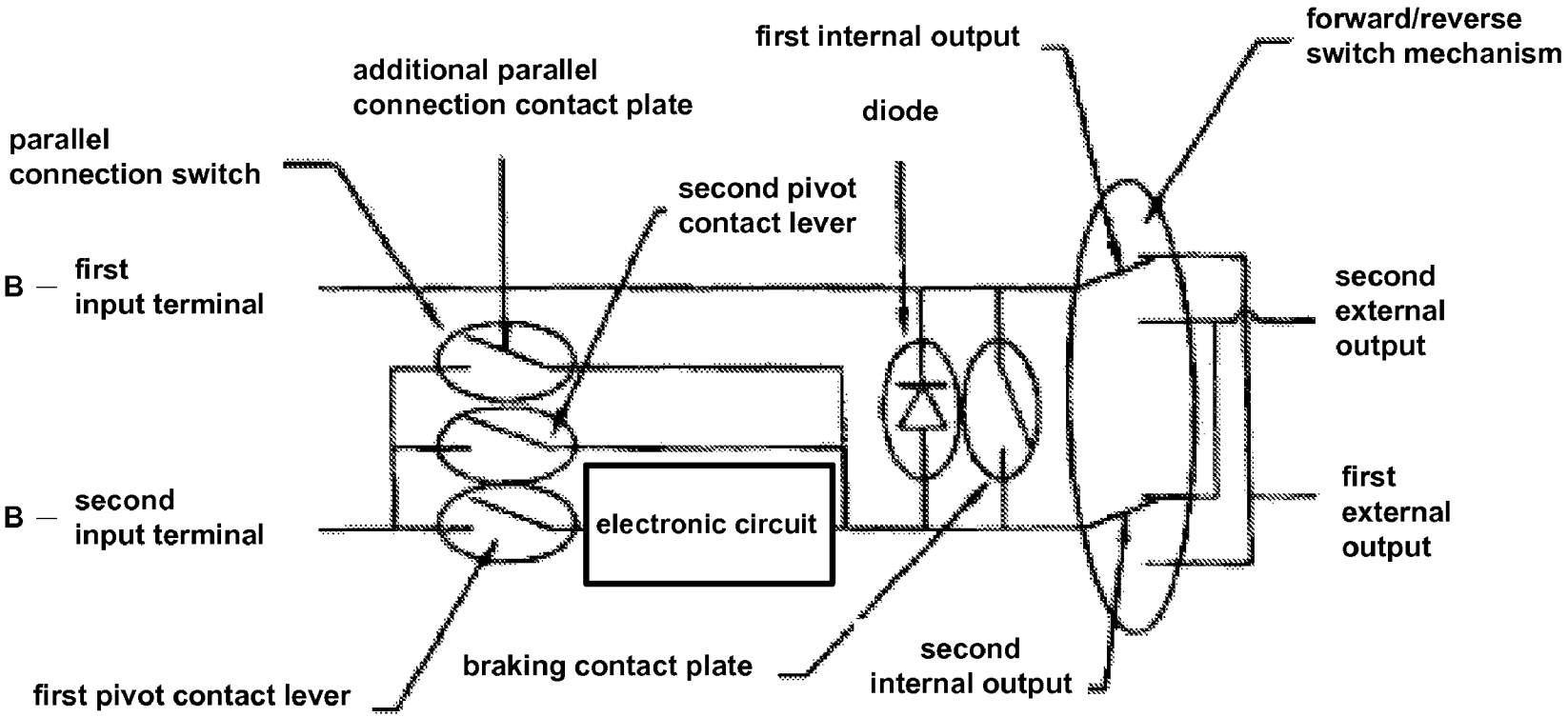
FIG. 26 is an electronic circuit diagram of the switch assembly according to an embodiment of the present invention.

The connection relationship between every component of the switch assembly can be seen as shown in FIG. 26.

The working process of the switch assembly is recited as below:

The first cam 17 is able to leave the compressed portion 168 of the first pivot contact lever 15 so that the pivot contact lever pivots around the connecting point, i.e., the notch 262 between itself and the support 26 so that the first end of the pivot contact lever 15 contacts the fixed contact head 22 on the first fixed contact portion so that the circuit formed by the second input terminal 3, the electronic circuit 21 alternating the output voltage and the second output terminal 10 is connected when the trigger 1 is pressed to overcome action force from said pivot contact lever spring 103 so that the trigger lever 101 and the trigger 1 simultaneously slide inwardly for a part of the travel. The second cam 18 causes the second pivot contact lever 16 closing on the fixed contact head of the second fixed contact portion to connect the circuit from the second input terminal 3 to the second internal output terminal 10, and, the additional parallel connection contact plate also closes between said first additional contact portion 43 and the second additional contact portion 45 so as to bypass the current while the output and input voltages is the same when said trigger is further pressed to the innermost position. The trigger lever slides outwardly because it is subjected to the action force from the pivot contact lever spring 103 so that the trigger and said trigger lever simultaneously protrude outwardly when the trigger is released. While the trigger is sliding outwardly, the second cam presses the second pivot contact lever to be disconnected from the contact head of the second fixed contact portion. While the trigger is continuing to slide outwardly, the first cam presses the first pivot contact lever to be disconnected from the contact head of the first fixed contact portion.

As shown in the electronic circuit diagram, the switch assembly further comprises a diode. The diode has one end connected to the first input terminal and the first output terminal and the other end connected to the second fixed contact portion, the electronic circuit and the second output port. Said diode functions to allow the continuous passage of current flow when said MOSFET is non-conductive during switch-on and switch-off. Said first pivot contact lever is in series connection to the second output terminal via said MOSFET and said second pivot contact lever is in series connection between said second input terminal and said second output port.

In the present invention, the first cam can cause the first pivot contact lever to pivot into contact with or disengagement from the first fixed contact portion while the second cam can cause the second pivot contact lever to pivot into contact with or disengagement from the second fixed contact portion during the sliding travel of said trigger lever. The first and second cams have different shapes so that they can engage said two pivot contact levers at different points of the travel of the trigger lever so that the first cam enables engagement of the first pivot contact lever with the first fixed contact portion prior to the time that the second cam enables engagement of the second pivot contact lever with the second fixed contact portion when the input and the output are in connection. The second cam enables disengagement of the second pivot contact lever with the second fixed contact portion prior to the time that the first cam enables disengagement of the first pivot contact lever with the first fixed contact portion when the input and the output are in disconnected.

The switch assembly further comprises a braking contact plate having one end in series connection to the second output terminal and the other end being able to connect or disconnect said first output port. The braking contact plate is in connection with the first output terminal and the second output terminal when said trigger is in the outermost position. The braking contact plate functions to brake when an electric motor is connected to the switch assembly so as to prevent the rotation of the electric motor when the trigger is pressed from the innermost position to the outermost position.

Figure 27:
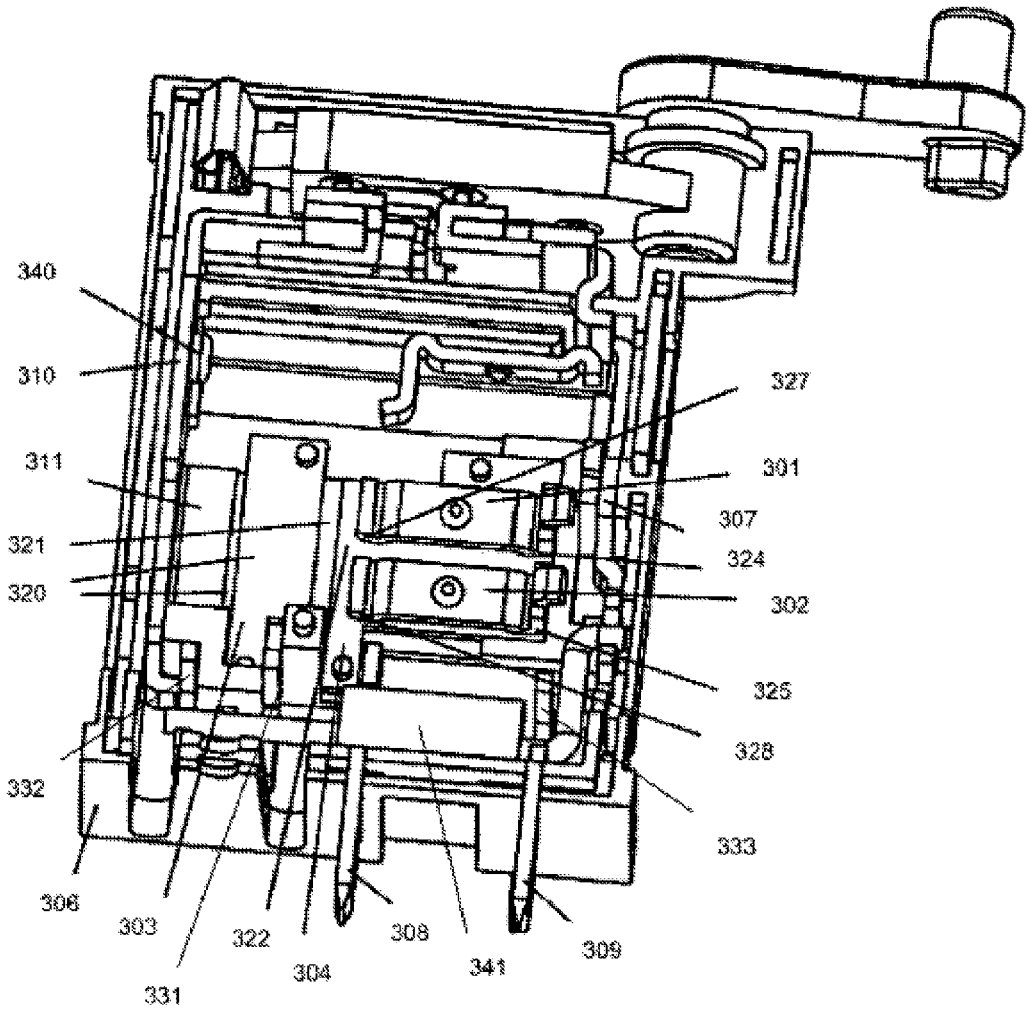
FIG. 27 is a sectional view of the switch assembly, according to an embodiment of the present invention.
Figure 31:
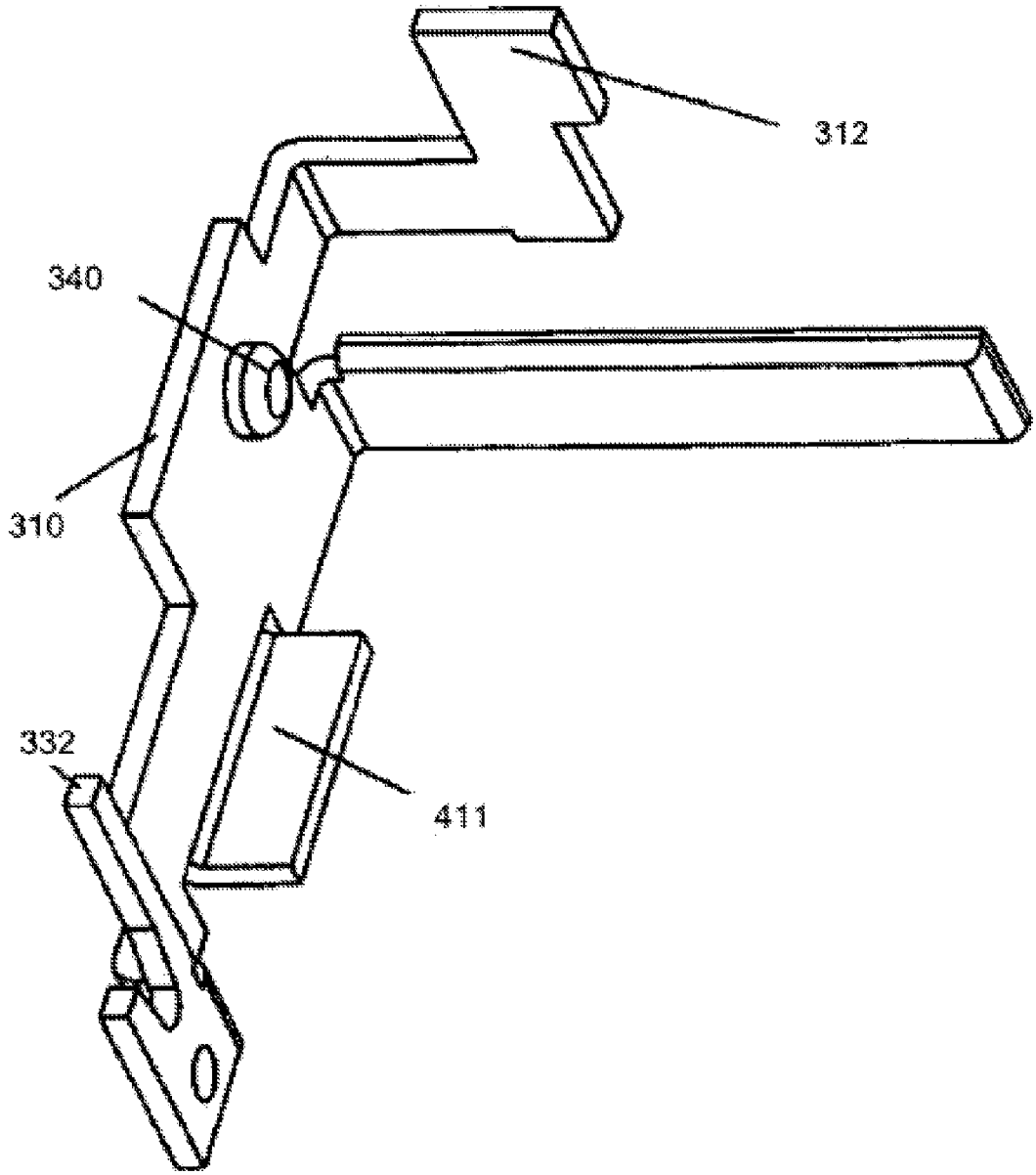
FIG. 31 is a structural representation of the straight-through fixed contact plate according to an embodiment of the present invention.
Figure 32:
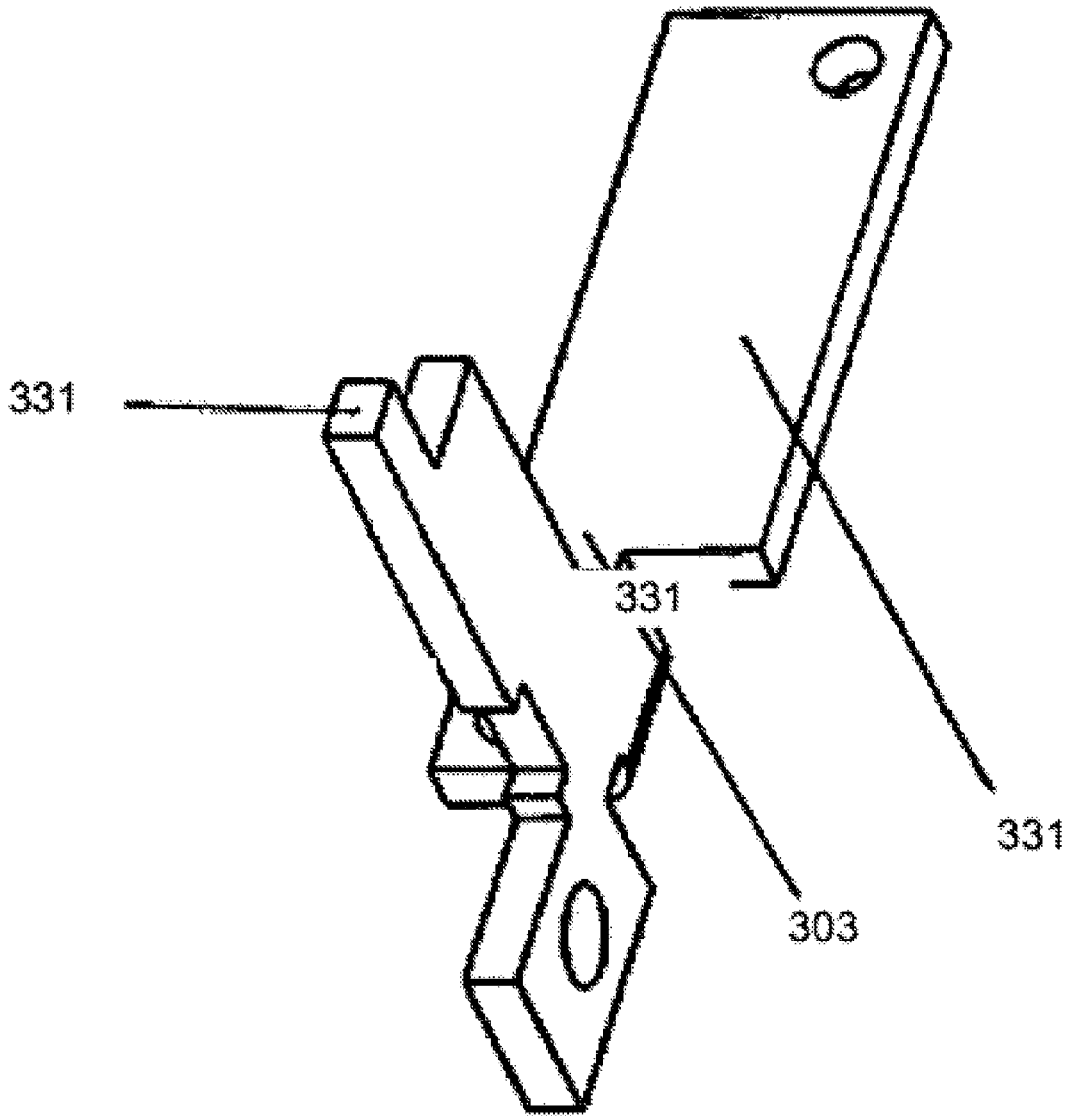
FIG. 32 is a structural representation of a speed governing fixed contact plate according to an embodiment of the present invention.

FIGS. 24-37 illustrate a preferred embodiment for the present invention. As shown in FIGS. 27-28, the switch assembly includes a housing 306. The power source negative pole input fixed contact part 304, as one input unit, and the power source positive pole input fixed contact part 307 as another input unit are installed on the housing 306. The power source negative pole input fixed contact part 304, with the power source negative pole input fixed contact plate 322 and the power source positive pole input fixed contact part 307 are both fixed to the housing 306. One end 308 of the power source negative pole input fixed contact part 304 is used for electrical connection at the negative pole of the power source. One end 309 of the power source positive pole input fixed contact part 307 is used for electrical connection at the positive pole of the power source. The straight-through fixed contact part 310 is also fixed to the housing 306. In FIG. 31, the straight-through fixed contact part 310 is equipped with the straight-through fixed contact plate 411 used as the straight-through fixed contact unit. The straight-through fixed contact part 310 is also equipped with the end 312 used as the output unit. As shown in FIGS. 27 and 32, a speed governing fixed contact part 303 equipped with the speed governing fixed contact plate 320, used as the speed governing fixed contact unit, is fixed to the housing 306.

Figure 33:
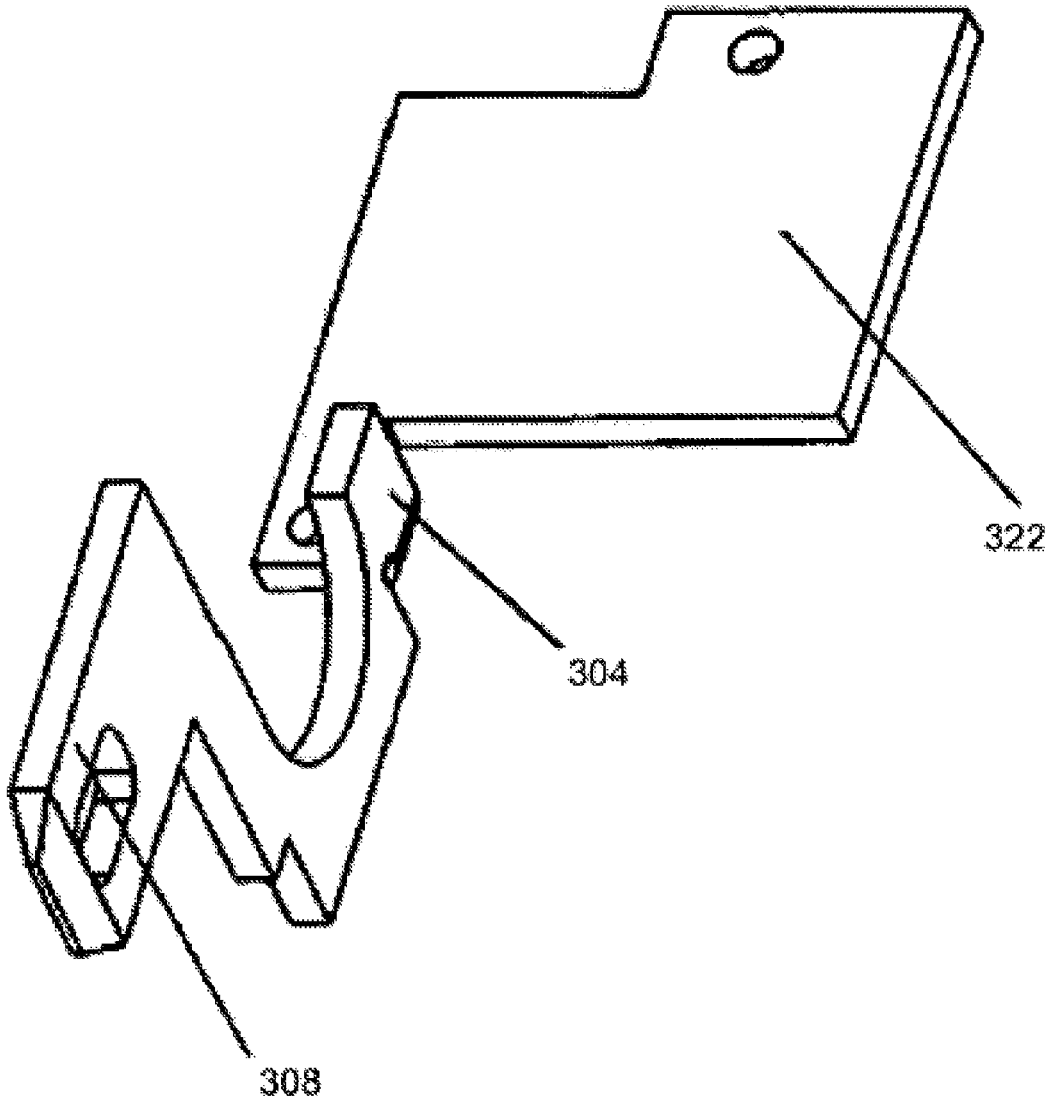
FIG. 33 is structural representation of a power source negative pole input fixed contact plate according to an embodiment of the present invention.

As shown in FIGS. 27 and 33, the power source negative pole input fixed contact part 304 is equipped with the power source negative pole input fixed contact plate 322. The push rod 305 is connected to the housing 306, and is able to slide in a reciprocating way in relation to the housing.

The housing 306 is also equipped with two identical sliding contact plates 301 and 302 used as the sliding contact part. The sliding contact plates 301 and 302 are used to receive electric current from the power source negative pole input fixed contact part 304. In one embodiment, there are two sliding contact plates, but there may be more than two. More sliding contact plates may provide less electric current that flows via each contact point, less total contact resistance, and a higher bearing capacity of the switch. The switch assembly in one embodiment is equipped with at least two sliding contact parts, to reduce the electric current that flows via each contact point and to reduce the total contact resistance.

Figure 34:
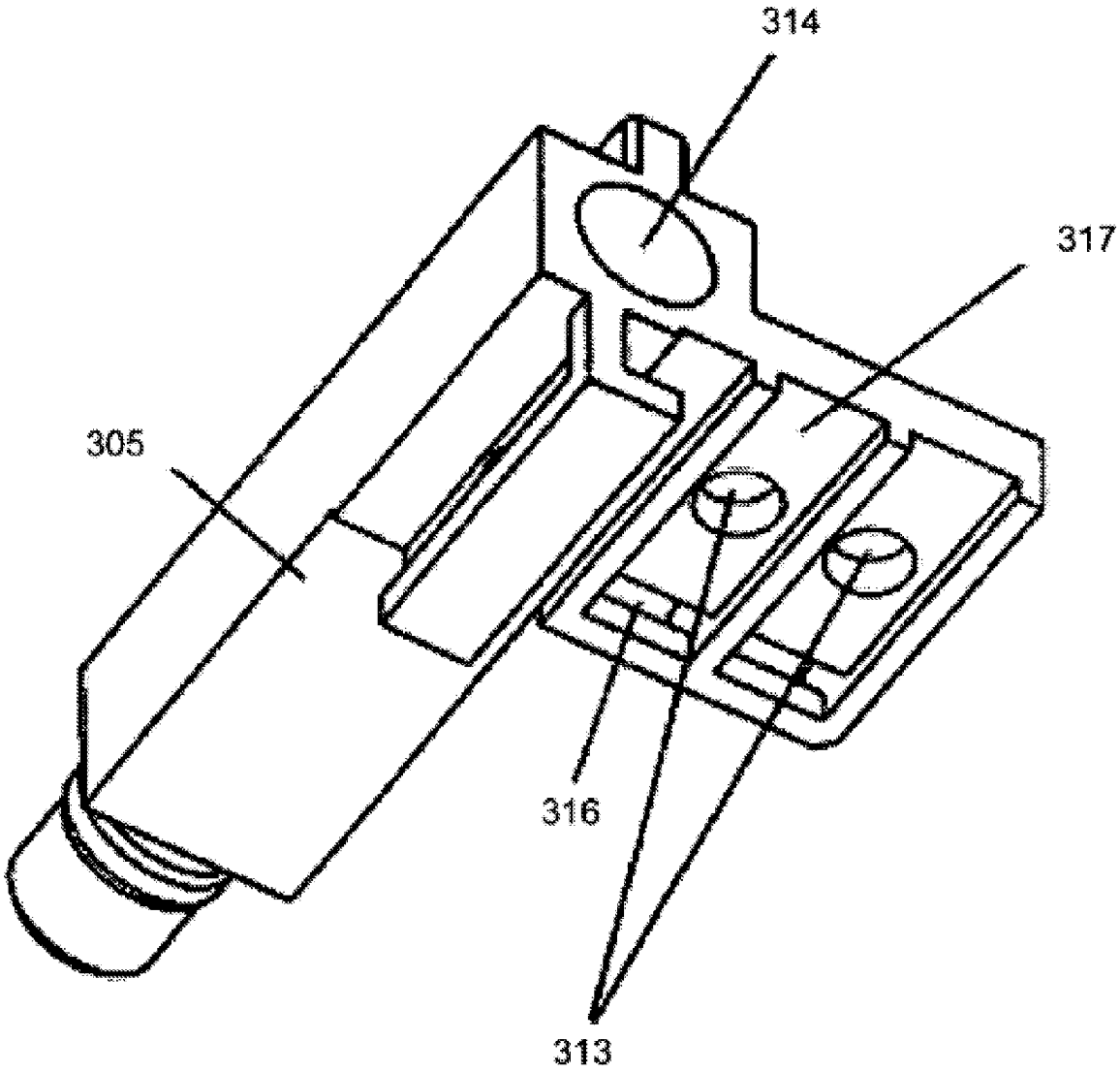
FIG. 34 is a diagram of a push rod according to an embodiment of the present invention.

In FIG. 27, the push rod 305 and its ledge 315 are not drawn (see FIG. 39), to show the relative position relations for the sliding contact plates 301 and 302, the power source negative pole input fixed contact part 304, the speed governing fixed contact plate 320 and the straight-through fixed contact plate 311. The sliding contact plates 301 and 302 are fixed in connection to the push rod 305. As shown in FIGS. 28, 33, and 34, the push rod 305 is equipped with the ledge 315 formed with it as a whole piece. The notch 317 is connected to the ledge 315. The contact plate spring hole 313 used to accommodate one end of the contact plate spring (not shown) is set up inside the notch 317.

One end of the notch 317 is equipped with the clip hole 316. The sliding contact plates 301 and 302 are equipped with the catch 318 and the bulging unit 312. In an assembly of the embodiment, one end of the contact plate spring (not shown) is placed into the contact plate spring hole 313 first, and the bulging unit 312 of the sliding contact plate is used to press on the other end of the spring and insert the catch 318 into the clip hole 316 of the ledge 315, so that the sliding contact plate is held to the ledge 315 with the cooperation of the catch 318 and the clip hole 316. The contact plate spring may exert thrust on the sliding contact plate due to pressure.

The push rod spring (not shown) may be installed into the push rod spring hole 314 of the push rod 305. When the push rod 305 equipped with the sliding contact plate is assembled to the housing of the switch, one end of the push rod presses firmly on the bottom of the push rod spring hole 314, while the other end presses firmly on the convex unit 340 of the straight-through fixed contact part 310. The push rod spring exerts an outward thrust on the push rod, so that the push rod is able to slide inwardly when it pushes and presses inwardly under the effect of an external force. When the external force for pushing and pressing inwardly disappears or is less than the outward thrust of the push rod spring, the push rod will slide outward until it reaches the maximum position for its outward protrusion. With the thrust of the contact plate spring, the sliding contact plate firmly presses on the corresponding part it needs to be in contact with, to implement efficient electric conduction.

Figure 29:
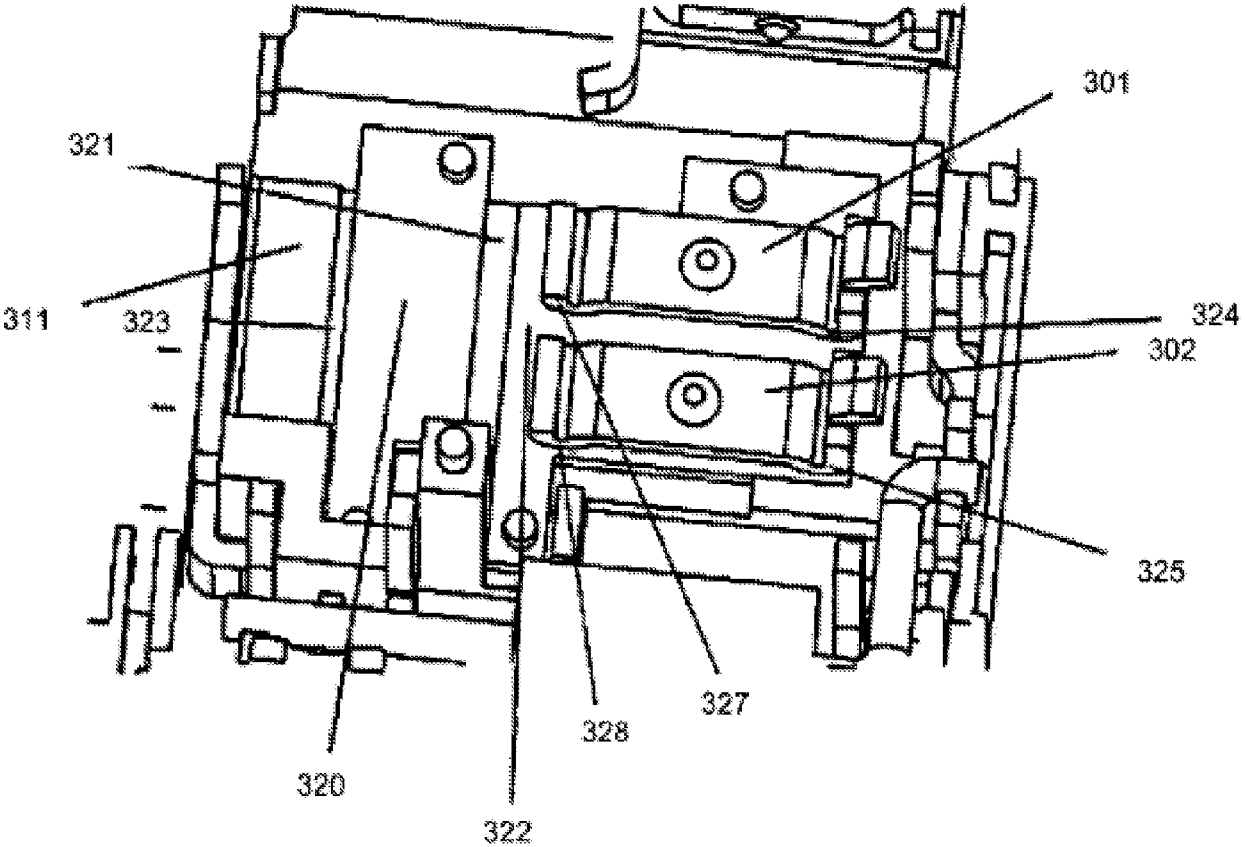
FIG. 29 is a close-up view of the switch according to an embodiment of the present invention.

The two sliding contact plates 301 and 302 are able to slide together with the push rod in a reciprocating way in relation to the housing 306 when the push rod 305 is sliding in a reciprocating way during a course. In FIGS. 27-29, the insulation gap 321 is connected between the speed governing fixed contact plate 320 and the power source negative pole input fixed contact plate 322, and the insulation gap 323 is connected between the speed governing fixed contact plate 320 and the straight-through fixed contact plate 311. When the push rod 305 of the switch is not in a situation in which it slides inward under the effect of pressure, the ends 324, 327, 325 and 328, respectively, for the two sliding contact plates are all in contact with the power source negative pole input fixed contact plate 322. In this condition, the switch is in an OFF status. During the entire portion in which the push rod 305 is sliding in a reciprocating way, the end 324 and the end 325 are in constant contact with the power source negative pole input fixed contact plate 22 for electric conduction. The end 324 and the end 325 respectively for the sliding contact parts 301 and 302 may slide during the entire portion in which the push rod 305 is sliding in a reciprocating way.

As shown in FIGS. 27-29, during the preliminary part of the entire portion in which the push rod 305 slides inwardly under pressure, the push rod 305 of the switch drives the end 327 and the end 328 respectively for the sliding contact plates 301 and 302. The push rod 305 separates the sliding contact plates 301 and 302 from the power source negative pole input fixed contact plate 322 and makes them contact the speed governing fixed contact plate 320. In this condition, the electric current flows, via the power source negative pole input fixed contact part 304, the sliding contact plates 301 and 302, the speed governing fixed contact part 303 and the electronic circuit with speed governing feature as connected to the speed governing fixed contact part 303, to the output unit of the switch or the power-driven equipment under the control of the switch, and the switch is in speed governing status at this time.

Figure 36:
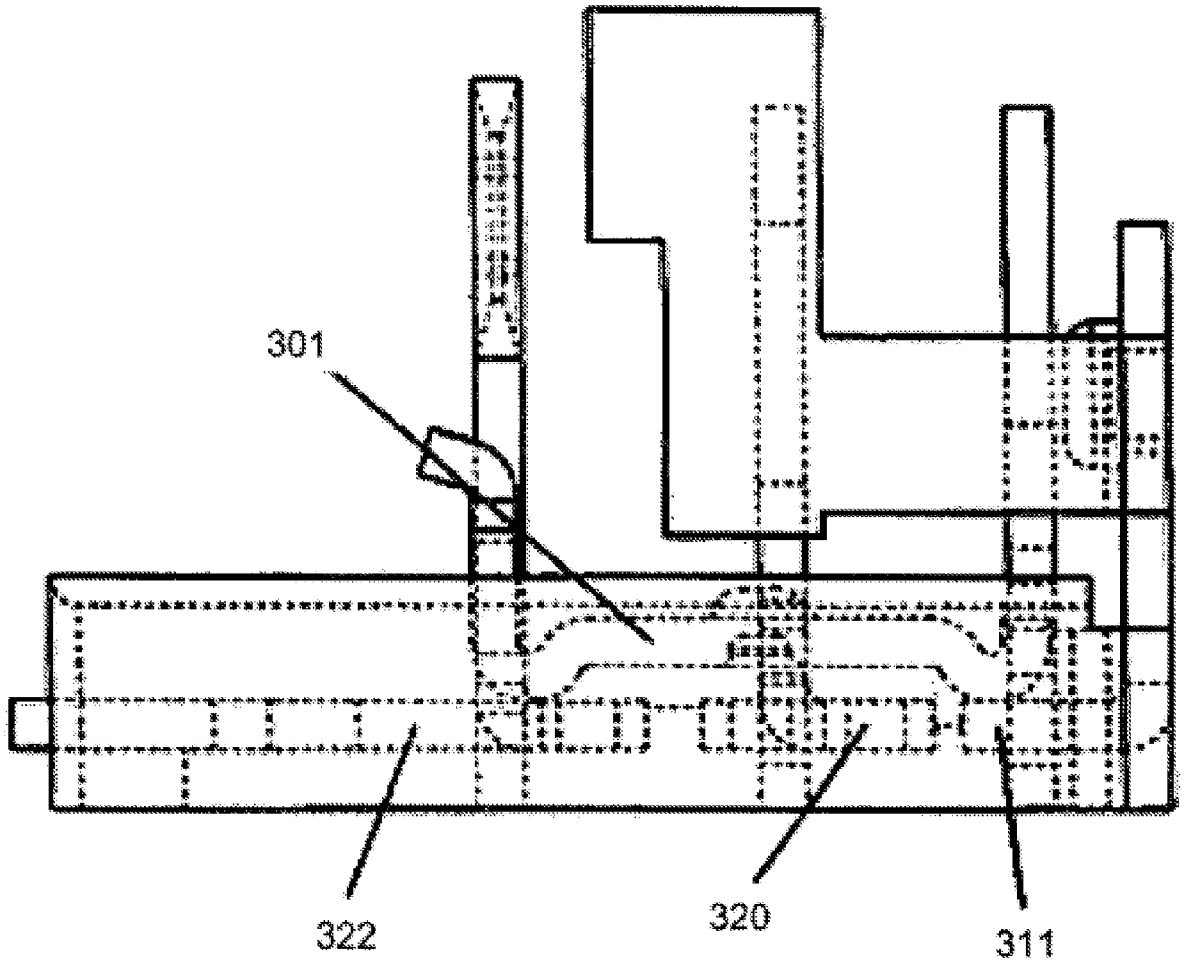
FIG. 36 is a diagram of surface contacts according to an embodiment of the present invention.

As shown in FIGS. 27, 28 and 36, during the final part of the entire portion in which the push rod 305 slides inwardly under the effect of further pressure, the push rod 305 of the switch drives the end 327 and the end 328 respectively for the sliding contact plates 301 and 302. The push rod 305 separates the sliding contact plates 301 and 302 from the speed governing fixed contact plate 320 and makes them contact the straight-through fixed contact plate 311. In this condition, the switch is in straight-through status. At this time, the electric current flows directly, via the power source negative pole input fixed contact part 304, the sliding contact plates 301 and 302, and the straight-through fixed contact part 310, to the output unit of the switch or the power-driven equipment under the control of the switch.

Figure 35:
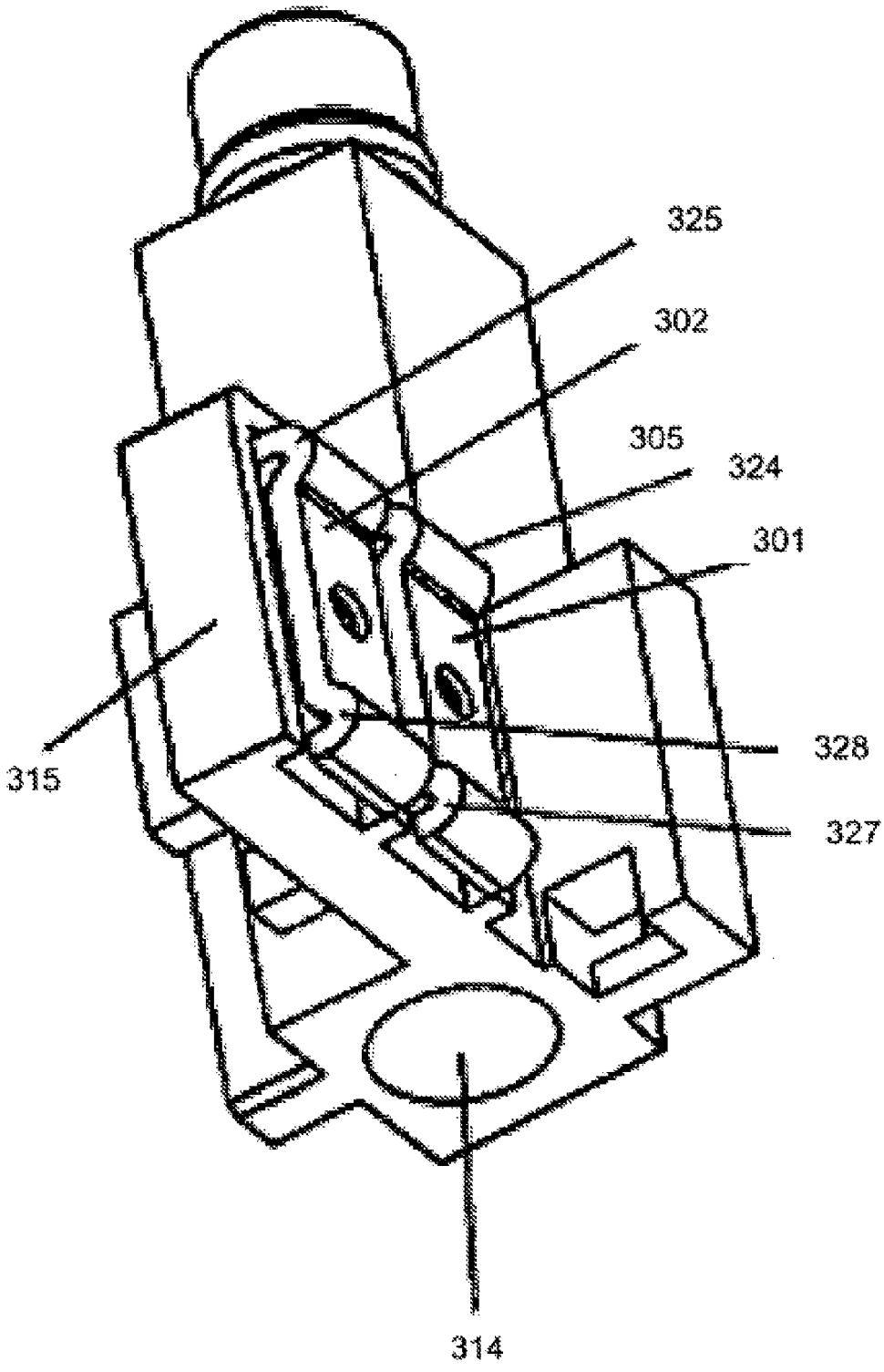
FIG. 35 is a diagram of the push rod installed with the sliding contact plate according to an embodiment of the present invention.
Figure 37:
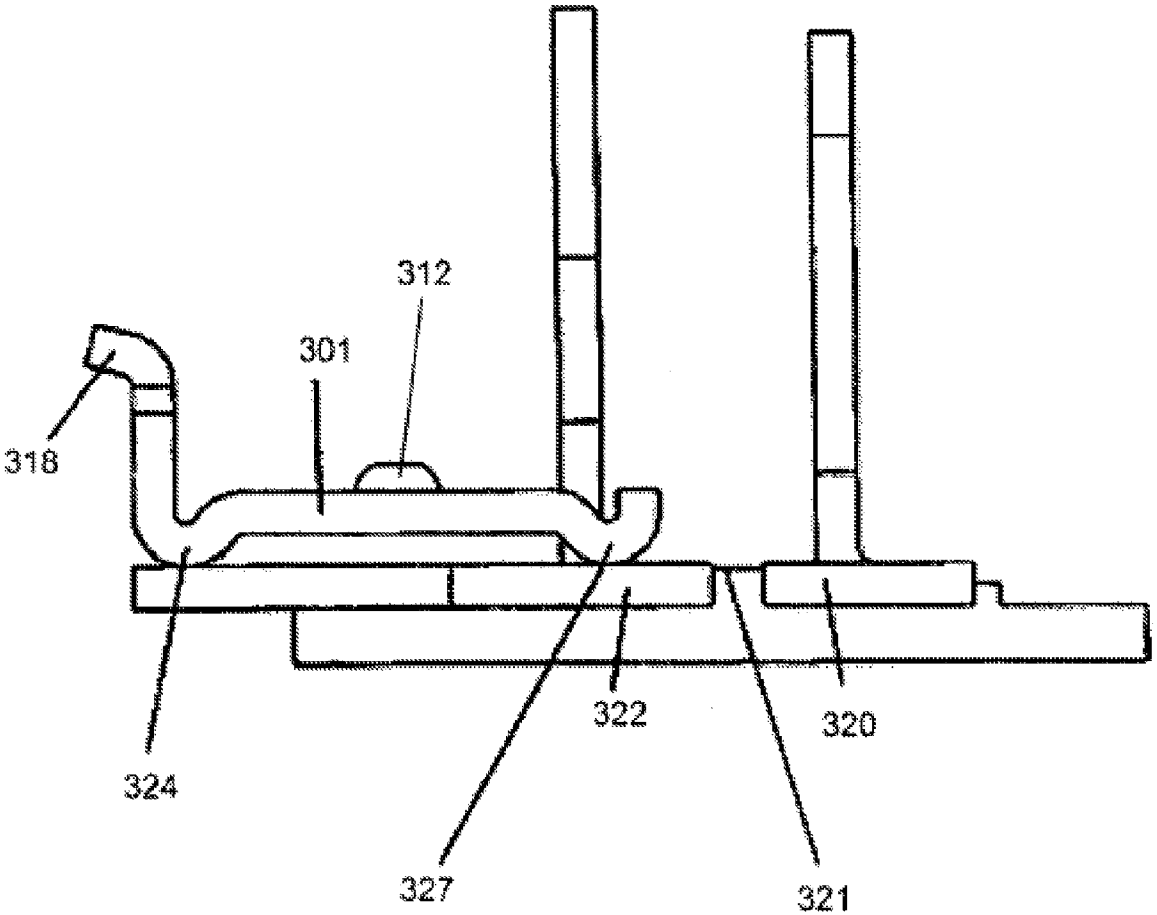
FIG. 37 is a diagram that displays a sliding contact according to an embodiment of the present invention.

As shown FIGS. 35-37, the end 324, the end 325, the end 327 and the end 328 respectively for the sliding contact plates 301 and 302 include one cambered contact surface each. The power source negative pole input fixed contact plate 322, the speed governing fixed contact plate 320 and the straight-through fixed contact plate 311 have flat surfaces. During operation, the contact of the sliding contact plates with the power source negative pole input fixed contact plate 322, the speed governing fixed contact plate 320 and the straight-through fixed contact plate 311 is the contact of cambered contact surfaces with the various corresponding flat surfaces. Each end of the sliding contact plates 301 and 302 can also be equipped with two or more cambered contact surfaces, so as to reduce electric current flows via each contact point and to reduce the total contact resistance.

Figure 38:
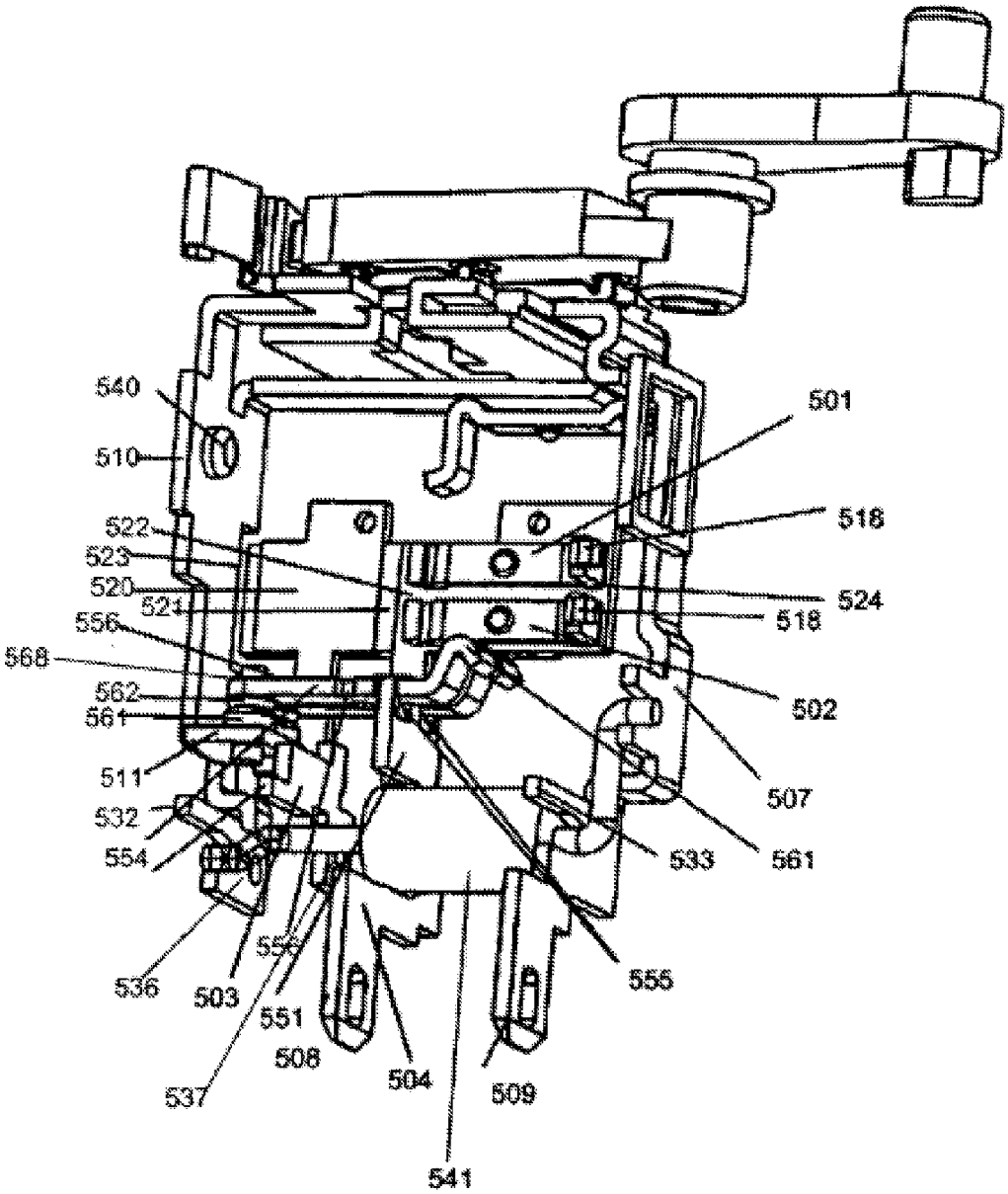
FIG. 38 is a sectional view of the housing of the switch assembly according to an embodiment of the present invention.
Figure 39:
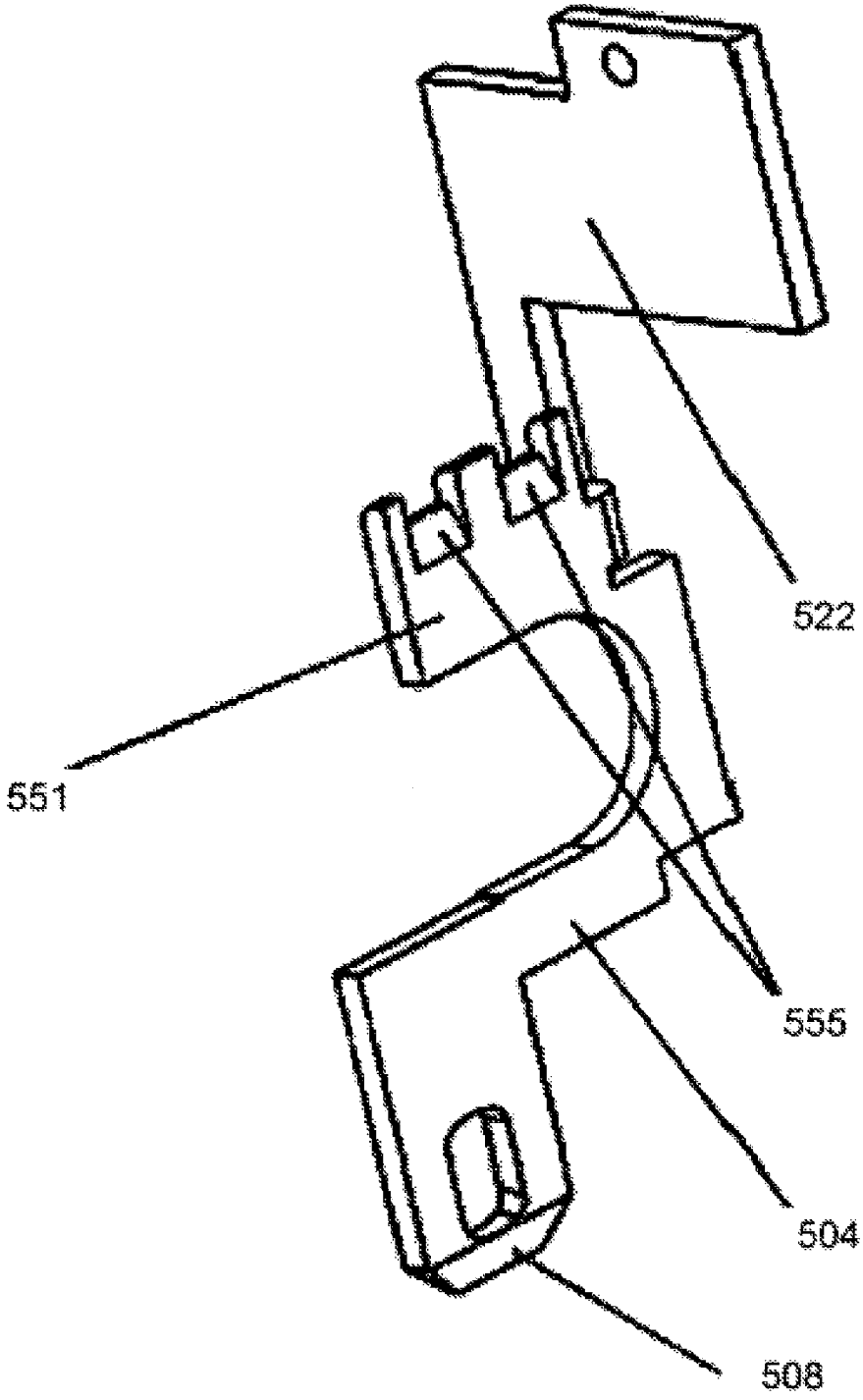
FIG. 39 is a diagram of the power source negative pole input fixed contact part according to an embodiment of the present invention.
Figure 40:
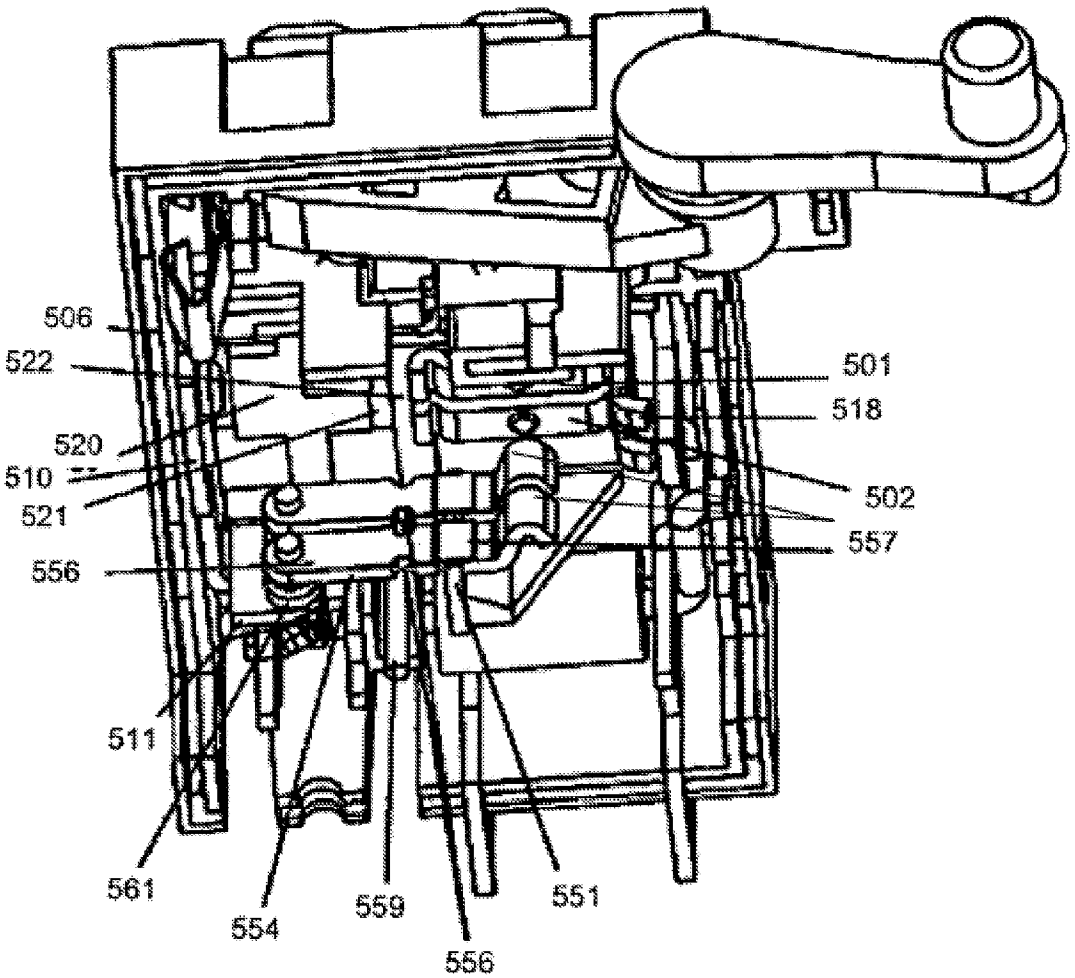
FIG. 40 is a sectional view of the housing of the switch assembly, with a push rod dismounted, according to an embodiment of the present invention.
Figure 41:
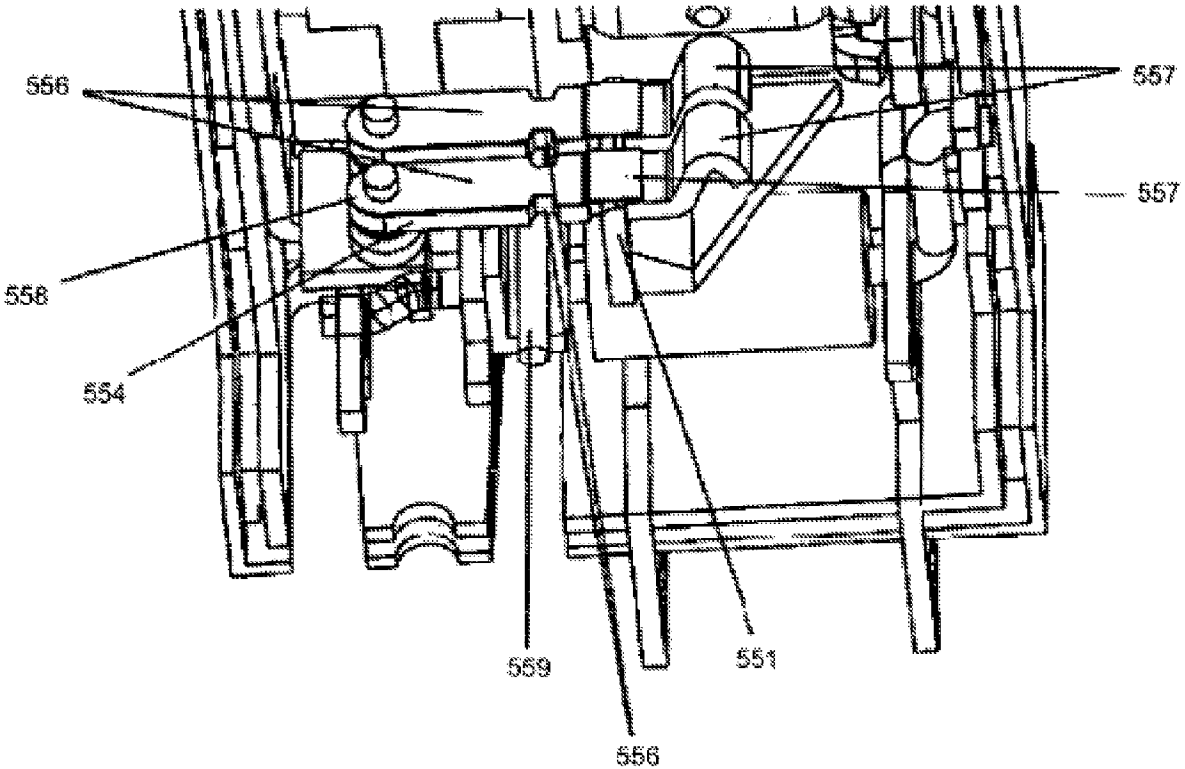
FIG. 41 is a close-up view of the housing of the switch assembly, with a push rod dismounted, according to an embodiment of the present invention.
Figure 42:
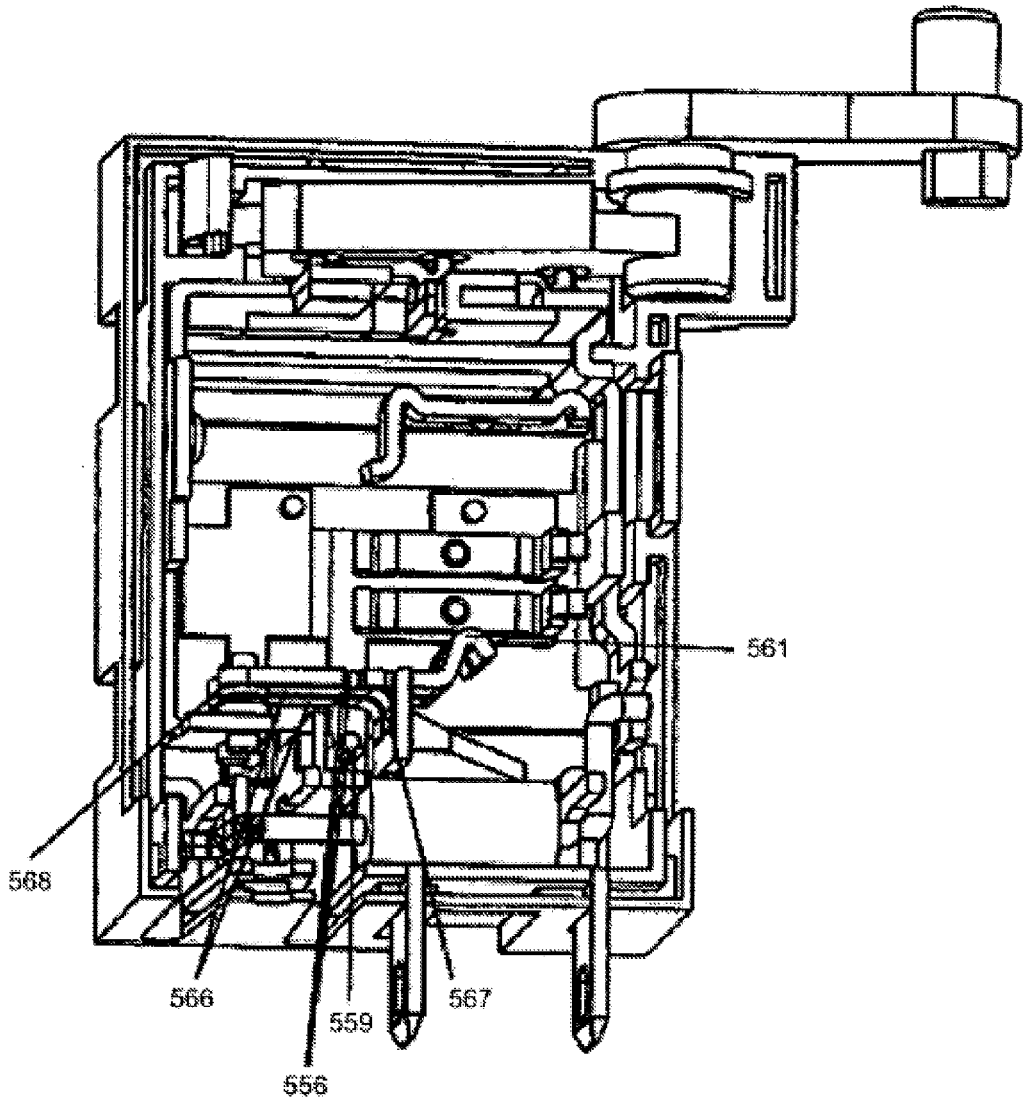
FIG. 42 is another sectional view of the housing of the switch assembly, with a push rod dismounted, according to an embodiment of the present invention.

As shown in FIG. 30, the electric speed governing system (PCB) 335, composed of an electronic circuit. The PCB 335 is connected with the speed governing fixed contact part 303 via the soldered point 331 on the speed governing fixed contact part 303, and is connected with the power source positive pole input fixed contact part 307 via the soldered point 333 on the power source positive pole input fixed contact part 307. During installation, if necessary, the locating point 332 on the straight-through fixed contact part 10 can be used for convenient location of the electric speed governing system 335. When the end 327 and the end 328 respectively for the sliding contact plates 301 and 302 are in contact with the speed governing fixed contact plate 320, via the soldered point 331, the electric speed governing system regulates electrical power, and exports power to the electronic impulse field effect transistor (FET) 341. As shown in FIGS. 38 and 39, the speed governing fixed contact part 303 is connected with the FET 341 via the soldered point 337 to deliver electric current to it. The output terminal of the FET 341 is connected with the straight-through fixed contact part 310 via the soldered point 336 on the straight-through fixed contact part 310.

The central hole of push rod 305 is installed with a spring, and when no external force works on the spring, the push rod 305 is at the most outward location. At this time, the two sliding contact plates 301 and 302 are firmly attached to the power source negative pole input fixed contact plate 322. The power source at the negative pole is disconnected, and the switch is at the "OFF" location. When the push rod 305 moves inwardly, the two sliding contact plates 301 and 302 move towards the speed governing fixed contact plate 303, and are connected with the speed governing fixed contact plate 303. The electric current is delivered via the negative pole of the power source to the negative pole input fixed contact plate 322, and flows towards the speed governing fixed contact plate 303 through the two sliding contact plates 301 and 302. The speed governing fixed contact plate 303 is supplied with electricity, and the speed governing fixed contact plate 303 delivers the main current to the FET 341. The output terminal of the FET 341 is connected with the straight-through fixed plate 411. As the power source positive pole input fixed contact plate is connected with the electric speed governing system, the switch has implemented the speed governing feature.

As the push rod 305 continues to move inwardly, the two sliding contact plates 301 and 302 go beyond the speed governing fixed contact plate to connect with the straight-through fixed contact plate 411, and the switch is in the straight-through mode.

The embodiment shown in FIGS. 27-37 adopts the contact mode of double sliding contact plates 301 and 302. The same 2 sliding contact plates are used from the beginning of work to the entry into the speed governing mode, and to the further entry into the straight-through mode. The working contact surfaces are twofold. Compared with a single sliding contact plate for moving contact, the present invention adds one electric current channel in work, so that the electric current that flows via each electric current channel is reduced, and the total contact resistance is also reduced, and the electric current bearing capacity of the switch is increased accordingly.

FIGS. 38-59 illustrate another preferred embodiment of the present invention. In the embodiment shown in FIG. 27, the straight-through feature of the switch is implemented through the simultaneous contact of the sliding contact plates 301 and 302 with the power source negative pole input fixed contact plate 322 and with the straight-through fixed contact plate 311 on the straight-through fixed contact part 10.

In the embodiment illustrated in FIGS. 38-59, the straight-through fixed contact part 310 is not equipped with the straight-through fixed contact plate 311, but is equipped with the straight-through fixed contact plate 511. During the final section of the course of operation for the push rod, the sliding contact plate is still in contact with the speed governing fixed contact plate or may lose contact with the speed governing fixed contact plate. The sliding contact plate may not be in contact with the straight-through fixed contact part. The straight-through mode of the switch is implemented through the connection of the power source negative pole input fixed contact part with the straight-through fixed contact part via at least two pivot contact parts. An important feature for the embodiment illustrated in FIGS. 49-60 is to make use of at least two pivot contact parts (pivot contact plates) to reduce contact resistance.

As shown in FIGS. 38-59, the speed governing fixed contact part 503 is equipped with the speed governing fixed contact plate 520. The speed governing fixed contact plate 520 may be different in size, shape or area from the speed governing fixed contact plate 320 in the embodiment shown in FIG. 27, so that, during the final part of the sliding portion for the push rod 505, the two sliding contact plates 501 and 502 stay in contact with the speed governing fixed contact plate 520. The sliding contact plates 501 and 502 can also be disconnected from the speed governing fixed contact plate 520 during the final part of the portion when the pivot contact part 554 is closed to implement the straight-through feature.

The insulation gaps 521 and 523 are respectively connected to isolate the speed governing fixed contact plate 520 from the power source negative pole input fixed contact plate 522 and from the straight-through fixed contact part 510. The straight-through fixed contact part 510 is with the straight-through fixed contact plate 511 as an integrated part of its entire body, and the straight-through fixed contact plate 511 is different from the straight-through fixed contact plate 311.

Figure 50:
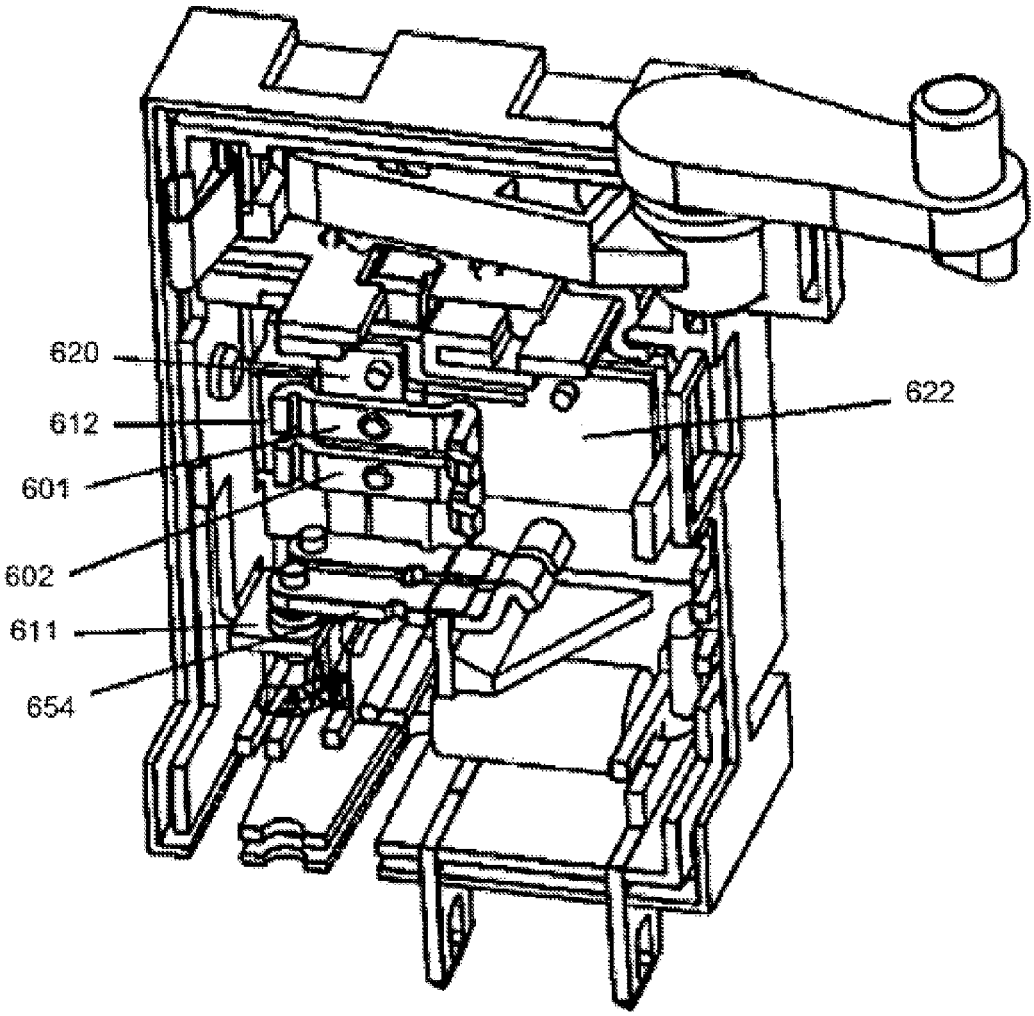
FIG. 50 is a structural representation of a switch assembly in a straight-through mode according to another embodiment of the present invention.
Figure 51:
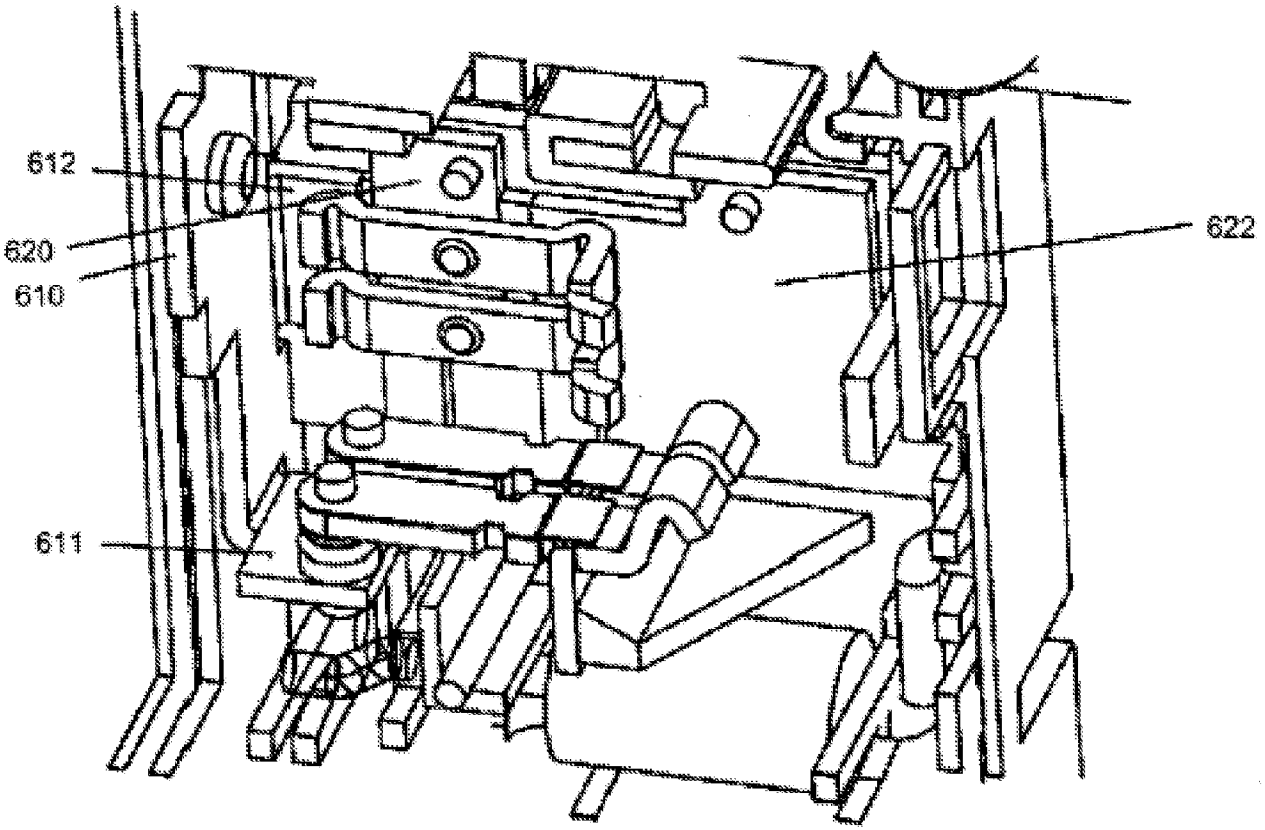
FIG. 51 is a close-up view of the switch assembly in a straight-through mode according to an embodiment of the present invention.
Figure 52:
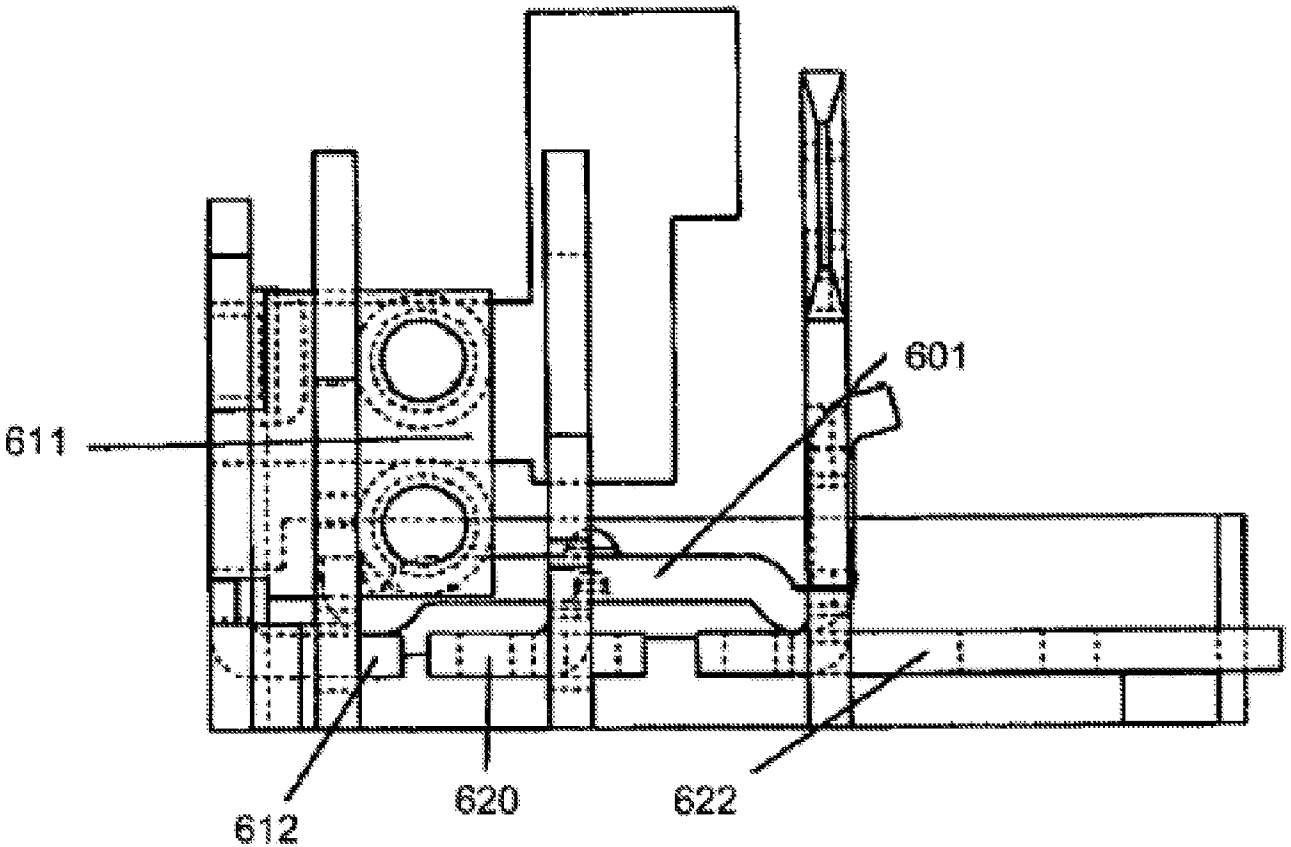
FIG. 52 is a diagram that displays a contact of the cambered surfaces of the sliding contact part in a straight-through mode according to an embodiment of the present invention.
Figure 53:
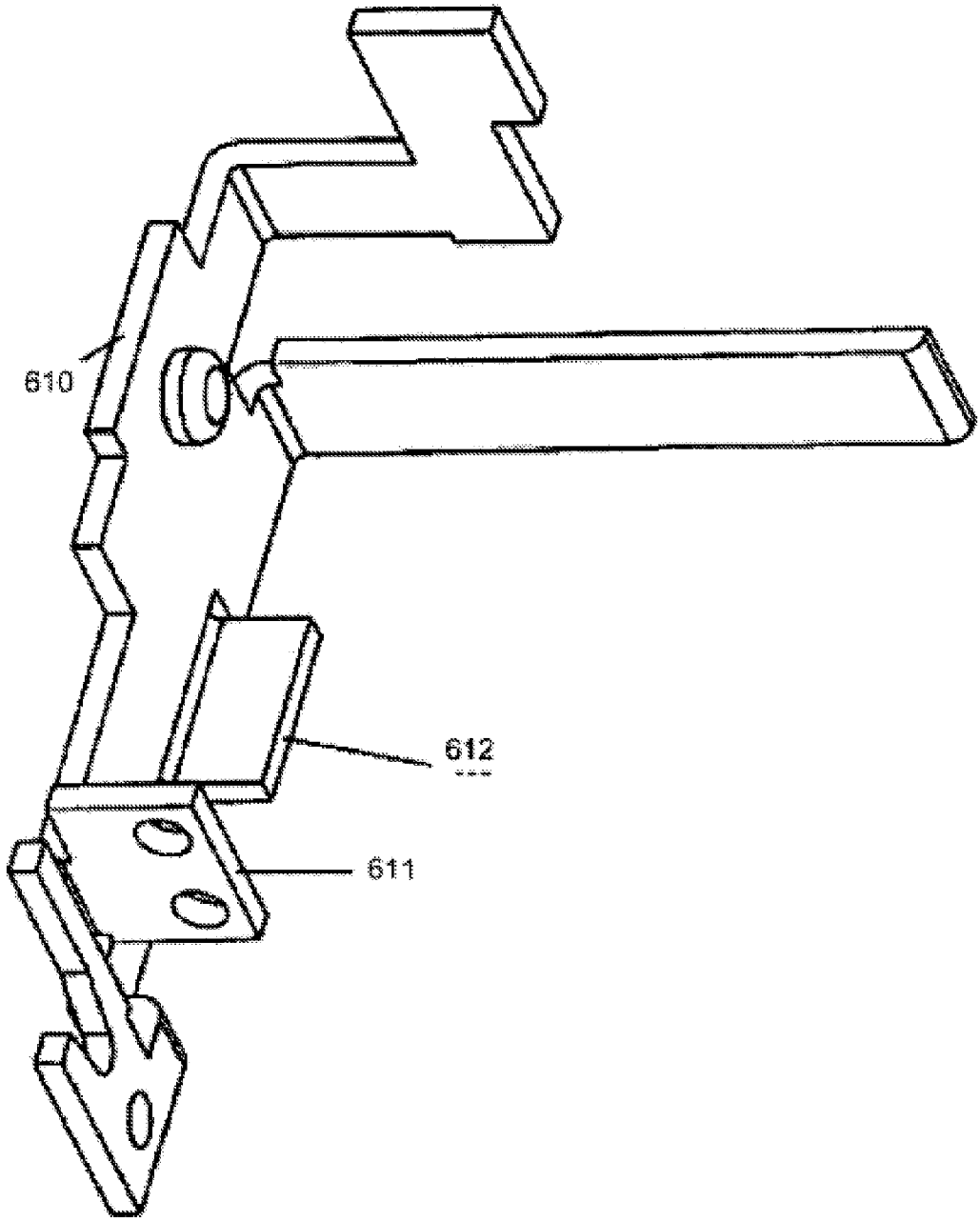
FIG. 53 is a structural representation of the straight-through fixed contact part according to an embodiment of the present invention.

The switch includes two fixed contact terminals 561 connected to the straight-through fixed contact plate 511. A support unit 551 connects to the power source negative pole input fixed contact part 504. As shown in FIG. 50, the support unit 551 is equipped with a concave structure 555. The pivot contact part 554 is equipped with a notch 580 that is in cooperation with the concave structure 555 of the support unit 551. The pivot contact part 554 is also equipped with the tension spring connection unit 556. There is a hole 570 on one end 578 as the current output side for the pivot contact part 554, and by making use of the hole, the contact terminal 562 is riveted to the pivot contact part. The other end 561 forms the salient end used as the pressure support unit for the pivot contact part 554. The salient end has a round and smooth cambered surface for transition. As shown in FIGS. 51-53, the tension spring connection unit 559 is fixed to the housing 506. During assembly, the notch 580 of the pivot contact part 554 is assembled to the concave structure 555 of the support unit 551, and one end of the tension spring (not shown) is connected to the tension spring connection unit 559 on the pivot contact part 554, while the other end is connected to the tension spring connection unit 559 that is fixed in relation to the housing 506. The tensile force of the tension spring makes the contact terminal 562 of the pivot contact part 554 press firmly on the fixed contact terminal 561 of the straight-through fixed contact plate 511.

Figure 46:
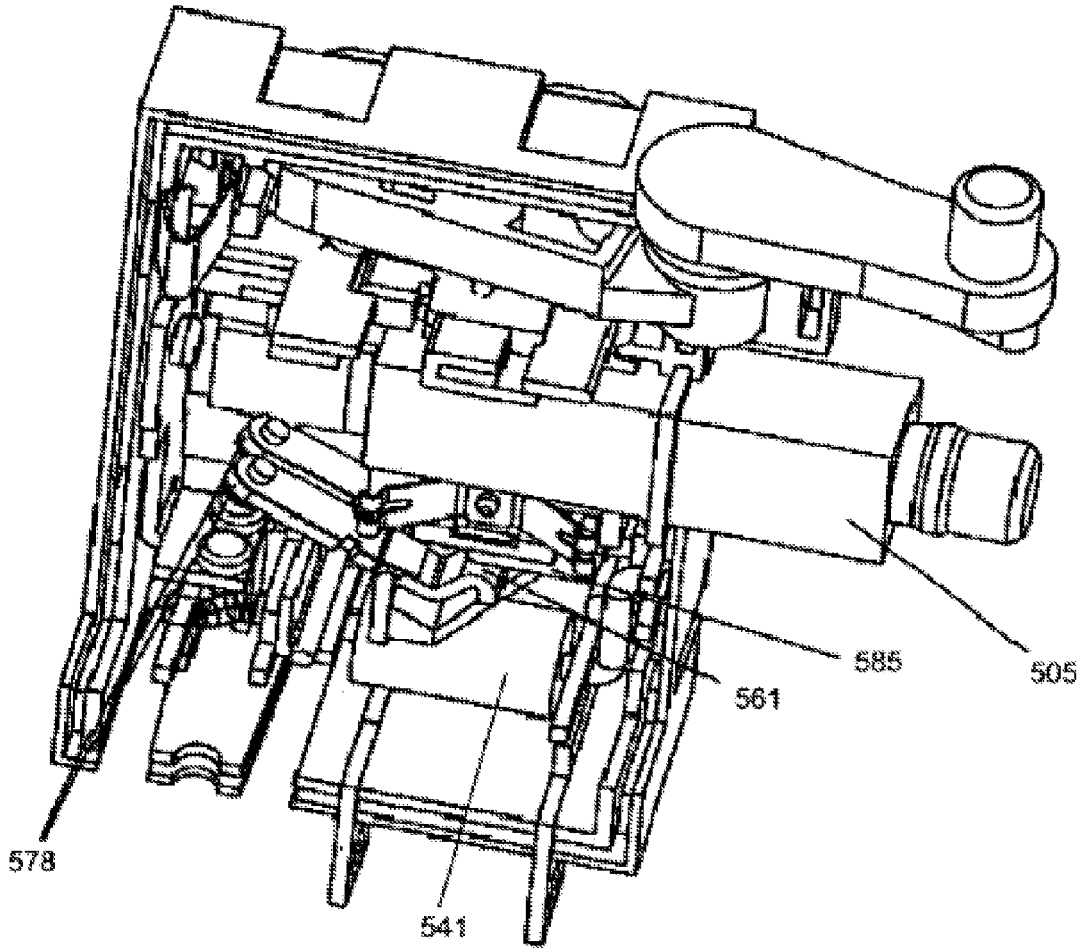
FIG. 46 is a structural representation of the switch in an OFF status according to an embodiment of the present invention.
Figure 48:
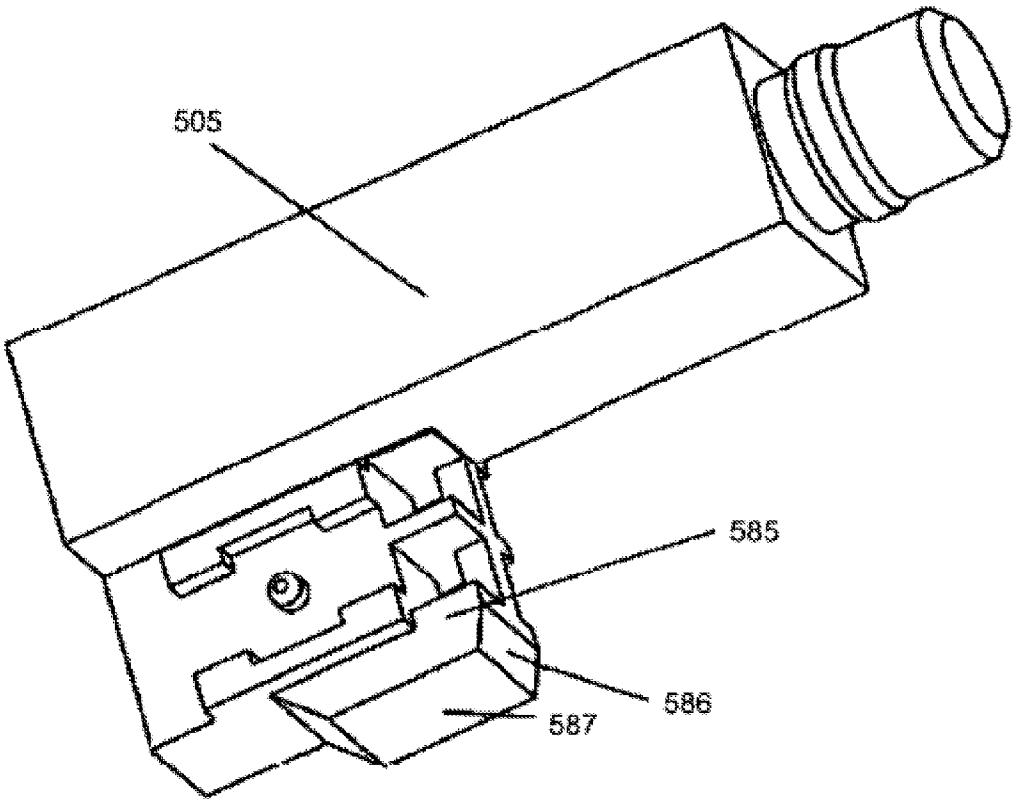
FIG. 48 is a structural representation of a push rod with a cam according to an embodiment of the present invention.
Figure 49:
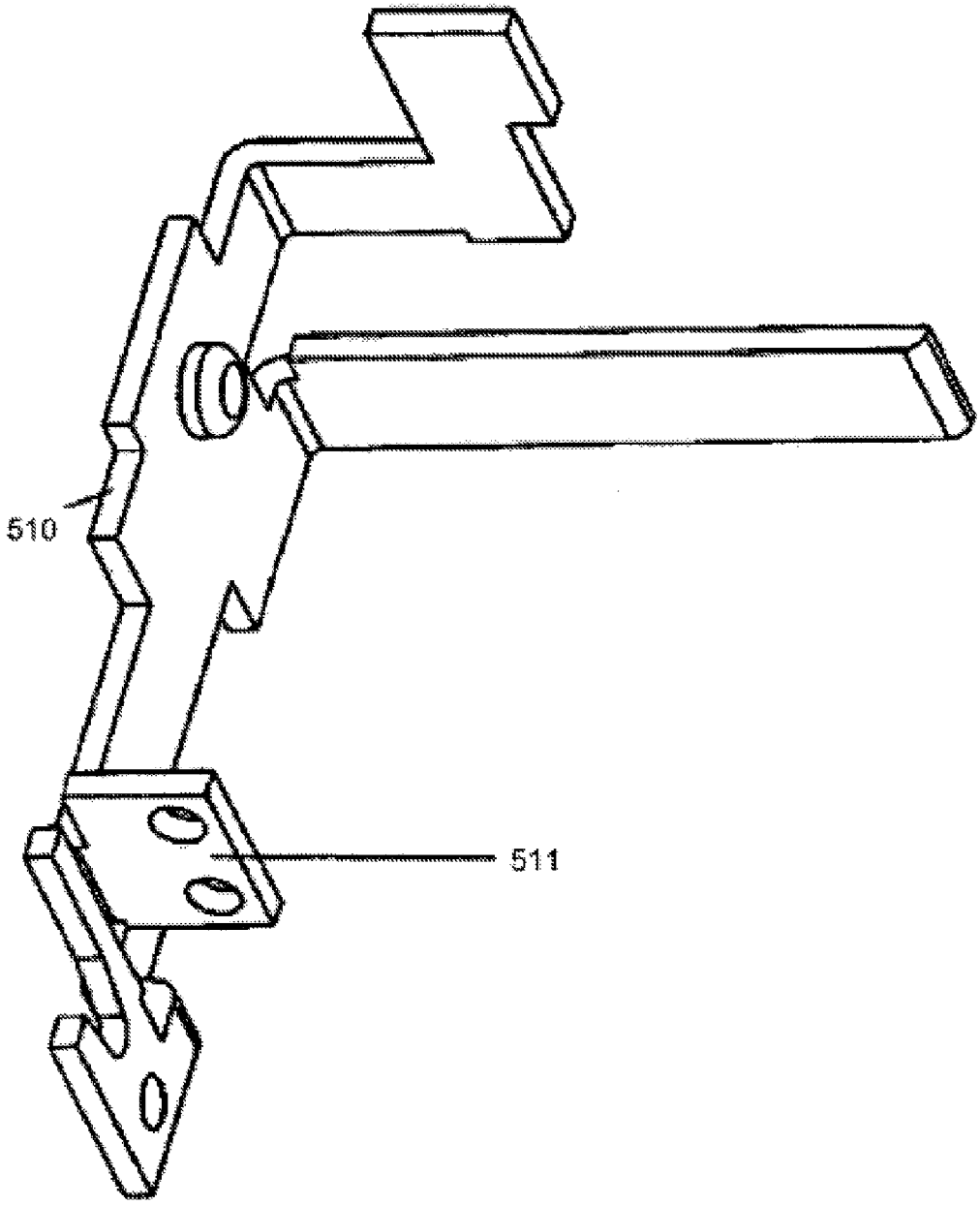
FIG. 49 is a structural representation of a straight-through fixed contact part according to an embodiment of the present invention.

The push rod 505 is different from the push rod 305 in that there is a cam 585 connect to the push rod 505, which is as shown in FIGS. 46 and 48. In FIG. 48, the sliding contact parts 501 and 502 on the push rod 505 are not visible. The sliding contact parts 501 and 502 are connected to the push rod 505, and the sliding contact parts 501 and 502 are fixed to the push rod 505 in the same way as in the embodiment illustrated in FIG. 27.

FIGS. 38-42 illustrate the mode in which the switch is not installed with the push rod 505. After the push rod 505 is assembled to the switch (when the sliding contact parts are not yet sliding inward together with the push rod 505 to make the sliding contact parts contact the speed governing fixed contact plate 520), the cam 585 on the push rod 505 will press on the salient end 561 of the pivot contact part. The push rod 505 separates the contact terminal 562 of the two pivot contact parts from the contact terminal 561 of the straight-through fixed contact plate 511.

The elastic copper plate 556 or the elastic copper plate 566 is connected the pivot contact part 554. The elastic copper plate 556 or 566 is used to compensate the convex structure 555 or the support unit 551 for the insufficient contact between the power source negative pole input fixed contact part 504 and the pivot contact part 554. The elastic copper plate 556 or 566 provides additional contact between the pivot contact part and the power source negative pole input fixed contact part. The elastic copper plate 556 or 566 is connected the upper side of the pivot contact part 554. The elastic copper plate 556 or 566 may also be set up on the lower side of the pivot contact part 554, which is the elastic copper plate 566. If there is a need to set up two elastic copper plates, the elastic copper plate 556 and the elastic copper plate 566 can be set up respectively on the upper side and the lower side of the pivot contact part 554. The switch may include at least one elastic copper plate on each pivot contact plate so as to reduce the resistance at the contact site. The elastic copper plate 556 or 566 is also able to implement the supplementary conduction between the pivot contact part and the power source negative pole input fixed contact plate that is used as the input unit.

Figure 45:
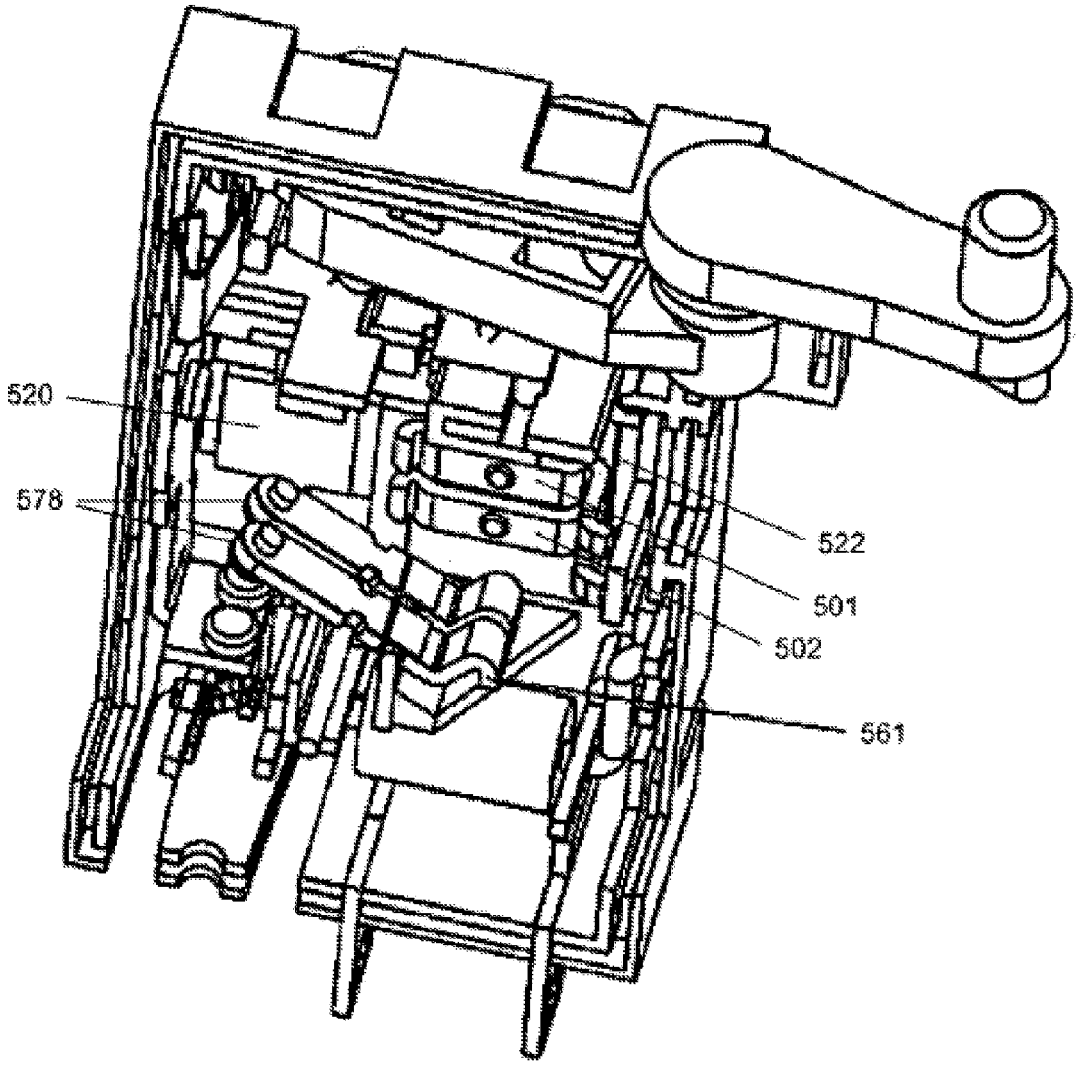
FIG. 45 is a sectional view of the housing of the switch assembly according to another embodiment of the present invention.

FIGS. 45 and 46 illustrate a mode in which the push rod 505 is not yet sliding inwardly or the inward sliding is not sufficient enough to make the sliding contact plates 501 and 502 contact the speed governing fixed contact plate 520, and in such status, the pressure surface 587 of the cam 585 on the push rod stays with pressure on the salient end 561 of the pivot contact plate 554, so that the contact terminal 562 of the pivot contact plate is disconnected from the fixed contact terminal 562 with the uplift of the end 578 or the end 568. At this time, the switch is in OFF status.

When the push rod 505 begins or continues to slide inwardly, namely during the preliminary part of the entire portion in which the push rod 505 slides inwardly, the push rod 505 will drive the two sliding contact plates 501 and 502 to slide inwardly so as to make one end contact the speed governing fixed contact plate 520. The cam 585 maintains pressure on the salient end 561, and the end 578 or the end 568 and the contact terminal 562 are still uplifted. The switch is in speed governing mode.

As the push rod 505 continues to slide inwardly, during the final part of the entire portion in which the push rod 505 slides inwardly, the cam 585 will leave the salient end 561. The spring that exerts a downward tensile force on the pivot contact part, and the end 578 of the pivot contact part makes the contact terminal at the current output side 562 contact the contact terminal 561 to close to implement the straight-through mode.

Figure 43:
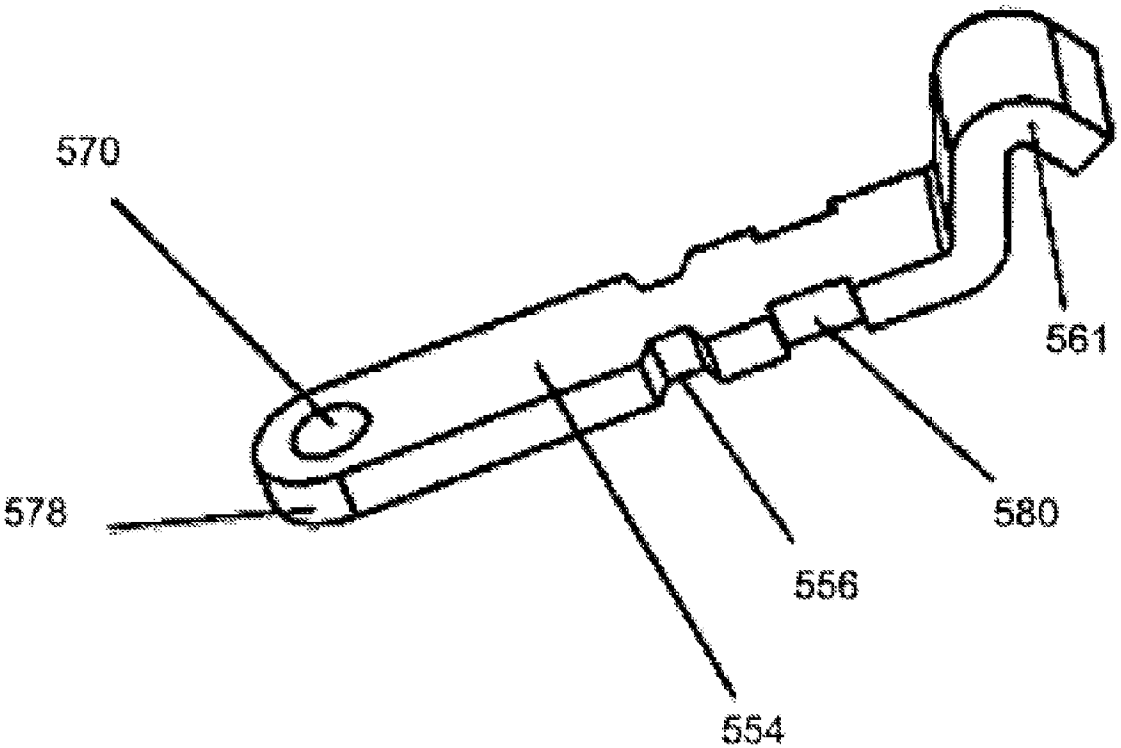
FIG. 43 is another close-up view of a sectional view of the housing of the switch assembly according to an embodiment of the present invention.
Figure 44:
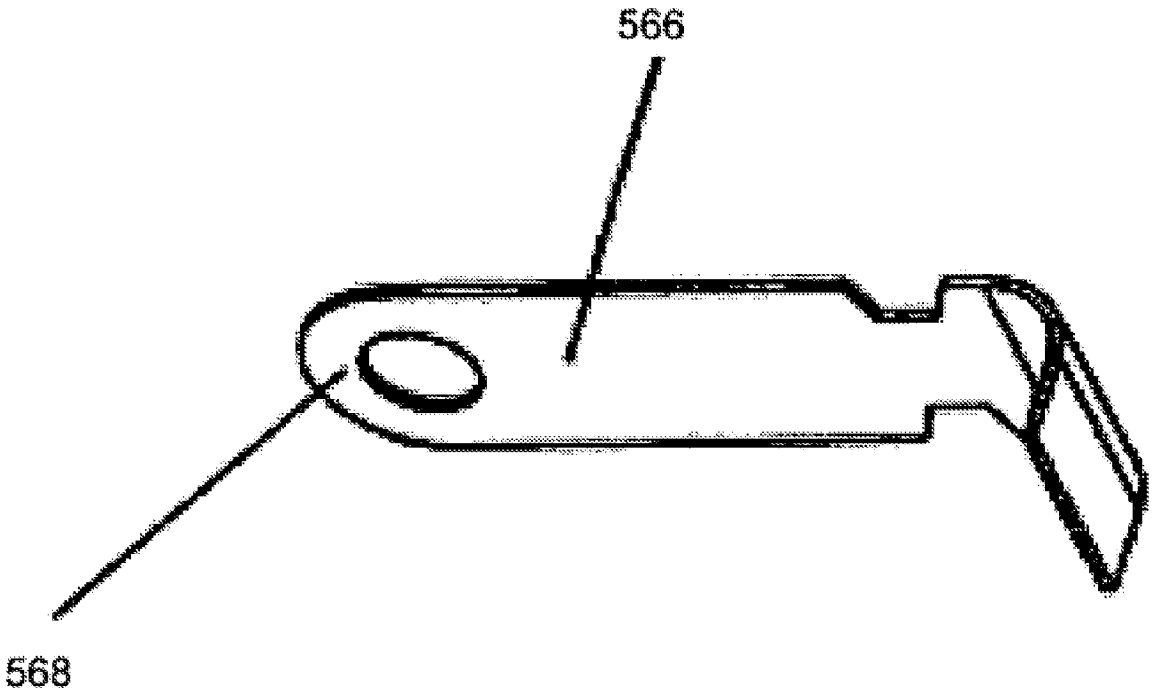
FIG. 44 is a structural representation of an elastic copper plate according to an embodiment of the present invention.

As shown in FIG. 43, one end 578 on the pivot contact plate is with a riveting hole 570, and one end 558 and/or 568 of the elastic copper plate 556 and/or 566 can be anchored to the upper side and/or the lower side of the pivot contact plate via the riveting hole. Due to the elasticity of the elastic copper plate, after the pivot contact plate, with the anchored elastic copper plate, is assembled to the support unit 551, the other end 557 and/or 567 of the elastic copper plate will press firmly on the top of the upper end of the concave structure of the support unit and/or on one side of the upper end of the support unit.

During the entire portion of reciprocating sliding of the push rod 505, one end 524 of the sliding contact parts 501 and 502 are in constant contact with the power source negative pole input fixed contact plate 522 for electric conduction.

Figure 47:
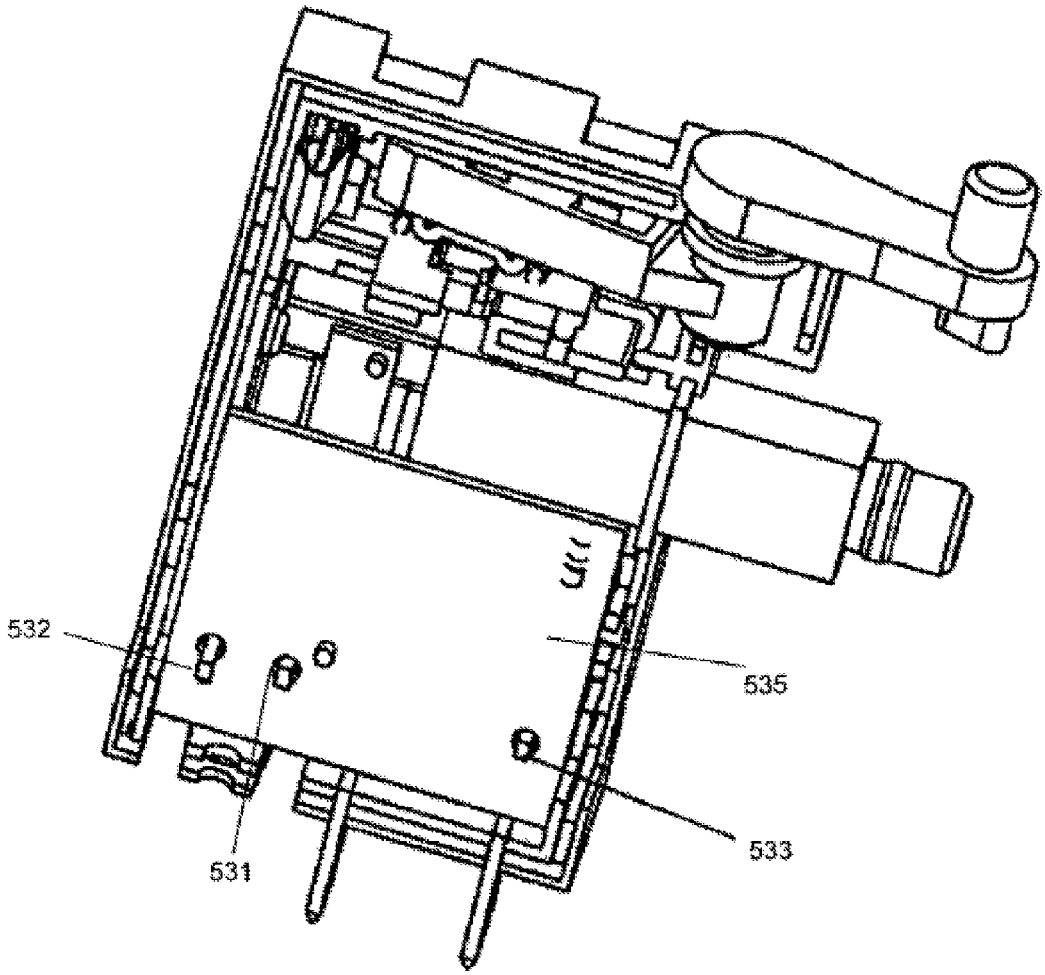
FIG. 47 is a structural representation of the switch assembly equipped with an electric speed governing system in an OFF status according to an embodiment of the present invention.

FIG. 47 illustrates the connection mode for the electric speed governing system (PCB) 535 composed of an electronic circuit. The electric speed governing system 535 is connected with the soldered point 533 on the power source positive pole input fixed contact part 507 and with the soldered point 531 on the speed governing fixed contact part 503. During installation, if necessary, the locating point 532 on the straight-through fixed contact part 510 can be used for convenient location of the electric speed governing system 535. When the speed governing fixed contact part gets electricity, the electric speed governing system gets the electricity to work and exports to the electronic impulse field effect transistor (FET) 541.

As shown in FIG. 38, the FET 541 is connected with the soldered point 536 on the straight-through fixed contact part 510, and is connected with the soldered point 537 on the speed governing fixed contact part 503, and the speed governing fixed contact part 503 delivers the main current to the FET 541 via the soldered point 537.

In the embodiment, there are two sliding contact plates 501 and 502 used as the sliding contact part, but it is also possible to use one sliding contact plate or more sliding contact parts. Site 256 of the pivot contact part is installed with a tension spring (not shown), and is subject to the effect of downward tensile force. A cam is connected under the push rod 505. When the push rod 505 is not under the effect of external force, the two sliding contact plates 501 and 502 are firmly attached to the power source negative pole input fixed contact plate 520, the speed governing fixed contact plate does not get electricity, and the cam presses firmly on the salient end of the two pivot contact parts. The left end of the two pivot contact parts lifts up to be disconnected from the 2 contact points of the straight-through contact plate, and the switch is in "OFF" location.

As the push rod 505 moves inward, when the two sliding contact plates 501 and 502 are connected with the speed governing fixed contact plate 503, the speed governing fixed contact plate 503 receives electricity, and the speed governing mode is implemented.

As the push rod 505 moves inwardly, when the cam is also disengaged from its pressure on the salient end of the two pivot contact parts, the two pivot contact parts complete the electric closing for the power source negative pole input fixed contact plate and the straight-through contact plate.

The embodiment illustrated in FIGS. 38-42 may be similar in operation to that of the embodiment illustrated in FIG. 27 from the beginning of work to the entry into the speed governing mode, but closing contact is adopted in a straight-through mode for the pivot contact plates in a parallel connection. Dual channel current division for pivot contact may be implemented in straight-through mode. Compared with a single pivot contact as the pivot contact mode in straight-through status, the switch assembly adds a pair of contact points for contact in straight-through status, so that it is able to reduce the electric current that flows via each contact point, to reduce the total contact resistance and to increase the electric current bearing capacity of the switch. The pivot contact in straight-through status is better than the moving contact in electric current bearing capacity.

FIGS. 50-53 show another preferred embodiment of the present invention. As shown in FIG. 50, the straight-through fixed contact plates 611 and 612 are on the straight-through fixed contact part. During the final part of the portion in which the push rod slides inwardly, or when the push rod slides inwardly to arrive at the most inward location, the sliding contact parts 601 and 602 contact the straight-through fixed contact plate 612, while the output terminal of the pivot contact part 654 contacts with the straight-through fixed contact plate 611. Through the implementation of straight-through feature via two channels, current division is implemented, which may allow reduction of the electric current that flows via each contact point and reduces the total contact resistance and increases the electric current bearing capacity of the switch.

The entire portion from "OFF" to "speed governing" and to "straight-through" is completed through moving contact. The pivot closing device is added at the time of straight-through feature. At this time, in "straight-through" status, two sliding contact plates 601 and 602 and two pivot contact plates 611 and 612 jointly complete the electric connection between the power source negative pole input fixed contact part and the straight-through contact plate. The combination of two groups in sliding contact and two groups in pivot contact further reduces the electric current that flows via each contact point, and reduces the total internal resistance of the switch, which means that the switch temperature is reduced.

Although there are two sliding contact parts 601 and 602 and two pivot contact parts 611 and 612, it may be possible to use the combination of one sliding contact part and one pivot contact part or to use the combination of more sliding contact parts and more pivot contact parts for implementation of contact resistance reduction and current division.

The three embodiments illustrated in FIGS. 27, 38, and 50 all include a reverse mechanism. The present invention can be applied to a switch assembly without the reverse mechanism, and can also be applied to a switch assembly with the reverse mechanism. Based on whether or not there is a need to change the polarity of the voltage delivered from the switch assembly so as to implement the forward rotation or reverse rotation for such equipment as the motor, the switch assembly can be with or without the reverse mechanism.

Figure 54:
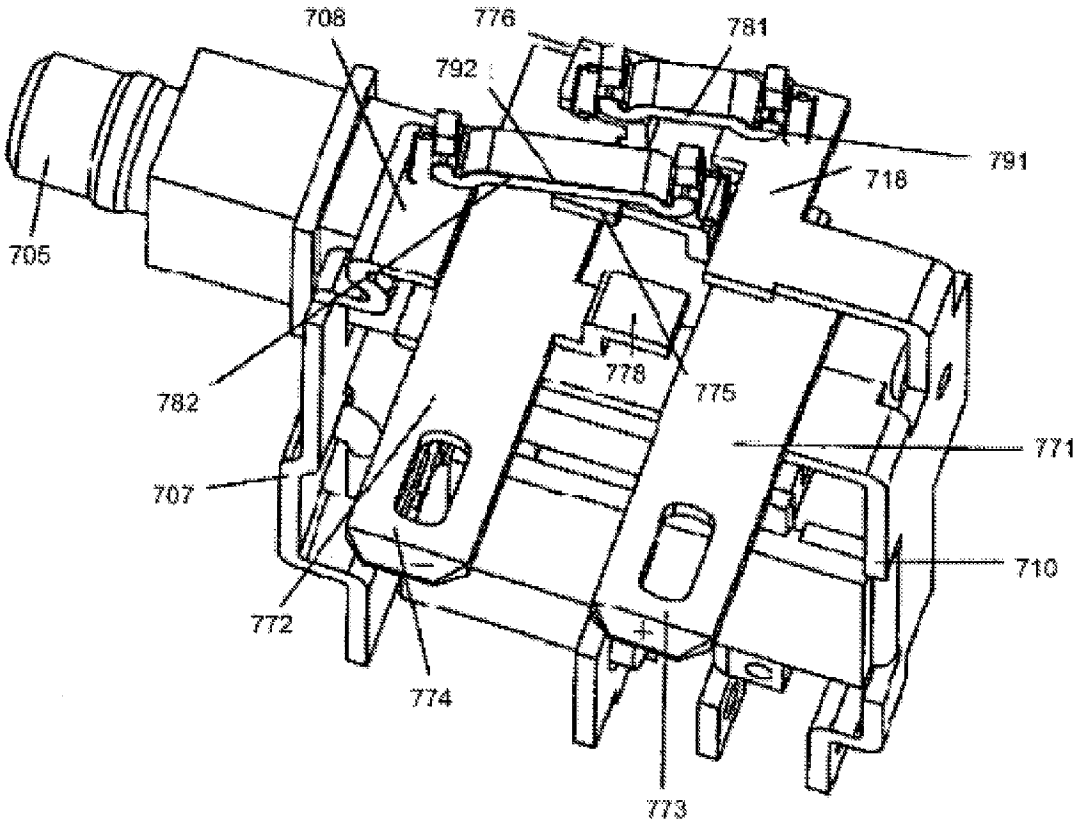
FIG. 54 is a structural representation of a switch assembly with a reverse mechanism according to another embodiment of the present invention.
Figure 55:
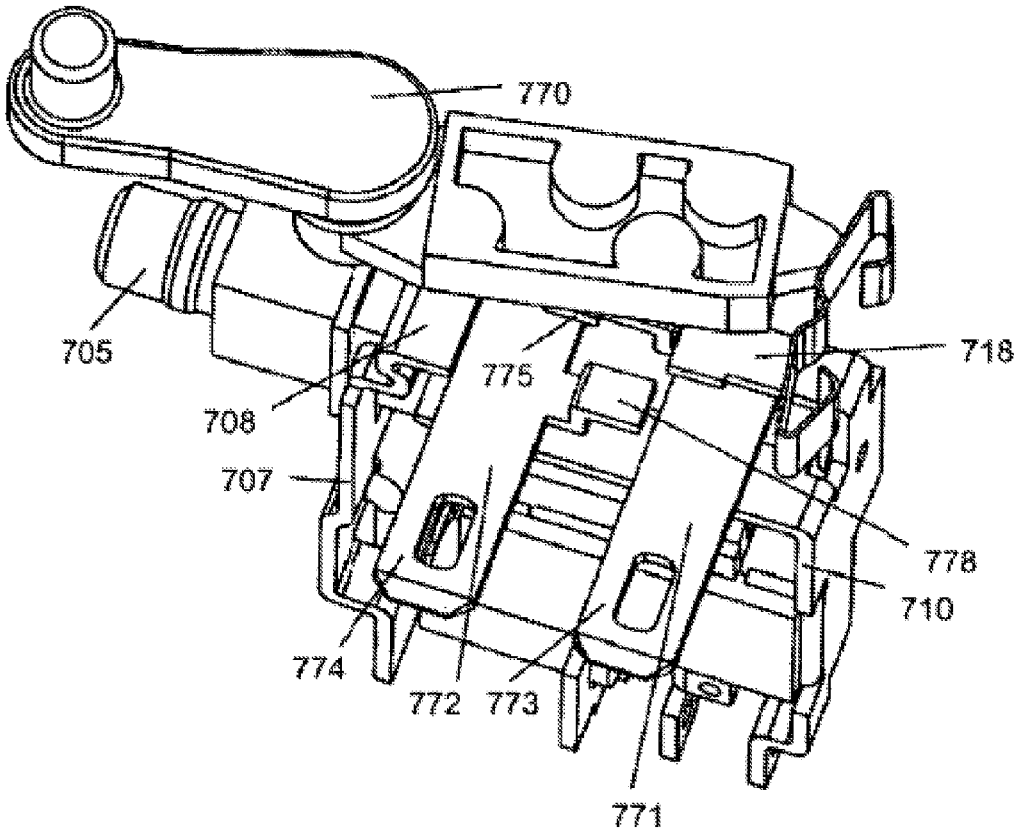
FIG. 55 is another structural representation of the switch assembly with a reverse mechanism according to an embodiment of the present invention.

FIGS. 54-55 illustrate structural representations of the reverse mechanism. The switch assembly includes a housing 206, and may also include the components as mentioned in the previous embodiments or may have the structural features as mentioned in the previous embodiments. As shown in FIGS. 54-55, the switch assembly also includes the power source positive pole input fixed contact part 707 used for electrical connection with the positive pole of the power source, and the power source negative pole input fixed contact part used for electrical connection with the negative pole of the power source as mentioned in previous cases of implementation. The input terminal 709 of the positive pole input fixed contact part 707 is the first input unit, and its output terminal is the first internal output unit. The output terminal is equipped with the positive pole contact plate 708 used as the first internal output reverse fixed contact unit. The input terminal of the power source negative pole input fixed contact part is the second input unit.

The switch also includes the straight-through fixed contact part 710 as the second internal output unit that can be in or out of electrical connection with the power source negative pole input fixed contact part. The input terminal of the straight-through fixed contact part 710 can be in or out of electrical connection with the negative pole input fixed contact part used as the second input unit. The output terminal is equipped with the negative pole contact plate 718 that may be used as the second internal output reverse fixed contact unit.

The first external output part 771, as the first external output unit, is fixed in relation to the housing 206, and its output terminal 773 is used for electrical connection with the input terminal of the electric equipment, such as the motor, under the control of the switch assembly. The switch assembly input terminal is equipped with the contact plate 775 used as the first external output reverse fixed contact unit.

The second external output part 772, as the second external output unit, is fixed in relation to the housing 206, and its output terminal 774 is used for electrical connection with the electric equipment under the control of the switch assembly. The input terminal is equipped with the contact plate 776, used as the second external output reverse fixed contact unit. The first internal output reverse fixed contact unit, the second internal output reverse fixed contact unit, the first external output reverse fixed contact unit and the second external output reverse fixed contact unit include fixed contact surfaces.

Figure 56:
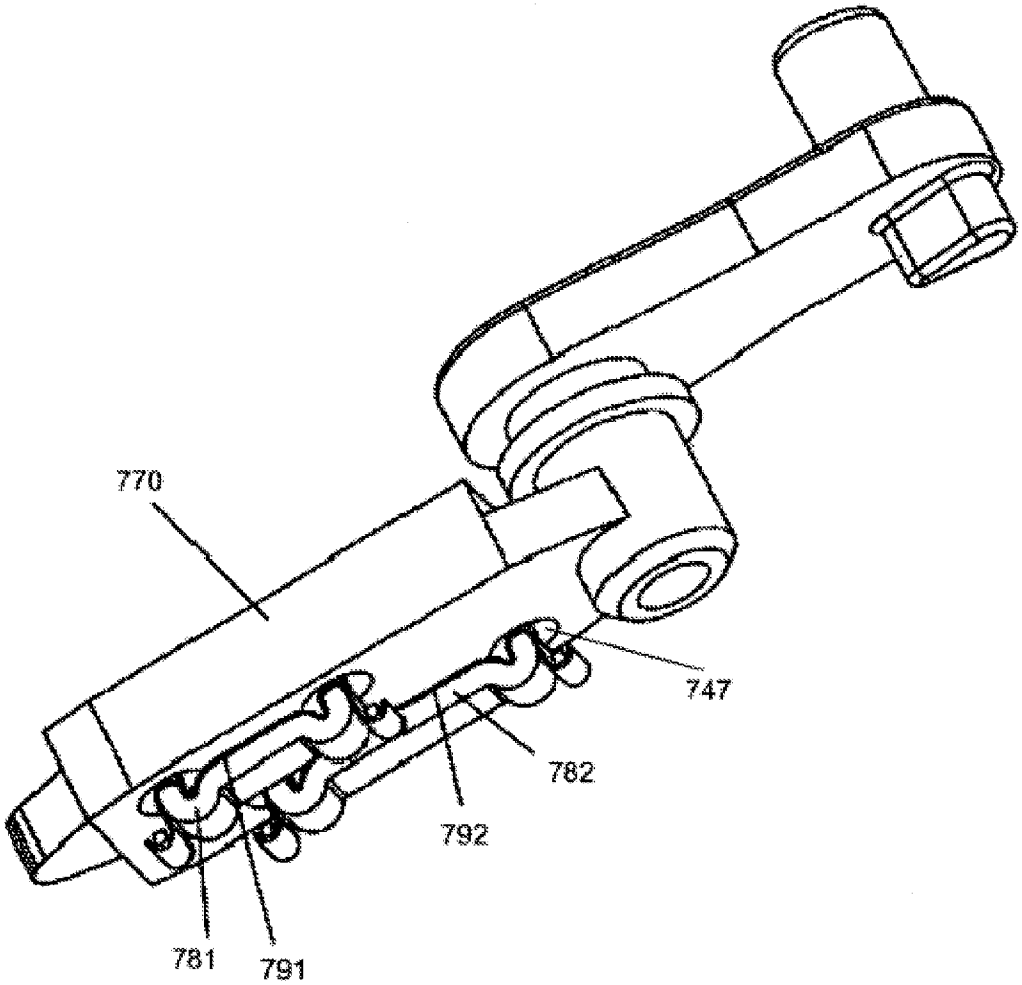
FIG. 56 is a diagram that displays the reverse switching device according to an embodiment of the present invention.
Figure 57:
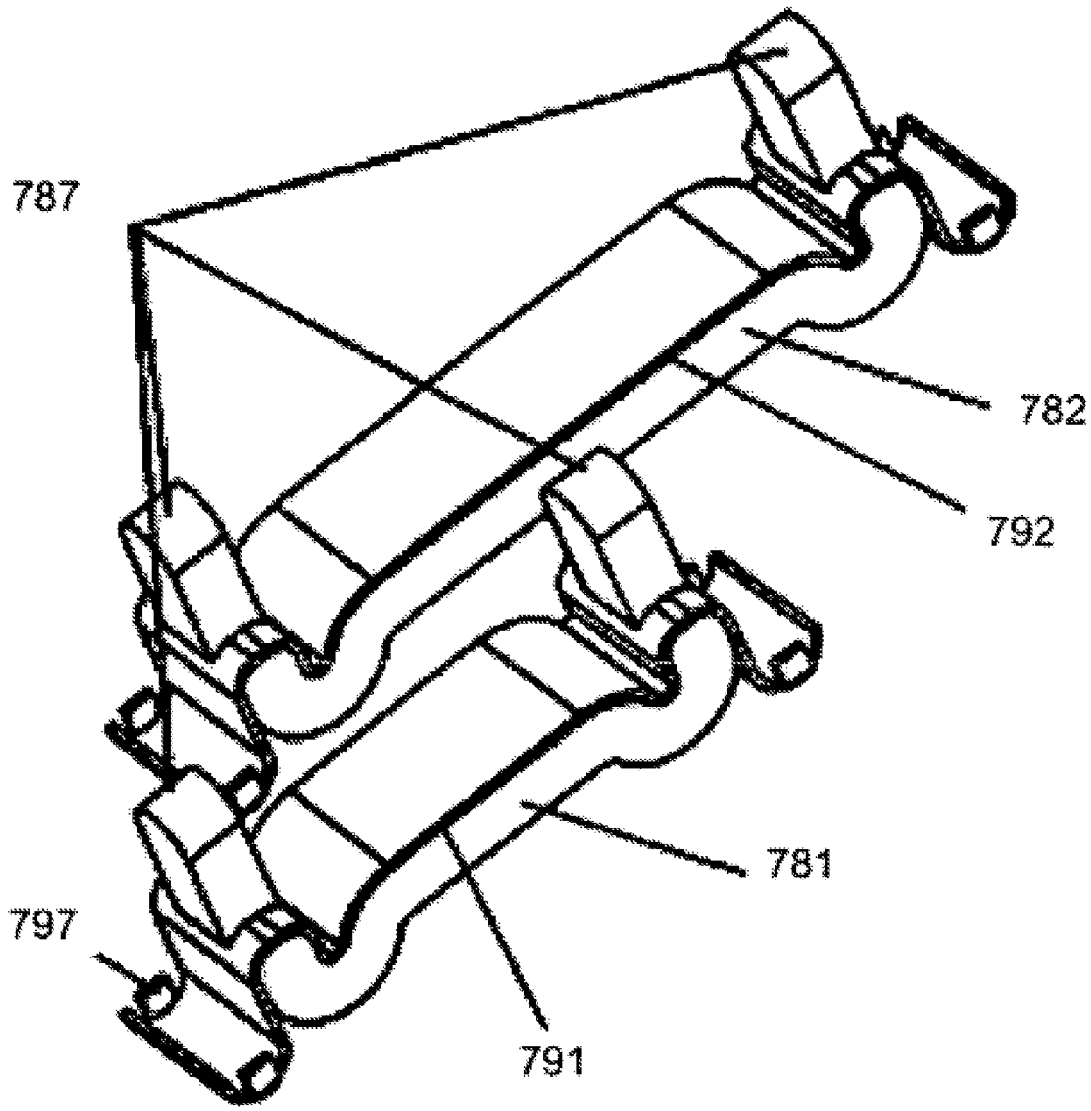
FIG. 57 illustrates a structure for two movable contact devices according to an embodiment of the present invention.
Figure 58:
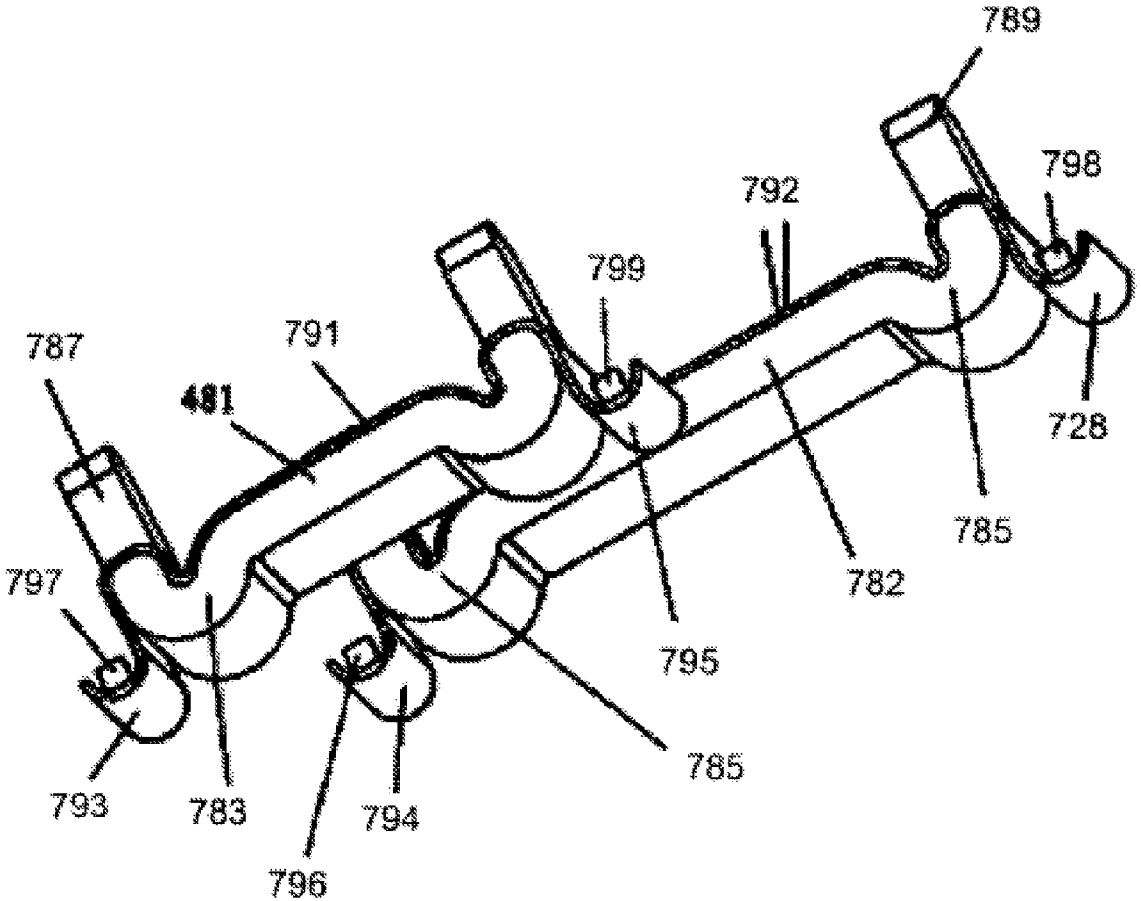
FIG. 58 is illustrates a view of two movable contact devices according to an embodiment of the present invention.
Figure 59:
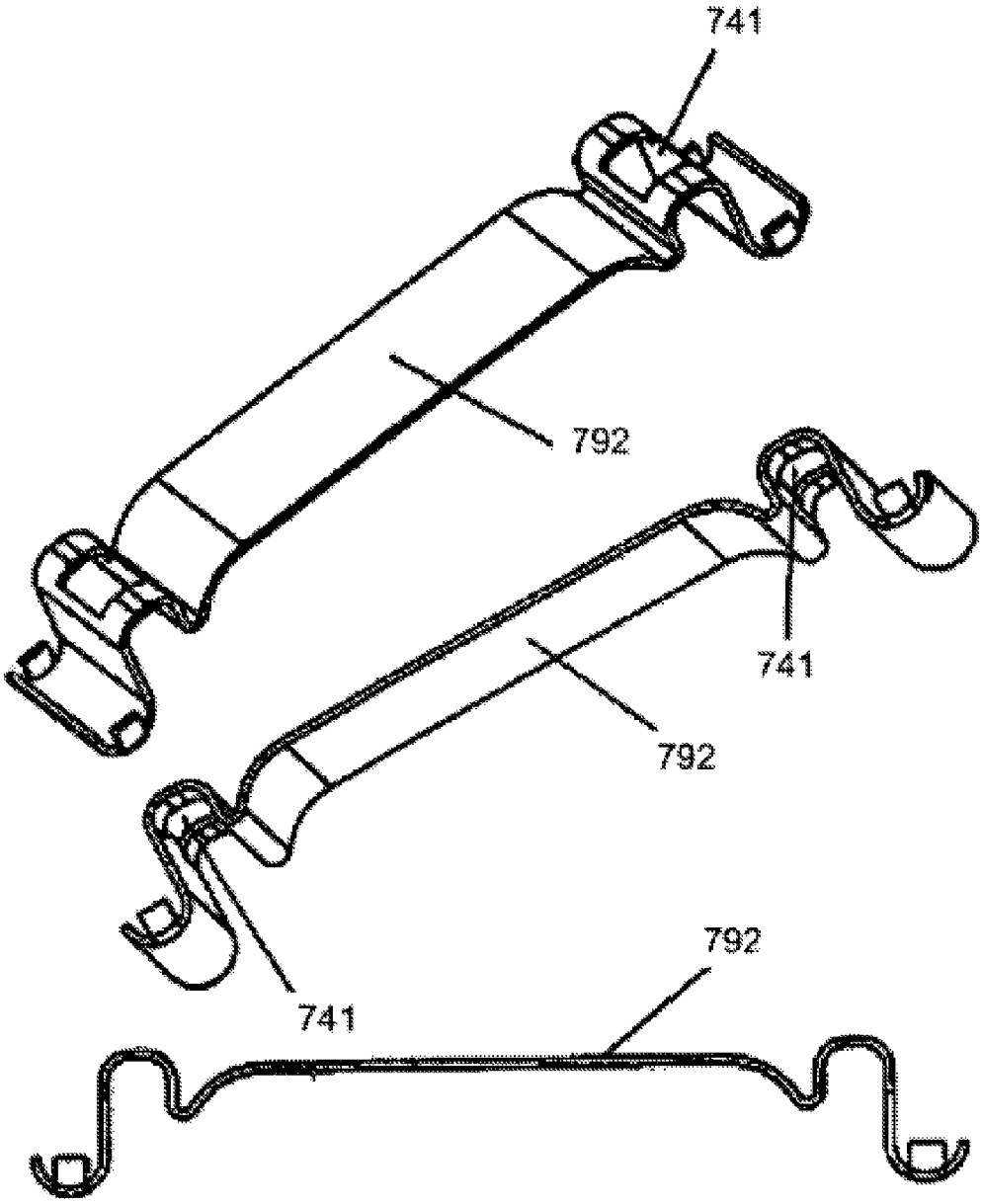
FIG. 59 illustrates the structure of a second movable contact part according to an embodiment of the present invention.
Figure 60:
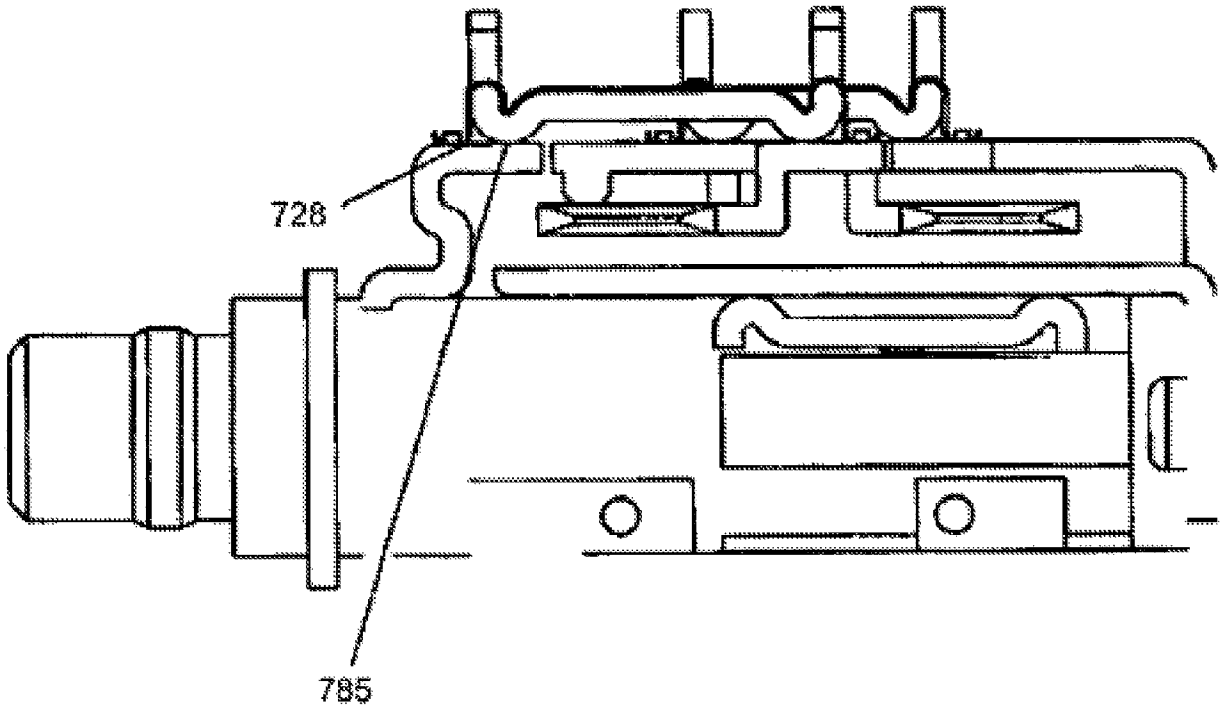
FIG. 60 illustrates the contact between a cambered surface of the first movable contact part and a flat surface of the corresponding contact part according to an embodiment of the present invention.

As shown in FIG. 56, there are four installation holes 747 on the reverse switching device 770. As shown in FIG. 58, each movable contact device is composed of one first movable contact part and one second movable contact part that is more elastic than the first movable contact part. The first movable contact part 781 and the second movable contact part 791 form the first movable contact device. The first movable contact part 782 and the second movable contact part 792 form the second movable contact device. The second movable contact part 792 includes a vertical foot hole 741, which is for the vertical foot 787 on the first movable contact part to insert in. After insertion, a spring (not shown) is covered on the vertical hole 741 so that the second movable contact part 792 is located between the spring and the first movable contact part 782. The vertical foot 787 of the assembled movable contact device, together with the spring, is inserted into the corresponding installation hole 747 of the reverse switching device 770. The reverse switching device 770 is installed to the body of the switch, and the movable contact unit of the movable contact device is made to press firmly on the corresponding fixed contact surface. The electric current that flows via each contact point will be reduced, and the total contact resistance will also be reduced.

After assembly is completed, through switching the reverse switching device, the two movable contact devices can be made to switch in synchronism, and can therefore change the voltage polarity on the output terminals 773 and 774 of the two external output parts. As shown in FIGS. 54-55, when, through the rotating reverse switching device, the movable contact unit of the first movable contact device is made to get in contact with the negative pole contact plate 718 and the input terminal 776 of the second external output part, and the movable contact unit of the second movable contact device is made to get in contact with the positive pole contact plate 708 and the input terminal 775 of the first external output part 771, the output terminal 773 exports positive voltage, while the output terminal 774 exports negative voltage.

When, through the rotating reverse switching device, the movable contact unit of the first movable contact device is made to get in contact with the negative pole contact plate 718 and the input terminal 775 of the first external output part, and the movable contact unit of the second movable contact device is made to get in contact with the positive pole contact plate 708 and the input terminal 778 of the second external output part 772, the output terminal 773 supplies a negative voltage, while the output terminal 774 supplies positive voltage.

As shown in FIG. 58, the movable contact unit 785 on the first movable contact part 782 protrudes from the body of the first movable contact part 782, the elastic movable contact units 794 and 728 on the second movable contact part 792 protrude from the body of said second movable contact part 792. The length of protrusion for the elastic movable contact units 728 and 794 is greater than the length of protrusion for the rigid movable contact unit 785 of the first movable contact part, so as to guarantee the stable rigid contact between the movable contact surface of the rigid movable contact unit 785 and the corresponding fixed contact surface, and the elastic contact between the movable contact surface on the movable contact units 728 and 794 and the fixed contact surface. The input terminal and the output terminal respectively in the first movable contact device and the second movable contact device each includes two movable contact units, and each movable contact unit is equipped with the movable contact surface that is able to be in contact with the fixed contact surface. As the total contact area is increased, the electric current that flows via each contact point is reduced, and the total contact resistance is reduced. More than two movable contact parts can be used for combination into a movable contact device, and the input terminal and the output terminal of such movable contact device will respectively have more than two movable contact units.

The movable contact surface respectively for the two movable contact units of each movable contact part may include a cambered surface. In this way, efficient sliding contact may be implemented with the fixed contact surface that is flat. In addition, two convex plates 796 and 798 are formed, through round and smooth bending, on the movable contact unit of the second movable contact part that is of greater elasticity. A round and smooth transition is formed between the convex plates and the other portions of the contact unit, which facilitates the smooth sliding of the movable contact device.

The thickness for the first movable contact part is greater than that for the second movable contact part, so that the elasticity for the second movable contact part is greater than that for the first movable contact part in implementation. The elasticity difference between the two contact parts may also be implemented through selection of different materials.

When the switch assembly is in a speed governing mode, the power source for the power source negative pole input fixed contact plate will supply the speed governing fixed contact plate with electricity through two sliding contact parts 701 and 702. The power source connects with the straight-through fixed contact plate through the power transistor (FET). When in straight-through feature, the negative pole input fixed contact plate directly connects with the straight-through fixed contact plate via two sliding contact parts (as in the embodiment illustrated in FIG. 27), two pivot contact parts (as in the embodiment illustrated in FIG. 38) or two sliding contact parts and two pivot contact parts (as in the embodiment illustrated in FIG. 50). The straight-through fixed contact plate will be used as the input terminal of the negative pole of the power source to enter one input terminal of the switch forward/reverse switching device, while the power source positive pole input fixed contact plate will be used as the other input terminal of the switch forward/reverse switching device. The input terminal of the negative pole of the power source and the input terminal of the positive pole of the power source will alternate the "+" and "−" polarities at the output terminals through the switching connection mode, so as to implement the forward rotation or backward rotation features (as shown in FIGS. 54-55). In FIGS. 54-55, the site 718 is one terminal for the straight-through fixed contact plate 710 to be used as the forward/reverse switching device, the site 708 is the other terminal for the power source positive pole input fixed contact plate to be used as the forward/reverse switching device, the site 775 is a contact area for the output terminal 771, and the site 776 in a contact area for the output terminal 772.

The two switching contact devices are two groups of combined switching contact devices in different sizes and in similar shapes (as shown in FIGS. 56-60). In FIGS. 56-60, the first switching contact part is made of relatively thick copper material, while the second switching contact part is made of relatively thin copper plate with good elasticity. Due to the combination of the two switching contact parts, all the electric connections for the forward/reverse switching device are made with two contact points in parallel connection, to reduce the electric current that flows via each contact point, to reduce the total contact resistance, and to increase the electric current bearing capacity of the switch.

This switch may provide auxiliary contact into the reverse structure. Two contact areas (one contact area for the existing products) provide one more electric current channel in working status to implement the feature of current division, to reduce the electric current that flows via each contact point, to reduce the total contact resistance, and to increase the electric current bearing capacity of the switch.

FIGS. 61-64 illustrate another preferred embodiment of the present invention. The switch assembly also includes the positive pole input fixed contact part 807 used for electrical connection with the positive pole of the power source, and the power source negative pole input fixed contact part used for electrical connection with the negative pole of the power source as mentioned in the previous embodiments.

Figure 64:
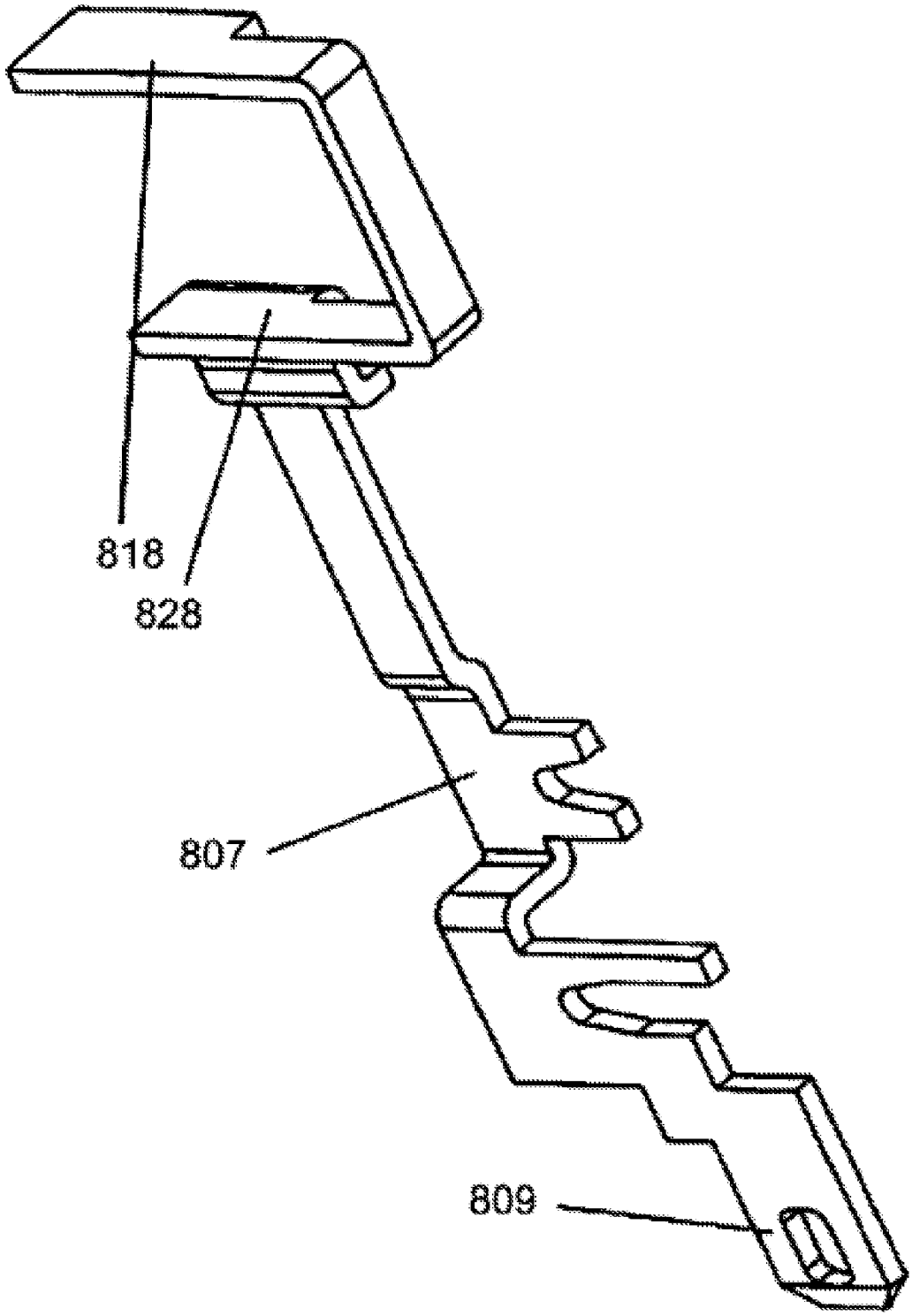
FIG. 64 is a diagram of the structure of the positive pole input fixed contact part according to an embodiment of the present invention.

As shown FIG. 64, the input terminal 809 of the positive pole input fixed contact part 807 is used as the first input unit, and its output terminal is used as the first internal output unit. The first internal output reverse fixed contact unit is on the output terminal. The first internal output reverse fixed contact unit has two branches to form a U shape, and each branch of the U-shape fixed contact unit has a positive pole contact plate, which is either 818 or 828, used as the fixed contact surface.

The switch also includes the straight-through fixed contact part 810 as the second internal output unit that can be in or out of electrical connection with the power source negative pole input fixed contact part. The input terminal of the straight-through fixed contact part 810 can be in or out of electrical connection with the negative pole input fixed contact part used as the second input unit, and the output terminal is equipped with the second internal output reverse fixed contact unit. The second internal output reverse fixed contact unit has two branches to form a U shape, and each branch of the U-shape fixed contact unit has a negative pole contact plate, which is either 848 or 868, used as the fixed contact surface. The straight-through fixed contact part 810 is also equipped with the straight-through fixed contact plates 811 and 812.

Figure 61:
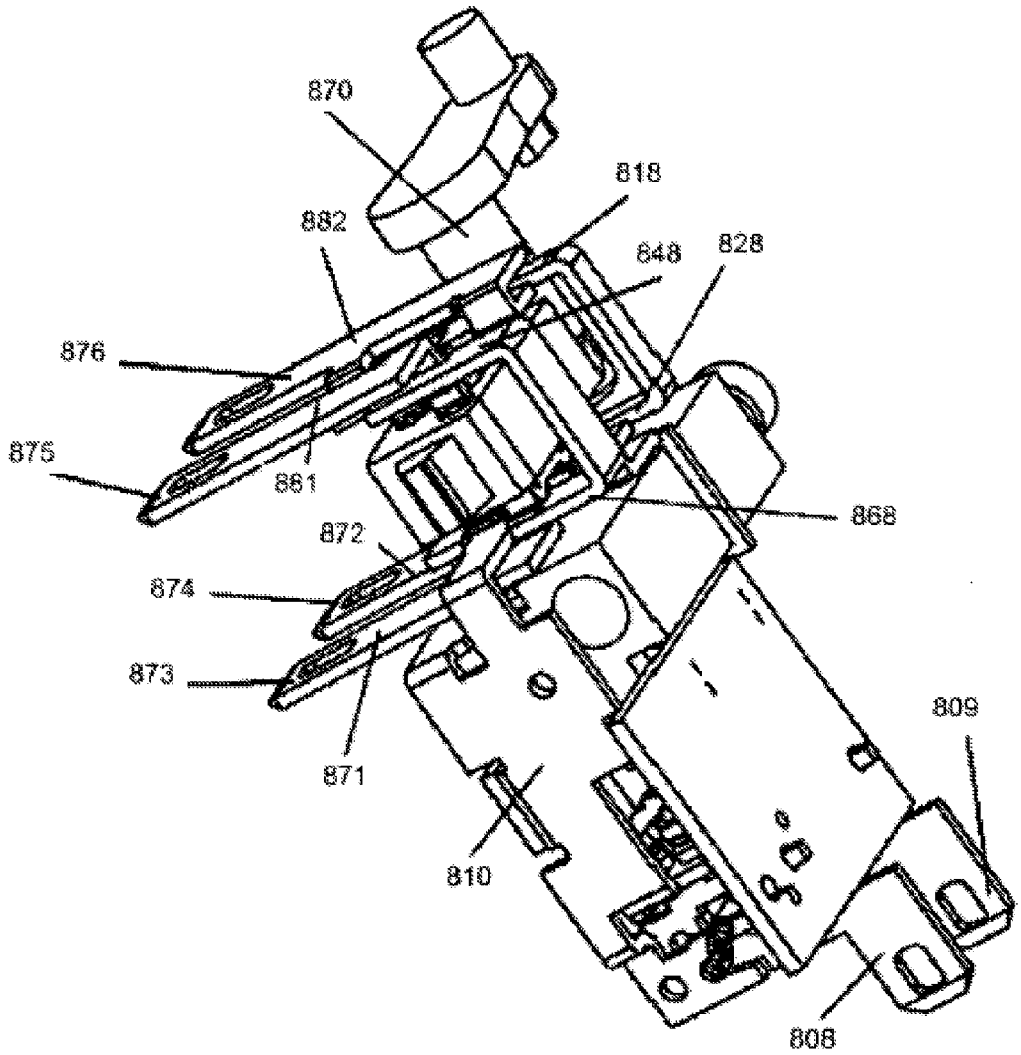
FIG. 61 is a diagram of the structural representation of a switch assembly with a reverse mechanism according to another embodiment of the present invention.

As shown in FIG. 61, the external output contact part 881 and the external output contact part 871 form the first external output unit. The two external output parts 871 and 881 can be connected to form an integrated body or can individually work as an output. The external output contact parts 871 and 881 are respectively equipped with the output terminals 873 and 875, and the two output terminals are used for one pole of the output voltage. The external output contact part 872 and the external output contact part 882 form the second external output unit. The two external output parts 872 and 882 can be connected to form an integrated body or can individually work as an output. The external output contact parts 872 and 882 are respectively equipped with the external output terminals 874 and 876, which are used for the other pole of the output voltage. Each pole has two output terminals for the convenience of wiring.

Figure 62:
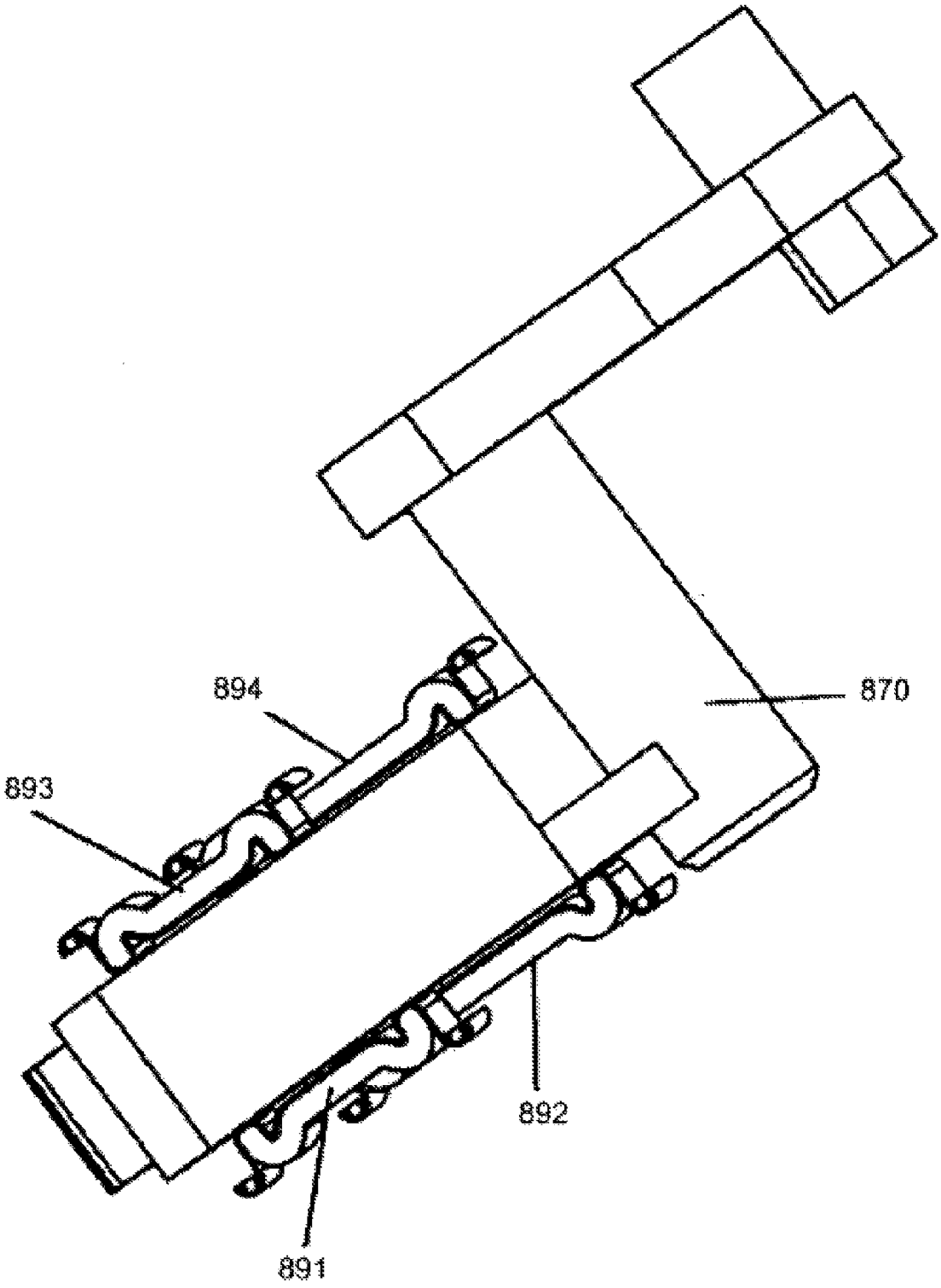
FIG. 62 is a diagram of the structural representation of the reverse switching device according to an embodiment of the present invention.
Figure 63:
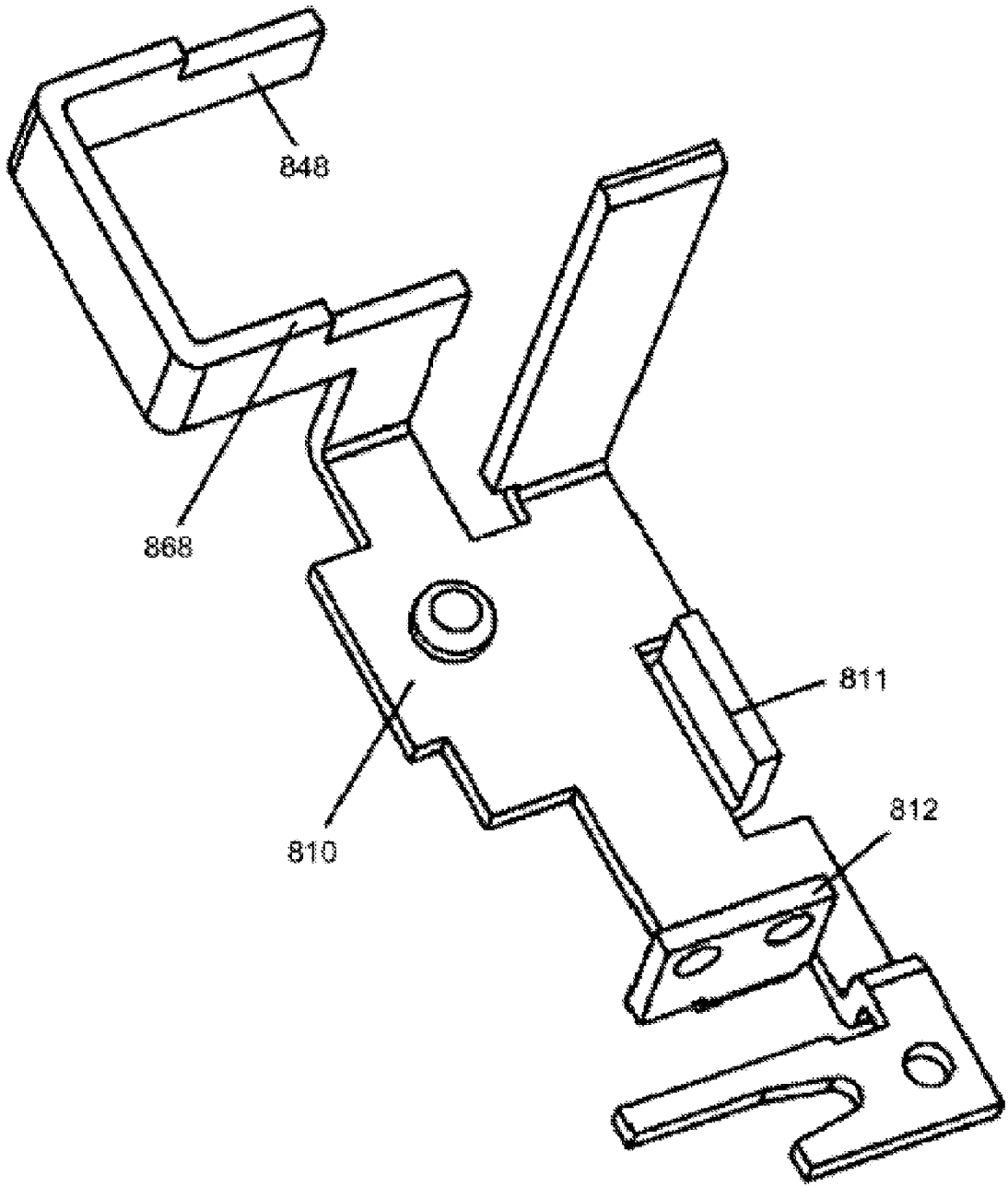
FIG. 63 is a diagram of the structure of a negative pole input fixed contact part according to an embodiment of the present invention.

As shown in FIG. 62, the two side faces of the reverse switching device 870 both carry the movable contact devices. There are 4 vertical foot installation holes (not shown in the diagram) set up on each of the two side faces of the reverse switching device 870. Through these installation holes, the first movable contact device 891 and the second movable contact device 892 are set up on one side face of the reverse switching device 870. The third movable contact device 893 and the fourth movable contact device 894 are fixed on the other side face of the reverse switching device 870. The side face on which the first and second movable contact devices are located and the side face on which the third and fourth movable contact devices are located are parallel and opposite to each other.

The input terminal and the output terminal for each movable contact device respectively include two movable contact units, and each contact unit is equipped with the movable contact surface that can be in contact with said fixed contact surface. Each contact point is of four contact points in parallel connection. Even if only one movable contact unit is connected the movable contact device, as each pole of the voltage uses two movable contact devices for conduction, there are two contact points in parallel connection, to reduce the electric current that flows via each contact point and to reduce the total contact resistance. At this time, all the contact points inside the forward/reverse switching device have increased to 4 contact points in parallel connection, which can further reduce the electric current that flows via each contact point and further reduce the total contact resistance, while the output terminals are expanded so that 873 and 875 become one group and 874 and 876 become one group. The external connecting wire thereof will not increase in wire width due to increase in carrying current, while the two electric tie lines 873 and 875 form one polar connection, and the two electric tie lines 874 and 876 form the other polar connection, which facilitate connection and assembly.

Even if each movable contact device does not include at least two movable contact parts that are fixed together and are able to move together, but is only composed of one movable contact part, as there are two movable contact devices set up for each pole, each pole has at least two contact points in parallel connection.

Figure 65:
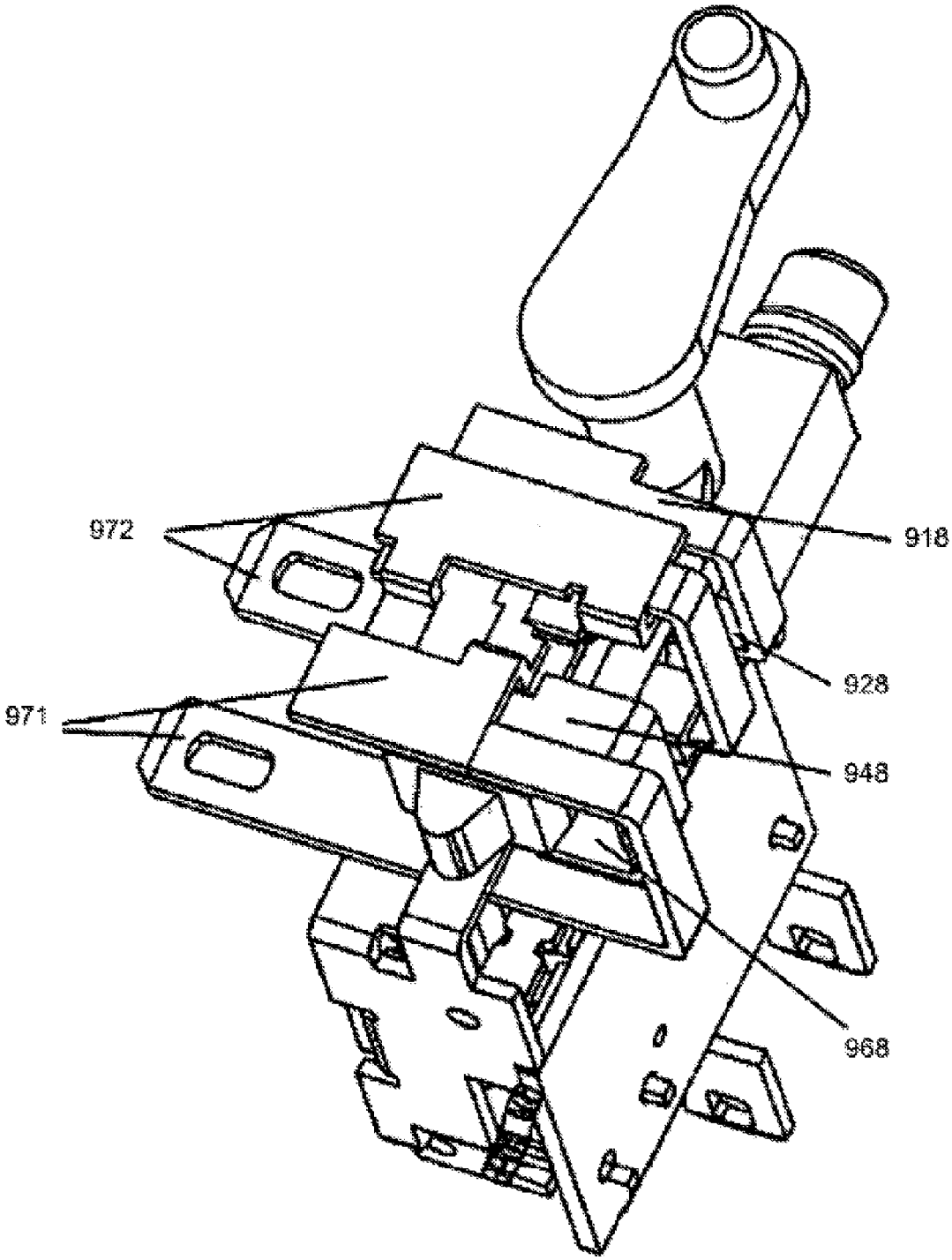
FIG. 65 is a diagram of the structure of the switch assembly with reverse switching structure according to another embodiment of the present invention.
Figure 66:
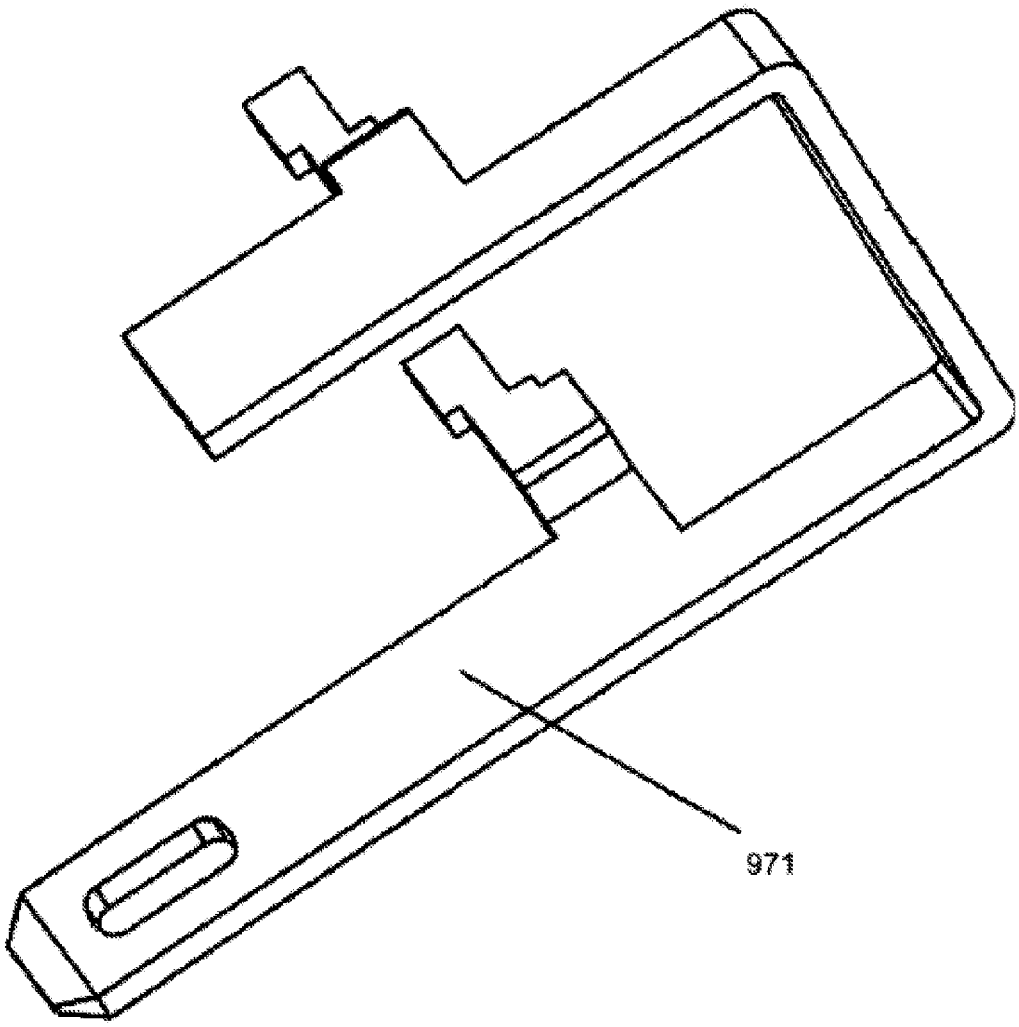
FIG. 66 is a diagram of the structure of the first external output part according to an embodiment of the present invention.
Figure 67:
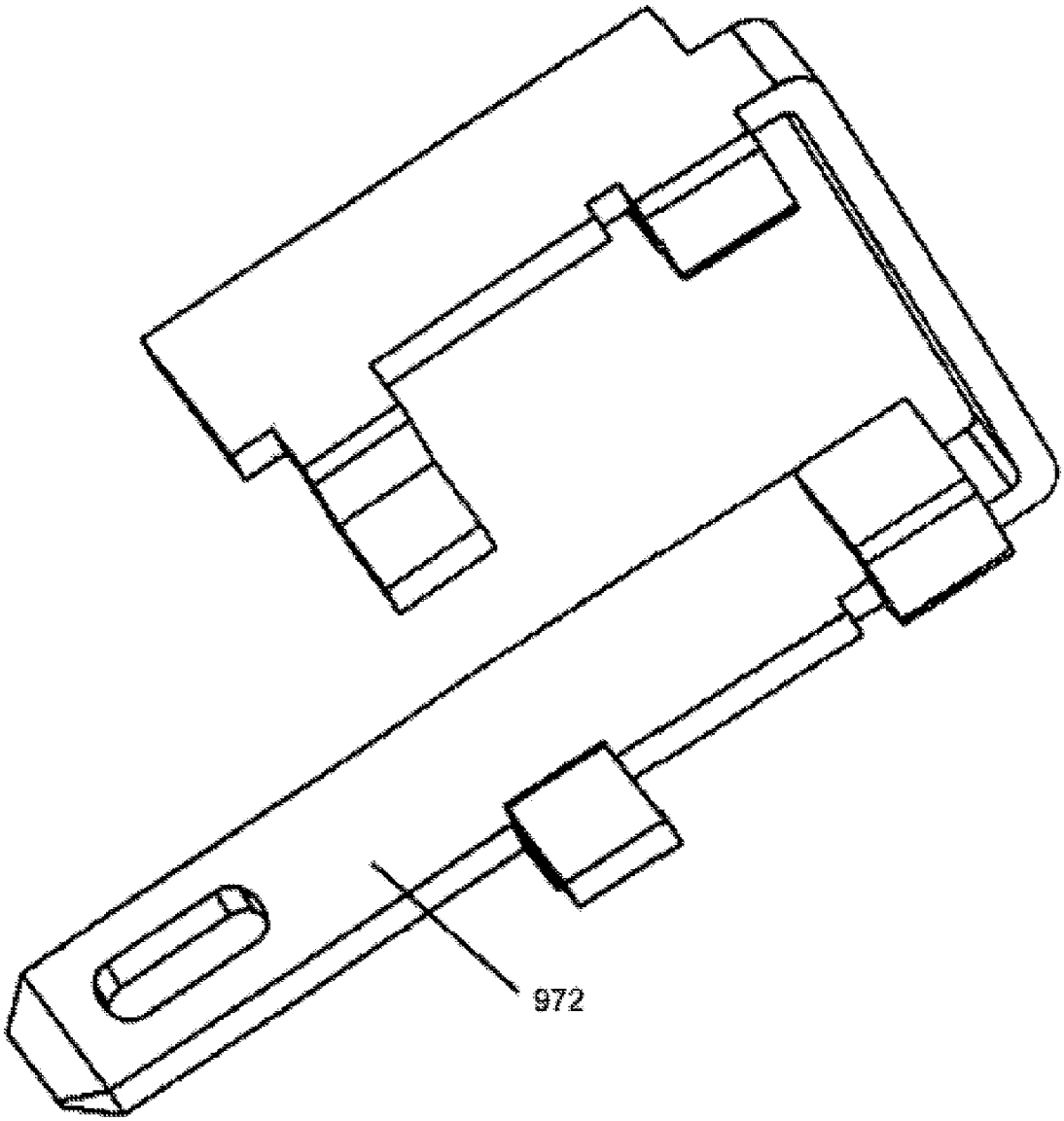
FIG. 67 is a diagram of the structure of the second external output part according to an embodiment of the present invention.

FIGS. 65-67 illustrate another preferred embodiment switch assembly of the present invention. The switch assembly illustrated in FIG. 65 includes first external output unit composed of one integrated external output part 971 and has one output terminal. The second external output unit is composed of one integrated external output part 972 and its output terminal has one output terminal. In addition, the external output parts 971 and 972 are both in a U shape. Each pole has one external terminal, which keeps the internal structure intended for increase of internal contact points from making changes on the external wiring structure, and facilitates wiring. All the contact points inside the forward/reverse switching device have increased to 4 contact points in parallel connection, which can further reduce the electric current that flows via each contact point and further reduce the total contact resistance, while the output terminals are still M1 and M2. The external connecting wire thereof will not change due to a change of internal structure, which may facilitates connection and assembly.

A switch assembly may include the electronic circuit with a speed governing feature, the structure used for speed governing, and the reverse mechanism used to alternate the output voltage polarity. This type of pivot contact part can be used in various types of switches, and can be especially used in the ordinary switch without speed governing feature and reversing feature, as the part in the switch to control electrical disconnection or connection.

This type of switch assembly includes: the housing; the current input unit, one end of which is used for electrical connection with the positive pole or the negative pole of the power source; and at least one pivot contact part. The current input unit can be equipped with a concave structure 455, and the fixed contact unit of the current input unit may be connected to the concave structure 455. The elastic metal plate may be connected to the upper side or lower side of said pivot contact part, and the other portion of the elastic metal plate presses firmly on the top of the upper end of the concave structure or on one side of its upper end, or presses firmly on the portion of the current input unit located below the lower surface of said pivot contact part.

The pivot contact part may be equipped with such structure as that of the pivot contact part 454 or as that of the pivot contact part 554. Elastic metal plates 556 and/or 566, used as an additional contact with said current input unit for electric conduction, are fixed to the pivot contact part, and one portion of the elastic metal plate is fixed to the pivot contact part to make the other portion of the metal plate press firmly on the current input unit through the elasticity of the elastic metal plate to implement supplementary conduction between the pivot contact part and the current input unit. This type of switch structure is also effective for reducing contact resistance. This type of switch can be without a speed governing feature and reversing feature as well as the structural parts as needed for such features.

Another example switch assembly includes a movable contact device used as the reversing part, as in the embodiments illustrated in FIGS. 50, 54, and 61. In the example switch assembly, the movable contact device is used for electrical disconnection or connection instead of reversing. In this type of switch, there may be one movable contact device (used only for opening or closing control on one pole of the voltage) or two movable contact devices (used respectively for opening or closing control on two poles of the voltage). This example switch may include: a housing, a current input unit, a current output unit, and at least two movable contact surfaces. The output terminal of the movable contact device may be disconnected from the fixed contact surfaces of the current output unit, so that it can be stopped from delivering electric current to the current output unit.

The movable contact device may be implemented as the embodiments illustrated in FIGS. 50, 54, and 61, and includes at least two movable contact parts 481 and 491 that are fixed together and are able to move together. The movable contact units are the movable contact units 428 and 485 connected to the movable contact parts 481 and 491, and there are at least two movable contact units connected to each of the movable contact parts. The reverse mechanism in of the embodiments illustrated in FIGS. 50, 54, and 61 can be individually used as well.

As can be understood by a skilled person in the art, a preferred high rating switch assembly may either involve improvements on all or improvement on only one of the aspects as presented by the present invention. When improvement on only one of the aspects is involved, the switch assembly can have its production costs reduced, but still possess an advantageous effect over the existing switches although its performance may not be better than those involving improvements on all the aspects.

A skilled person can further understand that, the improvements of the present invention apply not only to a high rating switch but also to a low rating switch or another conventional switch. When applied to other switches, the performance of the same can be also enhanced by either improvements on all or improvement on only one of the three aspects.

The invention claimed is:

1. A switch assembly, comprising:

a. a casing;

b. a first input terminal secured with respect to said casing;

c. a first internal output terminal secured with respect to said casing and a first external output terminal secured with respect to said casing;

d. a second internal output terminal secured with respect to said casing and a second external output terminal secured with respect to said casing, said first and second internal output terminals connecting said first and second external output terminals respectively via a forward/reverse switch mechanism, said first and second external output terminals being used to connect respectively ports of an electricity consuming device to be controlled by said switch assembly, said first internal output terminal and said first input terminal being in series connection and said second internal output terminal and a second input terminal being in series connection; wherein said forward/reverse switch mechanism comprises a switch contact plate, in which each of said first internal output terminal and said second internal output terminal is provided with two convex contact portions for contacting a contacting surface of said switch contact plate, wherein said two convex contact portion are provided at least in double.

2. A switch assembly as recited in claim 1, wherein two convex contact portions on each internal output terminal are in a wave shape.

3. A switch assembly as recited in claim 2 further comprising:

a. a support secured with respect to said casing and electrically connected to said second input terminal;

b. first and second fixed contact portions arranged in parallel and in parallel connection, said first and second fixed contact portions being secured with respect to said casing and electrically connected to said first and second internal output terminals respectively;

c. a trigger onto which a trigger lever is secured, said trigger lever held on and extending into said casing and being slidable with respect to said casing, a trigger spring being attached to said trigger for functioning to urge said trigger lever and said trigger normally to the outermost position, said trigger being able to be activated by a user from outside said switch assembly;

d. first and second pivot contact levers arranged in parallel and pivotably connected to said support respectively, a pivot contact lever spring being attached to each of said pivot contact levers;

e. first and second cams fixed to said trigger lever, said first cam being configured to pivot said first pivot contact lever so that the latter gets into contact with or disengagement from said first fixed contact portion while said second cam is configured to pivot said second pivot contact lever into contact with or disengagement from said second fixed contact portion during the sliding travel of said trigger lever, said first and second cams being in different shapes so that they can engage said two pivot contact levers at different points of the travel of said trigger lever so that said first cam enables engagement of said first pivot contact lever with said first fixed contact portion prior to that said second cam enables engagement of said second pivot contact lever with said second fixed contact portion when the input and the output are in connection, and said second cam enables disengagement of said second pivot contact lever from said second fixed contact portion prior to that said first cam enables disengagement of said first pivot contact lever from said first fixed contact portion when the input and the output are in disconnection;

f. said switch assembly further comprises an MOSFET, an electronic circuit board containing an electronic circuit and a diode;

g. said first and second cams will press against a respective compressed portion of said first and second pivot contact levers so that said respective pivot contact lever pivots to a state in which the second end thereof is cut off from electric connection to said fixed contact portion by overcoming action force of said pivot contact lever spring when said trigger lever and said trigger are normally in the outermost position;

h. said first cam being able to leave said compressed portion of said first pivot contact lever so that said first pivot contact lever pivots around said connecting point between itself and said support so that the first end of said first pivot contact lever contacts said fixed contact portion so that the circuit formed by said second input terminal, the electronic circuit alternating the output voltage and said second output terminal is closed when said trigger being pressed to overcome the action force from said pivot contact lever spring so that said trigger lever and said trigger simultaneously slide inwardly for a part of the travel, said second pivot contact lever will be closed to connect the circuit from said second input terminal to said second internal output terminal while the output and input voltages being the same when said trigger is further pressed to the innermost position, said trigger lever being able to slide outwardly with the action force from said trigger spring so that said trigger and said trigger lever simultaneously protrude outwardly when said trigger being released.

4. A switch assembly, comprising:

a. a housing;

b. a first input unit configurable for electric connection;

c. a second input unit fixed in relation to said housing;

d. a first internal output unit fixed in relation to the housing, and connected with the first input unit, and having a first internal output reverse fixed contact unit;

e. a second internal output unit fixed in relation to the housing; an input terminal of the second internal output unit configurable to be in electrical connection with or disconnected from said second input unit, and there is a second internal output reverse fixed contact unit at its output terminal; and f. a first external output unit fixed in relation to the housing, where an output terminal of the first external output unit is configurable for electrical connection with electric equipment under the control of the switch assembly, and there is a first external output reverse fixed contact unit at its input terminal.

5. A switch assembly as recited in claim 4, wherein a reverse switching device, a first movable contact device, and a second movable contact device are configured on the reverse switching device;

wherein each of an input terminal and an output terminal in said first movable contact device and said second movable contact device respectively includes at least two movable contact units, where each movable contact unit is equipped with movable contact surfaces that are contactable with a fixed contact surface of one of said fixed contact units; and wherein said reverse switching device is able to switch between a first position and a second position, so that the first movable contact device is able to move between its first position and second position in relation to said housing, and on the first position of said first movable contact device, at least two movable contact surfaces of the input terminal of said first movable contact device are in contact with the fixed contact surface of said first internal output reverse fixed contact unit, and at least two said movable contact surfaces of the output terminal of said first movable contact device are in contact with the fixed contact surface of said second external output reverse fixed contact unit, while on the second position of said first movable contact device, said movable contact surfaces of the input terminal of said first movable contact device are in contact with the fixed contact surface of said first internal output reverse fixed contact unit, and said at least two movable contact surfaces of the output terminal of said first movable contact device are in contact with the fixed contact surface of said first internal output reverse fixed contact unit; and wherein the second movable contact device is able to move between its first position and second position in relation to said housing, and on the first position of said second movable contact device, at least two movable contact surfaces of the input terminal of said second movable contact device are in contact with the fixed contact surface of said second internal output reverse fixed contact unit, and said at least two movable contact surfaces of the output terminal of said second movable contact device are in contact with the fixed contact surface of said first internal output reverse fixed contact unit, while on the second position of said second movable contact device, said at least two movable contact surfaces of the input terminal of said second movable contact device are in contact with the fixed contact surface of said second internal output reverse fixed contact unit, and at least two movable contact surfaces as mentioned of the output terminal of said second movable contact device are in contact with the fixed contact surface of said second internal output reverse fixed contact unit.

6. A switch assembly as recited in claim 5, wherein each of said movable contact devices comprises at least two movable contact parts that are fixed together and are able to move together, said movable contact unit connected to said movable contact part, and there are at least two movable contact units on each of the movable contact parts.

7. A switch assembly as recited in claim 6, wherein the movable contact surfaces for said at least two movable contact units comprise cambered surfaces.

8. A switch assembly as recited in claim 4, wherein the output terminal of the first external output unit is used for electrical connection with the electric equipment under the control of the switch assembly.

9. A switch assembly as recited in claim 4, wherein the second input unit is fixed in relation to said housing and where the input terminal of the second input unit is used for electric connection with one of a positive pole and negative pole of a power source.

10. A switch assembly as recited in claim 9, further comprising:

g. a second external output unit fixed in relation to the housing, where an output terminal of the second external output unit is configurable for electrical connection with the electric equipment under the control of the switch assembly, and a second external output reverse fixed contact unit at its input terminal, and wherein the first internal output reverse fixed contact unit, said second internal output reverse fixed contact unit, said first external output reverse fixed contact unit and said second external output reverse fixed contact unit comprise contact surfaces.

11. A switch assembly as recited in claim 4, wherein the second input unit is fixed in relation to said housing; and one end of the second input unit is used for electric connection with a power source.

12. A switch assembly as recited in claim 11, further comprising:

g. a second external output unit fixed in relation to the housing; wherein a reverse switching device, a first movable contact device, a second movable contact device, a third movable contact device and a fourth movable contact device are connected with the reverse switching device.

13. A switch assembly as recited in claim 12, wherein an input terminal and an output terminal for each of said movable contact devices respectively include at least one movable contact unit, each movable contact unit is equipped with movable contact surfaces that are able to be in contact with a fixed contact surface of one or said fixed contact units, where said reverse switching device is able to switch between its first position and second position, so that the first movable contact device and said third movable contact device are able to move between the first position and second position thereof in relation to said housing, and on the first position of said first movable contact device and said third movable contact device, at least one movable contact surface of the input terminal of said first movable contact device and at least one movable contact surface of the input terminal of said third movable contact device are respectively in contact with the two fixed contact surfaces on the U shape branch of said first internal output reverse fixed contact unit, and at least one movable contact surface of the output terminal of said first movable contact device and at least one movable contact surface of the output terminal of said third movable contact device are respectively in contact with said fixed contact surfaces on the two branches of said second external output reverse fixed contact unit for said U shape, while on the second position of said first movable contact device and said third movable contact device, said movable contact surface of the input terminal of said first movable contact device and said movable contact surface of the input terminal of said third movable contact device are still respectively in contact with the fixed contact surfaces on the two branches of said first internal output reverse fixed contact unit for the U shape, and at least one movable contact surface as mentioned of the output terminal of said first movable contact device and said movable contact surface of the input terminal of said third movable contact device are respectively in contact with the fixed contact surfaces on the two branches of said first external output reverse fixed contact unit; and wherein the second and the fourth movable contact devices are able to move between the first position and second position thereof in relation to said housing, and on the first position of said second and the fourth movable contact devices, said at least one movable contact surface of the input terminal of said second movable contact device and said at least one movable contact surface of the input terminal of said fourth movable contact device are respectively in contact with said fixed contact surfaces on the two branches of said second internal output reverse fixed contact unit for the U shape, and said at least one movable contact surface of the output terminal of said second movable contact device and said at least one movable contact surface of the output terminal of said fourth movable contact device are respectively in contact with said fixed contact surfaces on the two branches of said first external output reverse fixed contact unit, while on the second position of said second and the fourth movable contact devices, said at least one movable contact surface of the input terminal of said second movable contact device and said at least one movable contact surface of the input terminal of said fourth movable contact device are still respectively in contact with the fixed contact surfaces on the two branches of said second internal output reverse fixed contact unit for the U shape, and said at least one movable contact surface of the output terminal of said second movable contact device and said at least one movable contact surface of the output terminal of said fourth movable contact device are respectively in contact with the fixed contact surfaces of said second external output reverse fixed contact unit.

14. A switch assembly, comprising:

a. a housing; and b. a current input unit, one end of which is configurable for connection to a power source;

a current output unit configurable to receive electric current delivered from at least one movable contact device between said current output unit and said current input unit, and to deliver the received electric current to other parts of said switch assembly or to power-driven equipment under the control of the switch assembly, wherein said current input unit and said current output unit are both equipped with fixed contact units, and fixed contact surfaces are set up on each of said fixed contact units; and wherein said movable contact device is equipped with an input terminal and an output terminal, said input terminal and said output terminal respectively include at least two movable contact units each, and each movable contact unit is equipped with a movable contact surface that is able to be in contact with said fixed contact surface; and wherein said movable contact device is able to move between a first position and a second position in relation to said housing, and on the first position of said movable contact device, at least two movable contact surfaces of the input terminal of said movable contact device are in contact with the fixed contact surface of said current input unit, and at the same time, at least two movable contact surfaces of the output terminal of said first movable contact device are in contact with the fixed contact surface of said current output unit, so that said movable contact device is able to receive electric current from said current input unit and to deliver the received electric current to the current output unit via said movable contact device on the second position of said movable contact device, and where said at least two movable contact surfaces of the output terminal of said movable contact device are disconnected from the fixed contact surfaces of said current output unit, so that it can be stopped from delivering electric current to said current output unit;

wherein said movable contact device comprises at least two movable contact parts fixed together and are able to move together, and where said movable contact unit is connected to said movable contact part, and said at least two movable contact units are connected to each of the movable contact parts; and wherein at least one first movable contact part and at least one second movable contact part are included in said at least two movable contact parts; the movable contact unit on said first movable contact part protrudes from the body of said first movable contact part, and said elastic movable contact unit protrudes from the body of said second movable contact part, and the length of protrusion for said elastic movable contact unit is greater than the length of protrusion for said rigid movable contact unit, so as to make the movable contact surface of said rigid movable contact unit in stable rigid contact with said corresponding fixed contact surface, and that the movable contact surface of said elastic movable contact unit is in elastic contact with said fixed contact surface.

* * * * *